US009091456B2

(12) United States Patent
Sakashita et al.

(10) Patent No.: US 9,091,456 B2
(45) Date of Patent: Jul. 28, 2015

(54) INDOOR UNIT OF AIR CONDITIONER

(75) Inventors: Akihiko Sakashita, Osaka (JP); Yoshiharu Michitsuji, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 1626 days.

(21) Appl. No.: 12/600,360

(22) PCT Filed: May 19, 2008

(86) PCT No.: PCT/JP2008/001249

§ 371 (c)(1),
(2), (4) Date: Nov. 16, 2009

(87) PCT Pub. No.: WO2008/142863

PCT Pub. Date: Nov. 27, 2008

(65) Prior Publication Data

US 2010/0159818 A1 Jun. 24, 2010

(30) Foreign Application Priority Data

May 17, 2007 (JP) ..... 2007-132053
Nov. 27, 2007 (JP) ..... 2007-305929
Jan. 10, 2008 (JP) ..... 2008-003216

(51) Int. Cl.

*F25D 23/00* (2006.01)
*F24F 13/28* (2006.01)
*F24F 1/00* (2011.01)
*F24F 3/16* (2006.01)

(52) U.S. Cl.

CPC ..... *F24F 13/28* (2013.01); *F24F 1/0007* (2013.01); *F24F 2001/0037* (2013.01); *F24F 2003/1639* (2013.01)

(58) Field of Classification Search

USPC ..... 454/233
See application file for complete search history.

(56) References Cited

U.S. PATENT DOCUMENTS 5,388,426 A * 2/1995 Wada et al. ..... 62/263
6,102,012 A * 8/2000 Iiboshi et al. ..... 123/556
6,164,082 A * 12/2000 Okamoto et al. ..... 62/317
8,038,517 B2 * 10/2011 Shibuya et al. ..... 454/187
2007/0060036 A1 * 3/2007 Shibuya et al. ..... 454/187
2009/0042502 A1 * 2/2009 Kim et al. ..... 454/139
2010/0159818 A1 * 6/2010 Sakashita et al. ..... 454/233

(Continued)

FOREIGN PATENT DOCUMENTS

EP 2110618 A1 10/2009
JP 2004-156794 A 6/2004
JP 2004-301363 A 10/2004

(Continued)

OTHER PUBLICATIONS

JP2004_156794 EPO machine English translation.*
JP2006_071121 EPO machine English translation.*

*Primary Examiner* — Steven B McAllister
*Assistant Examiner* — Samantha Miller
(74) *Attorney, Agent, or Firm* — Birch, Stewart, Kolasch & Birch, LLP

(57) ABSTRACT

A casing (34) contains a rotating brush (151) for removing dust on an air filter (40), and a dust container (160) for containing the removed dust. A supply duct (71) through which air blowing from an indoor fan (39) enters the dust container (160), and a discharge duct (74) through which the dust contained in the dust container (160) is discharged out of the casing (34) together with the air are provided.

19 Claims, 38 Drawing Sheets

(56) References Cited

U.S. PATENT DOCUMENTS

2010/0317282 A1* 12/2010 Okada et al. ..... 454/292
2010/0323606 A1* 12/2010 Okada et al. ..... 454/338

FOREIGN PATENT DOCUMENTS

JP 2005-241093 A 9/2005
JP 2006-71121 A 3/2006

* cited by examiner (a)

(b)

(a)

(b)

(A)

(B)

(A)

(B)

INDOOR UNIT OF AIR CONDITIONER

TECHNICAL FIELD

The present invention relates to an indoor unit of an air conditioner, particularly to measures to discharge dust removed from an air filter.

BACKGROUND ART

Among indoor units of air conditioners having an air filter at an air inlet, those provided with a dust removing unit for removing dust trapped on the air filter have been known. An indoor unit of this type includes a container box for containing the removed dust, and a user needs to detach the container box to dispose of the dust. However, since the indoor unit of this type is generally installed at high elevations in a room, the detaching/attaching of the container box is burdensome particularly for elderly people and women.

To solve this problem, for example, Patent Document 1 proposes an air conditioner having a function of automatically discharging the dust removed from the air filter out of the indoor unit (to the outside of the room).

Specifically, the air conditioner of Patent Document 1 includes an indoor unit containing a dust removing unit (a dirt removing box) for removing the dust on the air filter. An outdoor unit contains a dirt collecting box and a vacuum suction fan. The dirt removing box in the indoor unit and the dirt collecting box in the outdoor unit are connected through a dirt transfer pipe. In this air conditioner, the dirt (dust) is removed from the air filter by the dirt removing box, and the dirt is sucked into the dirt collecting box by the vacuum suction fan. Thus, the dirt trapped on the air filter can be discharged outside the unit without any troubles to users.

[Patent Document 1] Published Unexamined Patent Publication No. 2004-301363

DISCLOSURE OF THE INVENTION

Problem that the Invention is to Solve

According to the air conditioner of the Patent Document 1, however, the vacuum suction fan is used to transfer the dust removed from the air filter to a selected location, thereby increasing the cost, and upsizing the apparatus (the indoor unit). In particular, since the transfer and disposal of the dust are not performed very frequently, the provision of the vacuum suction fan only for this purpose is not economy.

From this point of view, the present invention has been developed. The invention is directed to an indoor unit of an air conditioner having a function of removing dust from an air filter, and intends to easily transfer the removed dust to a predetermined location without upsizing the apparatus.

Means of Solving the Problem

In a first aspect of the invention, the invention is directed to an indoor unit of an air conditioner including: a casing (34) containing an indoor heat exchanger (37), an indoor fan (39) for sucking air from inside of a room, and an air filter (40) arranged on an inlet side of the indoor fan (39). The indoor unit of the air conditioner of the present invention includes a dust removing unit (50) for removing dust trapped on the air filter (40), and a dust transfer unit (70) for transferring the dust removed by the dust removing unit (50) to a predetermined location using air blowing from the indoor fan (39).

According to the above-described aspect of the invention, when the air sucked into the casing (34) by the indoor fan (39) passes through the air filter (40), dust contained in the air is trapped on the air filter (40). The dust trapped on the air filter (40) is removed by the dust removing unit (50). The removed dust is transferred to a predetermined location (e.g., outside the casing (34)) by the air blowing from the indoor fan (39). Specifically, the dust removed from the air filter (40) is transferred to another location by the air blowing from the indoor fan (39).

In a second aspect of the invention related to the first aspect of the invention, the indoor fan (39) is arranged to blow the air sucked from the inside of the room to the indoor heat exchanger (37). The dust transfer unit (70) is configured to transfer the dust removed by the dust removing unit (50) to the predetermined location using the air blowing from the indoor fan (39) and before passing through the indoor heat exchanger (37).

According to the above-described aspect of the invention, the dust removed by the dust removing unit (50) is transferred to the predetermined location by the air which is not yet supplied to the indoor heat exchanger (37).

In a third aspect of the invention related to the first aspect of the invention, the indoor unit of the air conditioner further includes: a dust container (60) for containing the dust removed by the dust removing unit (50). The dust transfer unit (70) is configured to bring the air blowing from the indoor fan (39) into the dust container (60) so as to transfer the dust contained in the dust container (60) to the predetermined location together with the air.

According to the above-described aspect of the invention, the dust removed from the air filter (40) is contained in the dust container (60). Bringing the air blowing from the indoor fan (39) into the dust container (60) transfers the dust in the dust container (60) to the predetermined location.

In a fourth aspect of the invention related to the third aspect of the invention, the indoor fan (39) is arranged to blow the air sucked from the inside of the room to the indoor heat exchanger (37). The dust transfer unit (70) is configured to bring the air blowing from the indoor fan (39) and before passing through the indoor heat exchanger (37) to the dust container (60).

According to the above-described aspect of the invention, the air which is not yet supplied to the indoor heat exchanger (37) is brought into the dust container (60), thereby transferring the dust in the dust container (60) to the predetermined location.

In a fifth aspect of the invention related to the fourth aspect of the invention, the dust transfer unit (70) includes a supply duct (71) arranged between the indoor heat exchanger (37) and the indoor fan (39) to bring the air blowing from the indoor fan (39) into the dust container (60), and a discharge duct (74) through which the dust contained in the dust container (60) is transferred to the predetermined location together with the air.

According to the above-described aspect of the invention, the air blowing from the indoor fan (39) flows into the supply duct (71), and is supplied to the dust container (60). The dust in the dust container (60) is transferred to the predetermined location together with the air through the discharge duct (74).

In a sixth aspect of the invention related to the third aspect of the invention, the dust transfer unit (70) includes an open/close means (72) for opening/closing an inlet port into which the air blowing from the indoor fan (39) enters.

According to the above-described aspect of the invention, an inlet port through which the air blowing from the indoor fan (39) is brought into the dust container (60) is opened/ closed by the open/close means (72) as required. For example, the inlet port is closed by the open/close means (72) in normal operation, and is opened by the open/close means (72) in cleaning the air filter (40). Thus, the air blowing from the indoor fan (39) is brought into the dust container (60) only when the filter cleaning is required.

In a seventh aspect of the invention related to the third aspect of the invention, the dust transfer unit (70) includes an air collecting plate (91) on an inlet port to which the air blowing from the indoor fan (39) is introduced.

According to the above-described aspect of the invention, the air blowing from the indoor fan (39) is trapped by the air collecting plate (91). Specifically, the air blowing from the indoor fan (39) easily flows to the air collecting plate (91), and therefore, the air blowing from the indoor fan (39) is easily brought into the dust container (60). This increases the amount of air brought into the dust container (60), thereby allowing for easy transfer of the dust in the dust container (60) to the predetermined location.

In an eighth aspect of the invention related to the third aspect of the invention, the dust transfer unit (70) is configured to transfer the dust contained in the dust container (60) outside the casing (34).

According to the above-described aspect of the invention, the dust in the dust container (60) is transferred outside the casing (34), e.g., to space above a ceiling of the room.

In a ninth aspect of the invention related to the third aspect of the invention, the indoor unit of the air conditioner further includes: a dust collection box (92) larger in volume than the dust container (60). The dust transfer unit (70) is configured to transfer the dust contained in the dust container (60) to the dust collection box (92).

According to the above-described aspect of the invention, the dust is transferred from the dust container (60) to the dust collection box (92), and is contained therein. Since the dust collection box (92) has a large volume, it can contain a large amount of dust.

In a tenth aspect of the invention related to the second or fourth aspect of the invention, an adjuster plate (23*a*) for adjusting a flow direction of the air is provided at an outlet (23) through which the air blowing from the indoor fan (39) is supplied to the inside of the room. The adjuster plate (23*a*) is adjusted to maximize flow resistance of the outlet (23) when the dust transfer unit (70) is transferring the dust.

According to the above-described aspect of the invention, the flow resistance of the outlet (23) is maximized when the dust is transferred from the dust container (60). The amount of air blowing out of the outlet (23) decreases, thereby increasing the amount of air brought into the dust container (60). This increases the amount of dust transferred from the dust container (60).

In an eleventh aspect of the invention related to the second or fourth aspect of the invention, supply of a heating medium to the indoor heat exchanger (37) is stopped when the dust transfer unit (70) is transferring the dust.

According to the above-described aspect of the invention, for example, in an air conditioner (10) including a refrigerant circuit (18) for performing a vapor compression refrigeration cycle, supply of a refrigerant to the indoor heat exchanger (37) is stopped in transferring the dust from the dust container (60). Therefore, the air blowing from the indoor fan (39) is not cooled or heated in the indoor heat exchanger (37).

In a twelfth aspect of the invention related to the second or third aspect of the invention, the number of rotations of the indoor fan (39) is maximized when the dust transfer unit (70) is transferring the dust.

According to the above-described aspect of the invention, the number of rotations of the indoor fan (39) is maximized in transferring the dust. This increases the amount of air blowing from the indoor fan (39), thereby increasing the amount of air brought into the dust container (60). Therefore, the amount of dust transferred from the dust container (60) increases.

In a thirteenth aspect of the invention related to the third aspect of the invention, the dust removing unit (50) includes a brush member (51) provided in the dust container (60) and is in contact with the air filter (40), and a filter moving unit (52) for moving the air filter (40) relative to the brush member (51).

According to the above-described aspect of the invention, the filter moving unit (52) moves the air filter (40), with the air filter (40) kept in contact with the brush member (51). As the air filter (40) moves, the dust on the air filter (40) is scraped (removed) by the brush member (51). The dust removed by the brush member (51) is contained in the dust container (60).

In a fourteenth aspect of the invention related to the thirteenth aspect of the invention, an open/close means (72) for opening/closing the inlet port by moving the air filter (40) is arranged at the inlet port of the dust transfer unit (70) into which the air blowing from the indoor fan (39) enters.

According to the above-described aspect of the invention, the inlet port of the dust transfer unit (70) is automatically opened/closed by moving the air filter (40). For example, the open/close means (72) automatically opens the inlet port when the dust is removed from every part of the air filter (40). Therefore, after the dust removal is finished, the air blowing from the indoor fan (39) is brought into the dust container (60), thereby transferring all the removed dust to the predetermined location.

In a fifteenth aspect of the invention related to the thirteenth aspect of the invention, the brush member (51) of the dust removing unit (50) includes a bristle portion (51*b*) made of pile fabric and in contact with the air filter (40).

According to the above-described aspect of the invention, the air filter (40) moves while it is kept in contact with the bristle portion (51*b*) of the brush member (51). As the air filter (40) moves, the dust on the air filter (40) is scraped (removed) by the bristle portion (51*b*). Since the bristle portion (51*b*) is made of pile fabric, bristles of the bristle portion (51*b*) are relatively short. Therefore, in the dust container (60), the flow of the air blowing from the indoor fan (39) is not disturbed very much by the bristles of the bristle portion (51*b*). That is, the blowing air easily flows in the dust container (60).

In a sixteenth aspect of the invention related to the thirteenth aspect of the invention, the brush member (51) is arranged in an opening (62) formed in an upper surface of the dust container (60). An edge (6*c*) of the opening (62) positioned rearward of the brush member (51) in the direction of movement of the air filter (40) functions as a guide for allowing the dust on the air filter (40) that passed over the brush member (51) to move together with the air filter (40).

According to the above-described aspect of the invention, the brush member (51) is arranged in the opening (62) of the dust container (60), and is in contact with the air filter (40). As the air filter (40) moves to pass over the brush member (51), the dust adhered to the air filter (40) is scraped by the brush member (51). However, all the dust is not always scraped, and the dust not scraped still adheres to the air filter (40), or remains separated from the air filter (40). The remaining dust moves rearward of the brush member (51) (i.e., rearward in the direction of movement of the air filter (40)) as the air filter (40) moves.

If the edge (6*c*) of the opening (62) rearward of the brush member (51) is not particularly devised, the dust that passed over the brush member (51) is disturbed by the edge (6*c*), and stays in a gap between the edge (6*c*) and the brush member (51). Specifically, the air filter (40) moves, but the dust remains in the gap between the edge (6*c*) and the brush member (51). The remaining dust gradually grows into a cluster of a certain size, and is flipped by the air filter (40) to fall in the room, etc. according to the present invention, the rearward edge (6*c*) of the opening (62) is configured as a guide, the edge (6*c*) allows the dust that has not scraped by the brush member (51) to move smoothly together with the air filter (40). This can prevent the dust from remaining behind the brush member (51).

In a seventeenth aspect of the invention related to the sixteenth aspect of the invention, the edge (6*c*) of the opening (62) is gradually tapered toward the brush member (51*b*).

According to the above-described aspect of the invention, the dust that has not scraped by the brush member (51) is not disturbed by the edge (6*c*) of the opening (62), but moves reliably and smoothly along a surface of the edge (6*c*) in the direction of movement of the air filter (40).

In an eighteenth aspect of the invention related to the seventeenth aspect of the invention, the brush member (51) includes a cylindrical shaft portion (51*a*), and a bristle portion (51*b*) arranged on an outer circumferential surface of the shaft portion (51*a*). An end face of the edge (6*c*) of the opening (62) is curved to correspond to the bristle portion (51*b*).

According to the above-described aspect of the invention, the brush member (51) is entirely cylindrical, and part of the circumferential surface of the brush member (51) is exposed from the opening (62). As shown in FIG. 17, since the end face of the edge (6*c*) of the opening (62) is curved to correspond to the bristle portion (51*b*), a gap between the edge (6*c*) and the brush member (51) is minimized as possible. Specifically, the edge (6*c*) in parallel with the direction of movement of the air filter (40) is formed immediately rearward of the brush member (51). Therefore, the dust that passed over the brush member (51) is less likely to remain in the gap between the edge (6*c*) and the brush member (51), thereby allowing the dust to smoothly move in the direction of movement of the air filter (40).

In a nineteenth aspect of the invention related to the thirteenth aspect of the invention, the brush member (51) is arranged in an opening (62) formed in an upper surface of the dust container (60), and a closure member (138) for closing the opening (62) is formed in part of the air filter (40).

According to the above-described aspect of the invention, the brush member (51) is arranged in the opening (62) of the dust container (60), and is in contact with the air filter (40). When the air filter (40) moves to pass over the brush member (51), the dust adhered to a predetermined portion of the air filter (40) except for the closure member (138) is scraped by the brush member (51). In transferring the dust accumulated in the dust container (60), the air filter (40) moves, and the closure member (138) closes the opening (62) of the dust container (60).

Effect of the Invention

According to the present invention described above, the dust removed from the air filter (40) is transferred to a predetermined location by the air blowing from the indoor fan (39). Therefore, the removed dust can easily be transferred to the predetermined location suitable for disposal of the dust without providing another transfer means, such as a suction fan, etc. This can improve the efficiency in disposal of the dust removed from the air filter (40) without upsizing the unit.

According to the second aspect of the invention, the dust removed by the dust removing unit (50) is transferred by the air which is not yet supplied to the indoor heat exchanger (37). Therefore, as compared with the case where the dust is transferred by the air that has passed through the indoor heat exchanger (37), flow resistance of the air decreases, thereby ensuring dust transfer capability. Therefore, it is no longer necessary to increase the capacity of the indoor fan (39) for the dust transfer.

According to the third aspect of the invention, the dust container (60) for containing the dust removed from the air filter (40) is provided, and the air blowing from the indoor fan (39) is brought into the dust container (60). Therefore, the removed dust can temporarily be contained in the dust container (60), and then the dust is transferred in bulk. This can improve the efficiency of the dust transfer.

According to the fourth aspect of the invention, the air which is not yet supplied to the indoor heat exchanger (37) is brought into the dust container (60). For example, in cooling the room, the air before cooled in the indoor heat exchanger (37) is brought into the dust container (60), thereby preventing condensation formed by the cooled air in the dust container (160). This does not require additional measures to prevent the condensation, thereby reducing the cost.

Particularly according to the fifth aspect of the invention, the supply duct (71) and the discharge duct (74) are provided for bringing the air blowing from the indoor fan (39) into the dust container (60) for the dust transfer. This makes it possible to transfer the dust removed from the air filter (40) to the predetermined location with reliability by the air blowing from the indoor fan (39).

According to the sixth aspect of the invention, the open/close means (72) is arranged at an air inlet port of the dust transfer unit (70). Opening the open/close means (72) as required in cleaning the air filter (40) makes it possible to bring the air blowing from the indoor fan (39) into the dust container (60). This can prevent wasteful supply of the air blowing from the indoor fan (39) to the dust container (60). Therefore, in normal operation, all the air blowing from the indoor fan (39) can be supplied to the indoor heat exchanger (37). This does not impair the comfortability of a person in the room.

According to the seventh aspect of the invention, the air collecting plate (91) is arranged at the air inlet port of the dust transfer unit (70). This allows the air blowing from the indoor fan (39) to easily flow into the inlet port, thereby increasing the amount of air brought into the dust container (60). This improves the efficiency of the dust transfer, and reduces time required for the cleaning operation of the air filter (40).

According to the eighth aspect of the invention, the dust is transferred outside the casing (34). This can save the labor in discharging the dust from the unit (13) arranged particularly at high elevations. Therefore, the efficiency of the dust disposal by the user improves.

According to the ninth aspect of the invention, the dust is transferred from the dust container (60) to the dust collection box (92) larger in volume than the dust container (60), and is contained therein. Since the dust container (60) is arranged near the air filter (40), i.e., near the path of the sucked air, it needs to be reduced in volume as much as possible so as not to disturb the air flow. Due to the reduced volume, the dust container (60) cannot contain a large amount of dust. However, according to the present invention, the dust collection box (92) can contain a large amount of dust. This can reduce the frequency of the dust disposal, thereby additionally saving the user's labor. If the dust collection box (92) is arranged to a location that allows for easy disposal of the dust, the efficiency of the dust disposal can be improved. Further, if a single dust collection box (92) is arranged for a plurality of indoor units (13), the dust trapped in the plurality of indoor units (13) can be collected in bulk. Thus, the efficiency of the dust disposal can be improved even when the plurality of indoor units (13) are provided.

According to the tenth aspect of the invention, the flow resistance of the outlet (23) is maximized when the dust transfer unit (70) is transferring the dust. This can decrease the amount of air blowing out of the outlet (23), thereby increasing the amount of air brought into the dust container (60). As a result, the efficiency of the dust transfer can improve, thereby reducing time required for the cleaning operation of the air filter (40).

According to the eleventh aspect of the invention, supply of a heating medium to the indoor heat exchanger (37) is stopped when the dust transfer unit (70) is transferring the dust. Therefore, in cleaning the filter, the heat exchange in the indoor heat exchanger (37) is stopped. In cleaning the filter, a portion of the air blowing from the indoor fan (39) is supplied to the dust container (60), thereby decreasing the amount of air supplied to the indoor heat exchanger (37) as compared with the supplied amount in the normal operation. In this case, the air is excessively cooled or heated in the indoor heat exchanger (37), thereby impairing the comfortability of a person in the room. The excessive cooling of the air involves in condensation in the indoor heat exchanger (37). However, according to the present invention, the heat exchange in the indoor heat exchanger (37) is stopped. Therefore, the air is not excessively cooled or heated, thereby preventing the above-described defects from occurring.

According to the twelfth aspect of the invention, the number of rotations of the indoor fan (39) is maximized when the dust transfer unit (70) is transferring the dust. This can increase the amount of air brought into the dust container (60), thereby improving the efficiency of the dust transfer.

According to the thirteenth aspect of the invention, the dust removed by the brush member (51) is temporarily contained in the dust container (60) with reliability. Since the air filter (40) is moved relative to the brush member (51), the dust is removed from every part of the air filter (40).

According to the fourteenth aspect of the invention, the open/close means (72) is arranged at the air inlet port of the dust transfer unit (70) for opening/closing the air inlet port by moving the air filter (40). This allows for automatic opening/closing of the air inlet port, thereby saving the user's labor in discharging the dust.

According to the fifteenth aspect of the invention, the brush member (51) includes the bristle portion (51*b*) made of pile fabric. Therefore, the bristles of the bristle portion (51*b*) are short. This can reduce the flow resistance of the air blowing from the indoor fan (39) in the dust container (60). As a result, the dust contained in the dust container (60) can be transferred with improved efficiency.

According to the sixteenth aspect of the invention, the rearward edge (6*c*) of the opening (62) of the dust container (60) is configured as a guide for allowing the dust to move together with the air filter (40). This allows the dust that has not scraped by the brush member (51) to move together with the air filter (40) without being disturbed by the edge (6*c*). Therefore, the dust is prevented from remaining in a gap between the edge (6*c*) of the opening (62) and the brush member (51), growing into a cluster, and falling into the room, etc. This can improve the reliability of the function of cleaning the air filter (40).

According to the seventeenth aspect of the invention, the rearward edge (6*c*) of the opening (62) of the dust container (60) is tapered. Therefore, the dust that has not scraped by the brush member (51) can smoothly be moved along the surface of the edge (6*c*) of the opening (62). This can reliably prevent the dust from remaining in the gap between the edge (6*c*) of the opening (62) and the brush member (51). As a result, the reliability of the function of cleaning the air filter (40) further improves.

According to the eighteenth aspect of the invention, an end face of the edge (6*c*) of the opening (62) of the dust container (60) is curved to correspond to the bristle portion (51*b*). This can reduce a gap between the edge (6*c*) and the brush member (51) as much as possible. That is, a guide for moving the dust can be provided immediately behind the brush member (51). This can prevent the dust from remaining behind the brush member (51) with more reliability.

According to the nineteenth aspect of the invention, the closure member (138) for closing the opening (62) of the dust container (60) is formed in part of the air filter (40). Therefore, the opening (62) of the dust container (60) can be closed in transferring the dust by bringing the air blowing from the indoor fan (39) into the dust container (60). This can prevent the dust in the dust container (60) from flowing out of the opening (62). As a result, the dust is prevented from falling in the room.

BRIEF DESCRIPTION OF THE DRAWINGS

FIGS. 33(A) to 33(C) are views schematically illustrating the relationship between an air filter and a dust removing unit of the second embodiment of the present invention, in which FIGS. 33(A) and 33(B) illustrate the relationship in filter cleaning operation, and FIG. 33(C) illustrates the relationship in normal operation.

FIGS. 37(A) to 37(C) are lateral cross-sectional views illustrating the indoor unit of the third embodiment of the present invention, in which FIG. 37(A) is a lateral cross-sectional view of the indoor unit viewed from below, and FIGS. 37(B) and (C) are vertical cross-sectional views of the indoor unit viewed from the side.

DESCRIPTION OF CHARACTERS

Figure 1:
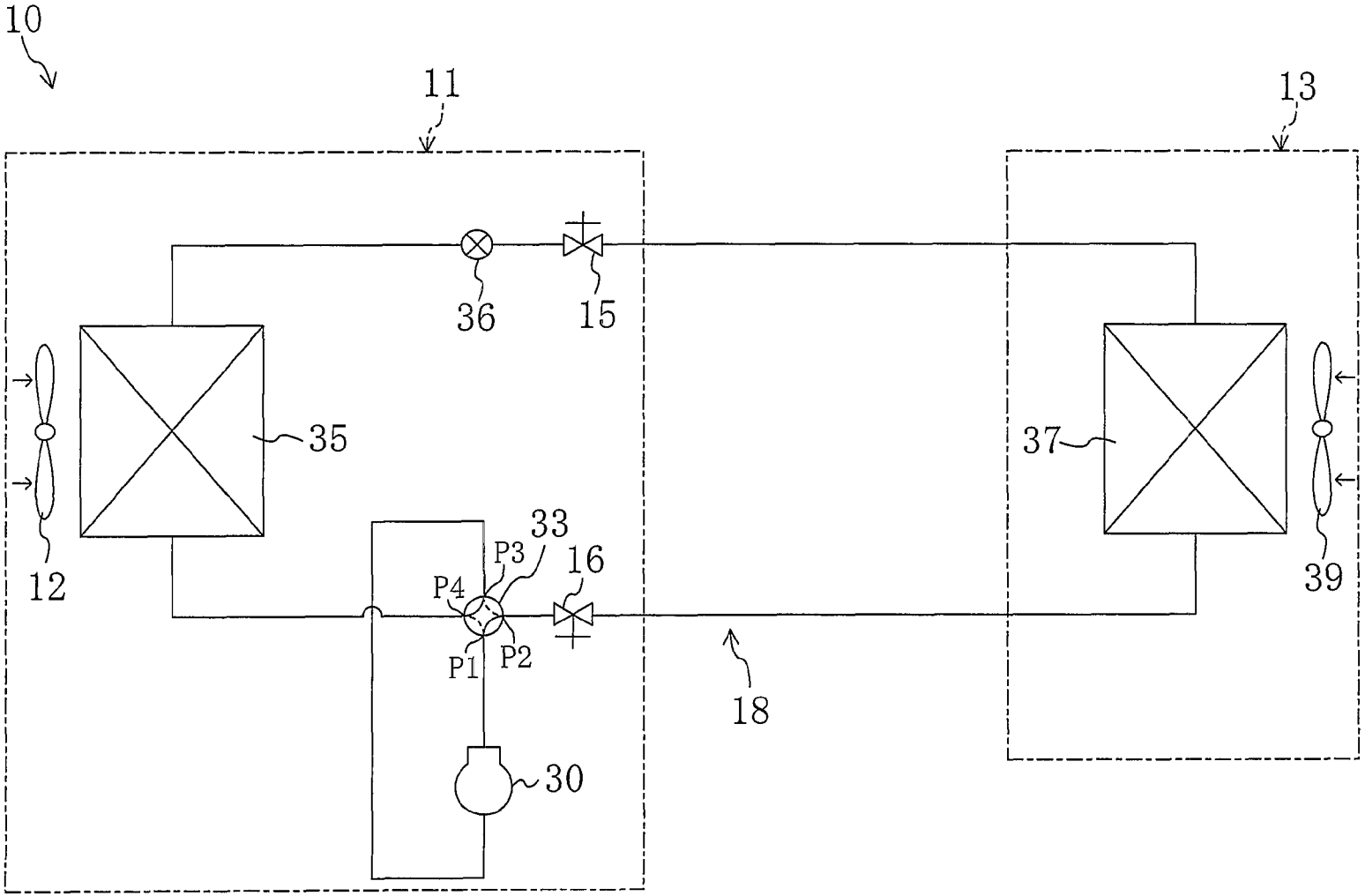
FIG. 1 is a circuit diagram illustrating the structure of an air conditioner of a first embodiment of the present invention.

10 Air conditioner
13 Indoor unit
23 Outlet
23*a* Adjuster plate
34 Casing
37 Indoor heat exchanger
39 Indoor fan
40 Air filter
50 Dust removing unit
51 Rotating brush (brush member)
51*a* Shaft portion
51*b* Bristle portion
52 Filter moving means
60 Dust container
62 Brush receiving opening (opening)
70 Dust transfer unit
71 Supply duct
72 Damper (open/close means)
74 Discharge duct
91 Air collecting plate
92 Dust collection box
6*c* Opening edge (edge)

BEST MODE FOR CARRYING OUT THE INVENTION

Embodiments of the present invention will be described in detail hereinafter with reference to the drawings.

First Embodiment

A first embodiment of the present invention will be described below. The present embodiment is directed to an air conditioner (10) including an indoor unit (13) of the present invention. In this air conditioner (10), the indoor unit (13) is installed on a ceiling in a room. The air conditioner (10) of the present embodiment will be described first, and then the indoor unit (13) of the present invention will be described.

The air conditioner (10) of the present embodiment includes, as shown in FIG. 1, an outdoor unit (11) and an indoor unit (13). The outdoor unit (11) includes a compressor (30), an outdoor heat exchanger (35), an expansion valve (36), a four-way switching valve (33) and an outdoor fan (12). The indoor unit (13) includes an indoor heat exchanger (37) and an indoor fan (39).

In the outdoor unit (11), a discharge side of the compressor (30) is connected to a first port (P1) of the four-way switching valve (33). A suction side of the compressor (30) is connected to a third port (P3) of the four-way switching valve (33).

The outdoor heat exchanger (35) is configured as a cross-fin type fin-and-tube heat exchanger. One end of the outdoor heat exchanger (35) is connected to a fourth port (P4) of the four-way switching valve (33). The other end of the outdoor heat exchanger (35) is connected to a liquid stop valve (15).

The outdoor fan (12) is arranged near the outdoor heat exchanger (35). In the outdoor heat exchanger (35), outdoor air sent by the outdoor fan (12) and a circulating refrigerant exchange heat. An expansion valve (36) capable of changing the degree of opening is provided between the outdoor heat exchanger (35) and the liquid stop valve (15). A second port (P2) of the four-way switching valve (33) is connected to a gas stop valve (16).

The four-way switching valve (33) is configured to be able to switch between a first state where the first port (P1) and the second port (P2) communicate with each other, and the third port (P3) and the fourth port (P4) communicate with each other (a state indicated by a solid line in FIG. 1), and a second state where the first port (P1) and the fourth port (P4) communicate with each other, and the second port (P2) and the third port (P3) communicate with each other (a state indicated by a broken line in FIG. 1).

In this air conditioner (10), heating operation is performed when the four-way switching valve (33) is set to the first state, and cooling operation is performed when the four-way switching valve (33) is set to the second state. In the heating operation, a vapor compression refrigeration cycle is performed in which the outdoor heat exchanger (35) and the indoor heat exchanger (37) in the refrigerant circuit (18) function as an evaporator and a condenser, respectively. In the cooling operation, a vapor compression refrigeration cycle is performed in which the outdoor heat exchanger (35) and the indoor heat exchanger (37) in the refrigerant circuit (18) function as a condenser and an evaporator, respectively.

[Structure of Indoor Unit]

Figure 2:
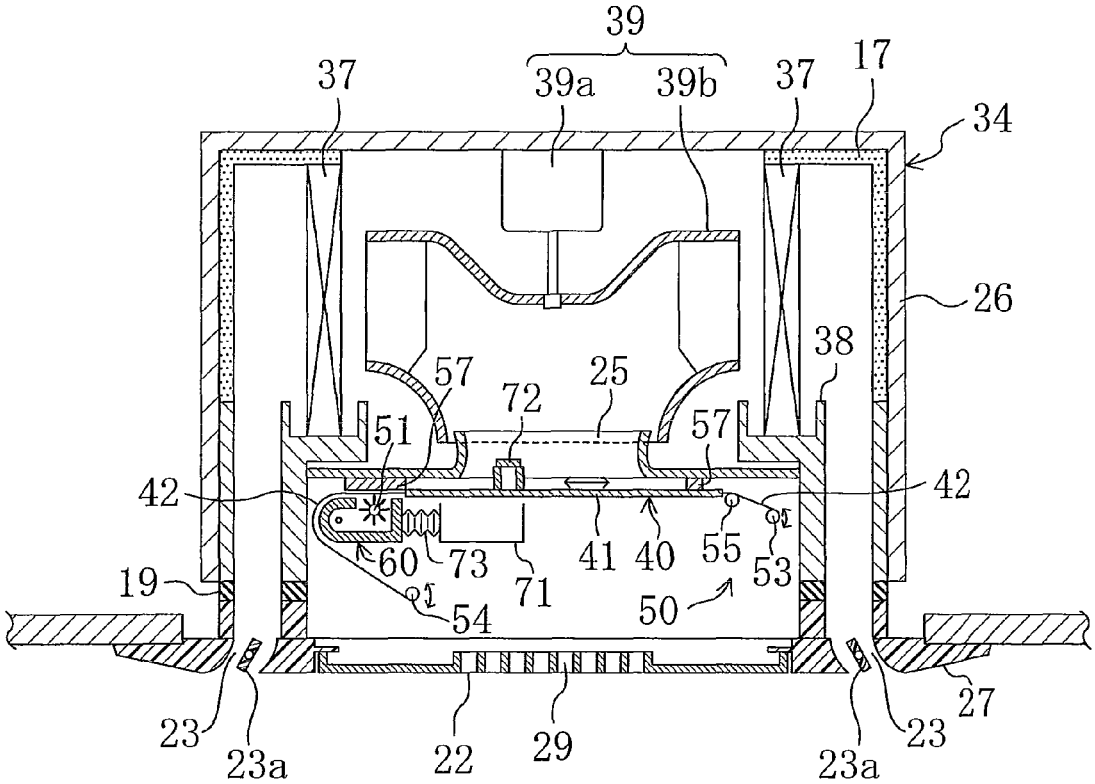
FIG. 2 is a vertical cross-sectional view of an indoor unit of the first embodiment of the present invention.
Figure 3:
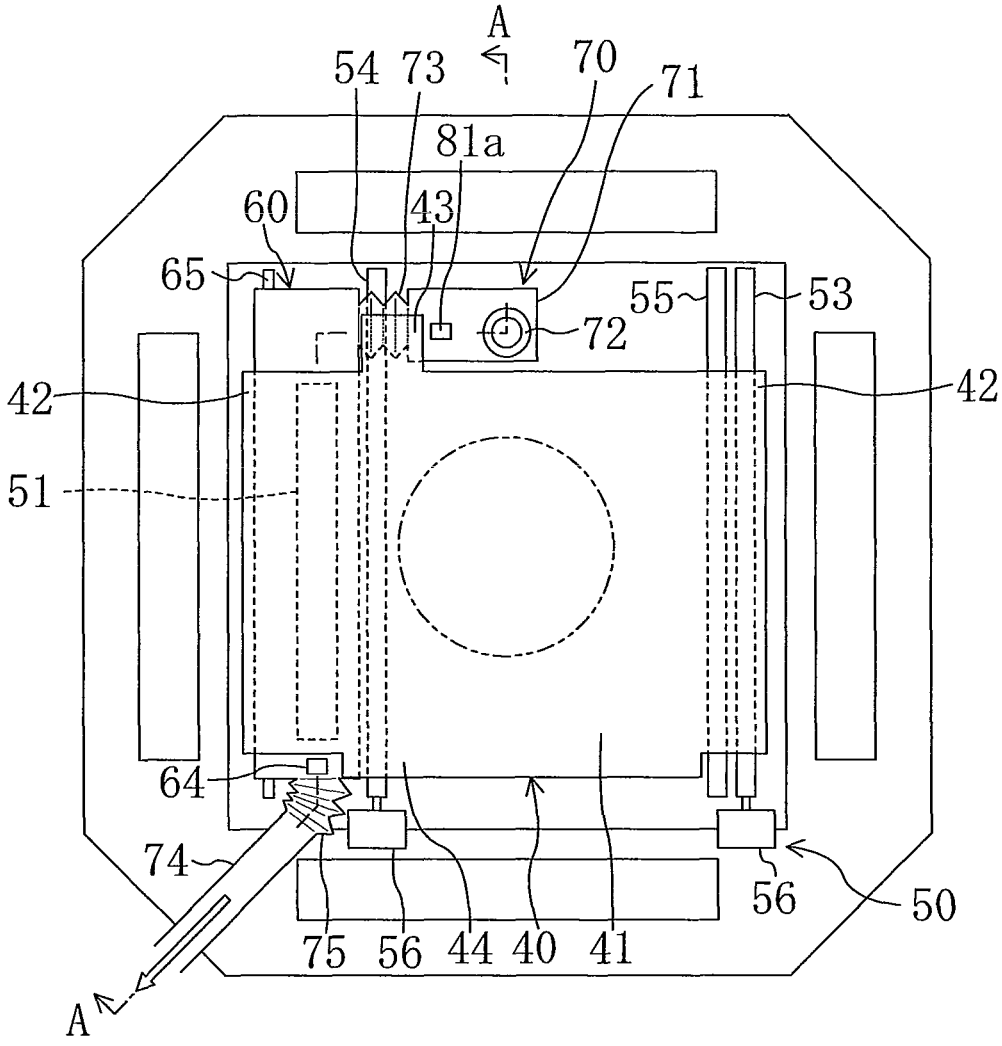
FIG. 3 is a lateral cross-sectional view of the indoor unit of the first embodiment of the present invention.
Figure 4:
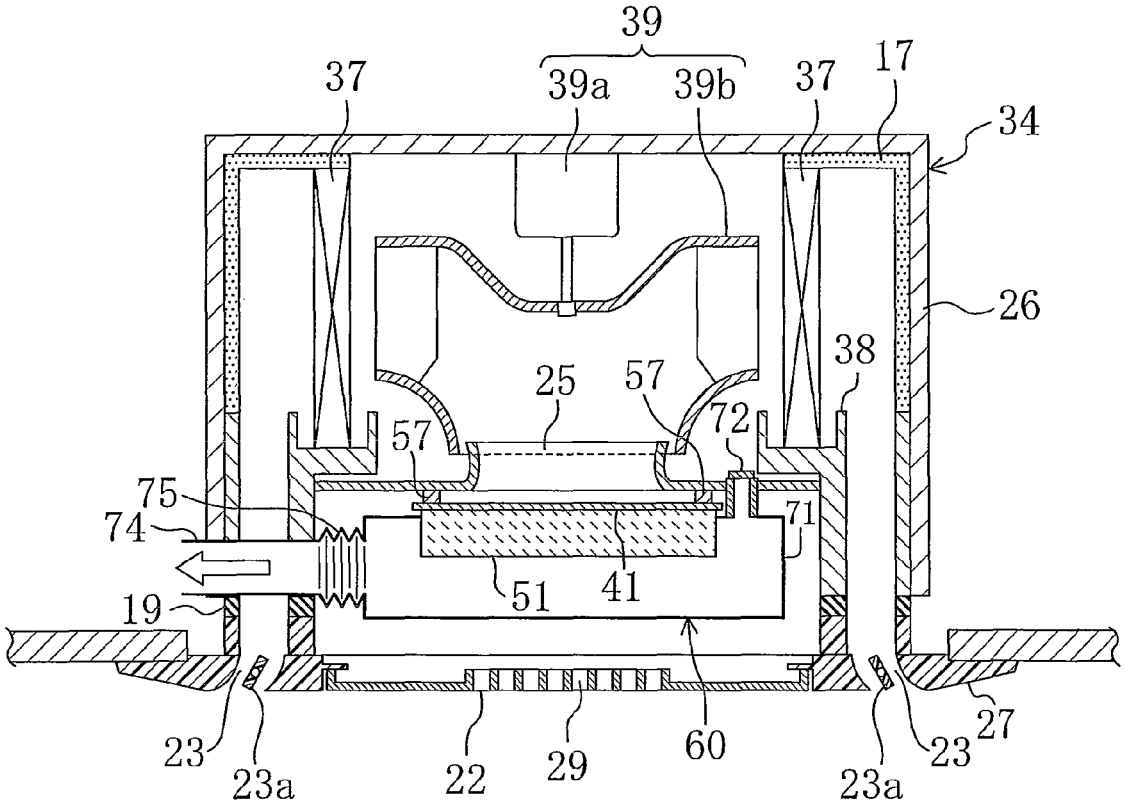
FIG. 4 is a vertical cross-sectional view taken along the line A-A shown in FIG. 3.

As shown in FIGS. 2 to 4, the indoor unit (13) includes a casing (34) including a casing body (26) and a decorative panel (27). In the casing (34), are placed the indoor heat exchanger (37), a drain pan (38), the indoor fan (39), an air filter (40), a dust removing unit (50), a dust container (60), and a dust transfer unit (70).

The casing body (26) is in the shape of a substantially rectangular parallelepiped box having an open bottom. A heat insulator (17) is laminated on an inner surface of the casing body (26). The casing body (26) is arranged with its lower portion inserted in an opening in a ceiling board.

The decorative panel (27) is in the shape of a rectangular plate. When viewed in plan, the decorative panel (27) is slightly larger than the casing body (26). The decorative panel (27) is attached to the casing body (26) to cover the bottom of the casing body (26) with a sealant (19) sandwiched therebetween. The decorative panel (27), when attached to the casing body (26), is exposed in the room.

Figure 5:
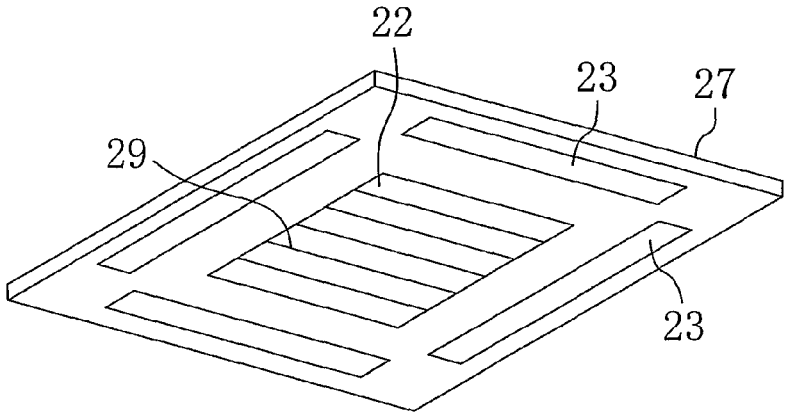
FIG. 5 is a perspective view of a decorative panel of the first embodiment of the present invention as viewed from below.

As shown in FIG. 5, the decorative panel (27) is provided with one inlet (22) and four outlets (23, 23, . . . ). The inlet (22) is rectangular-shaped, and is formed in the center of the decorative panel (27). A suction grille (29) provided with slits is fitted in the inlet (22). Each of the outlets (23) is in the shape of a narrow rectangle. The outlets (23) are formed along the sides of the decorative panel (27), respectively. An adjuster plate (23*a*) for adjusting the direction of air flow is provided at each of the outlets (23) (see FIG. 2, etc.). The adjuster plate (23*a*) rotates to adjust the direction of air flow (the direction of blowing air).

The indoor fan (39) is a so-called turbo fan. The indoor fan (39) is arranged near the center of the casing body (26) and above the inlet (22). The indoor fan (39) includes a fan motor (39*a*) and an impeller (39*b*). The fan motor (39*a*) is fixed to a top plate of the casing body (26). The impeller (39*b*) is connected to a rotation axis of the fan motor (39*a*). A bell mouth (25) communicating with the inlet (22) is provided below the indoor fan (39). The bell mouth (25) divides space in the casing (34) upstream of the indoor heat exchanger (37) into a room near the indoor fan (39) and a room near the suction grille (29). The indoor fan (39) is configured to blow air sucked from below through the bell mouth (25) in a radial direction.

The indoor heat exchanger (37) is configured as a cross-fin type fin-and-tube heat exchanger. When viewed in plan, the indoor heat exchanger (37) is in the shape of a rectangular frame, and is arranged to surround the indoor fan (39). In the indoor heat exchanger (37), indoor air sent by the indoor fan (39) and a circulating refrigerant exchange heat.

The drain pan (38) is arranged below the indoor heat exchanger (37). The drain pan (40) receives drainage generated as a result of condensation of moisture in the air in the indoor heat exchanger (37). The drain pan (40) is provided with a drain pump (not shown) for discharging the drainage. The drain pan (40) is inclined so that the drainage is collected to part of the drain pan at which the drain pump is provided.

Figure 6:
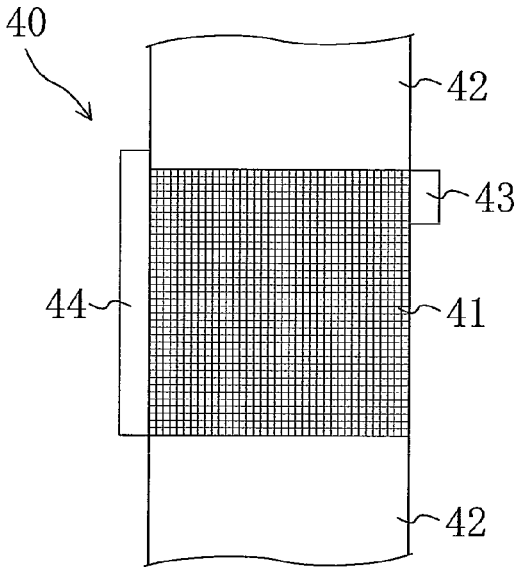
FIG. 6 is a plan view of an air filter of the first embodiment of the present invention.

The air filter (40) is in the shape of a long sheet, and is arranged below the bell mouth (25) (near an inlet of the bell mouth). As shown in FIG. 6, the air filter (40) includes a filter body (41) which is rectangular when viewed in plan, and winding portions (42). The filter body (41) is shaped as large as it can cover the inlet of the bell mouth (25), and traps dust contained in indoor air sucked into the indoor fan (39). The winding portions (42) are connected to a pair of opposing sides of the filter body (41), and are wound around a first winding drum (53) and a second winding drum (54) of a dust removing unit (50), respectively, as described later. A damper tab (43) and a container tab (44) are formed on another pair of sides of the filter body (41) to which the winding portions (42) are not connected (hereinafter referred to as lateral sides), respectively. The damper tab (43) is formed at an end portion of the filter body (41). The container tab (44) is formed to extend over almost every portion of the lateral side.

The dust removing unit (50) is provided for removing the dust trapped on the air filter (40). The dust removing unit (50) includes a rotating brush (51) as a brush member, and a filter moving means (52).

The filter moving means (52) keeps the air filter (40) at a predetermined position on one hand, and allows the air filter (40) to reciprocate relative to the rotating brush (51) on the other hand. The filter moving means (52) includes a first winding drum (53), a second winding drum (54), and a guide roller (55).

The first winding drum (53) and the second winding drum (54) are arranged below the bell mouth (25) and outside the inlet of the bell mouth. The first winding drum (53) is positioned on the right in FIG. 2 (hereinafter referred to as a rearward side), and the second winding drum (54) is positioned on the left in FIG. 2 (hereinafter referred to a forward side). Each of the winding drums (53, 54) is driven by a drive motor (56) to rotate in a reversible manner, so as to wind the winding portion (42) of the air filter (40). This allows the filter body (41) of the air filter (40) to move forward or rearward. The guide roller (55) is arranged slightly forward of the first winding drum (53). The guide roller (55) supports the winding portion (42) of the air filter (40) from below, and rotates as the air filter (40) moves.

A frame-shaped guide member (57) is attached to a bottom surface of the bell mouth (25) to surround the inlet of the bell mouth (see FIGS. 2 and 4). The guide member (57) guides the movement of the air filter (40) above the air filter (40).

The rotating brush (51) includes a rod-like shaft portion, and a bristle portion formed of a plurality of bristles attached to a circumferential surface of the shaft portion. The rotating brush (51) is arranged in a brush receiving opening (62) of a dust container (60) described later, and is positioned below a forward portion of the air filter (40). The rotating brush (51) is configured to remove the dust as it comes into contact with the moving filter body (41). The rotating brush (51) is arranged to sandwich the air filter (40) between the rotating brush (51) and the guide member (57). Therefore, the filter body (41) is reliably pushed onto the rotating brush (51), thereby improving the efficiency of dust removal.

Figure 7:
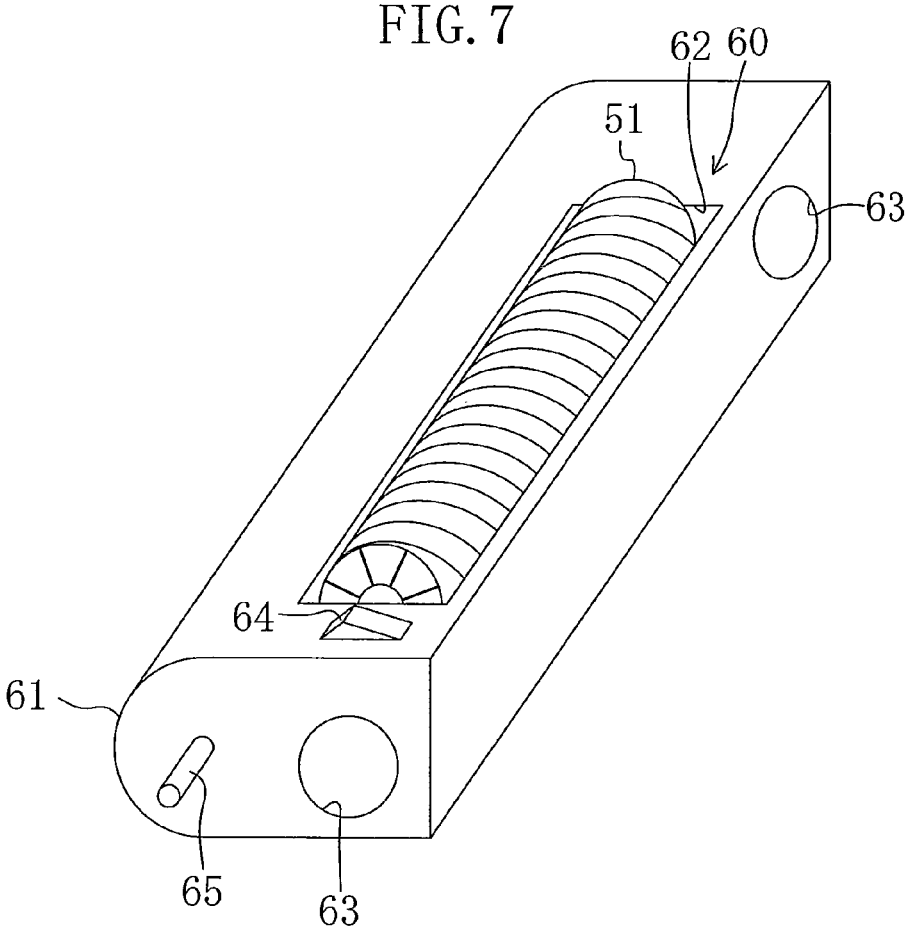
FIG. 7 is a perspective view of a dust container of the first embodiment of the present invention as viewed from behind.

The dust container (60) is provided to contain the dust removed by the rotating brush (51). The dust container (60) is a slightly narrow, rectangular parallelepiped-shaped container as shown in FIG. 7. The dust container (60) is arranged below the forward portion of the air filter (40) to extend laterally across the air filter (40). As described above, the rotating brush (51) is arranged in the brush receiving opening (62) formed in an upper surface of the dust container (60).

A forward surface of the dust container (60) is convex-curved to form an arc portion (61). The air filter (40) turns along the are portion (61), and is wound about the second winding drum (54). Duct connecting openings (63), to each of which a flexible tube (75) of a dust transfer unit (70) described later will be connected, are formed in one of the surfaces of the dust container (60) parallel to the lateral direction of the of the dust container (60) (hereinafter referred to as lateral surfaces), and in a rearward surface (hereinafter referred to as a rear surface), respectively.

Figure 8:
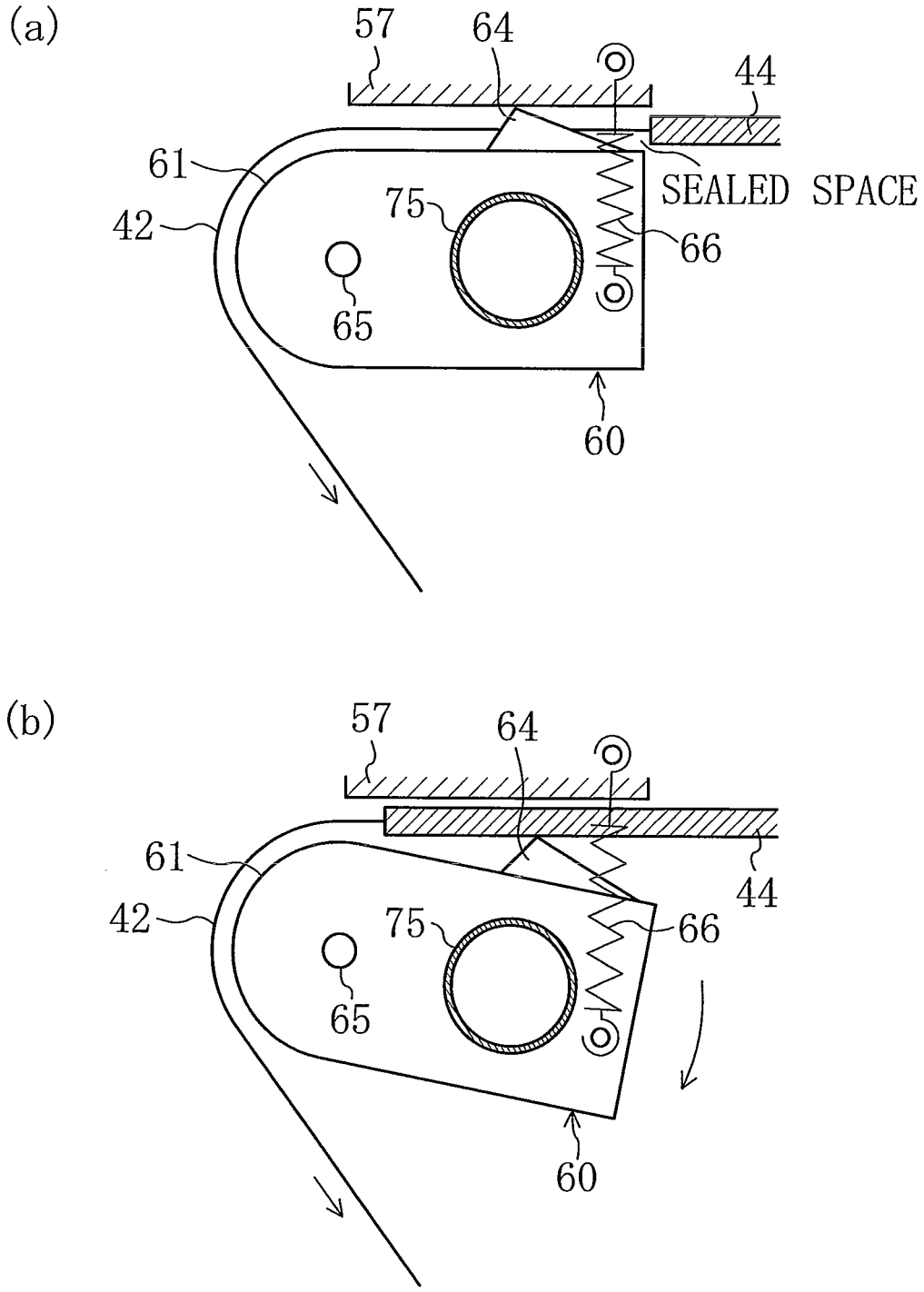
FIGS. 8(*a*) and 8(*b*) are views illustrating a rotation mechanism of the dust container of the first embodiment of the present invention, in which FIG. 8(*a*) illustrates the non-rotated dust container, and FIG. 8(*b*) illustrates the rotated dust container.

The dust container (60) is configured to rotate as the air filter (40) moves. As shown in FIG. 8, the dust container (60) includes a rotation axis (65) penetrating the dust container in the longitudinal direction, and a filter contact portion (64) projecting from an end of an upper surface of the dust container. In normal operation, the dust container (60) rotates in such a manner that a rear portion thereof moves upward due to a bias force of a spring (66) (see FIG. 8(*a*)). In this state, sealed space is formed between the rear portion of the dust container (60) and the guide member (57), thereby disconnecting the space inside the dust container (60) and the inlet side of the indoor fan (39). In cleaning the filter, the dust container (60) rotates to move downward as the air filter (40) moves, and the container tab (44) of the air filter (40) comes into contact with the filter contact portion (64) (see FIG. 8(*b*)). In this state, the sealed space is opened, thereby allowing the filter body (41) to easily pass through a gap between the dust container (60) and the guide member (57). As described above, the rotation axis (65), the filter contact portion (64), and the spring (66) comprise a rotation mechanism for rotating the dust container (60) by moving the air filter (40).

The dust transfer unit (70) brings the air blowing from the indoor fan (39) into the dust container (60), and transfers (discharges) the dust in the dust container (60) outside the casing (34) together with the air. The dust transfer unit (70) includes a supply duct (71) and a discharge duct (74). Specifically, the dust transfer unit (70) is configured to transfer the dust in the dust container (60) to a predetermined location using the air blowing from the indoor fan (39).

The supply duct (71) and the discharge duct (74) are arranged in space below the bell mouth (25). An outlet end of the supply duct (71) is connected to the duct connecting opening (63) formed in the rear surface of the dust container (60) through a flexible tube (75). An inlet end of the discharge duct (74) is connected to the duct connecting opening (63) formed in the lateral surface of the dust container (60) through a flexible tube (75).

Figure 9:
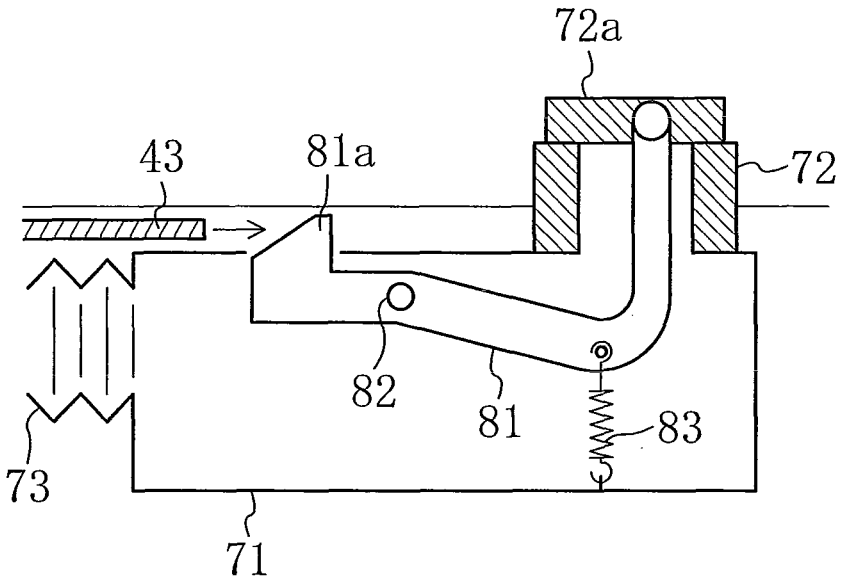
FIGS. 9(*a*) and 9(*b*) are views illustrating an opening/closing mechanism of a damper in a supply duct of the first embodiment of the present invention, in which FIG. 9(*a*) illustrates the closed damper, and FIG. 9(*b*) illustrates the opened damper.
Figure 9:
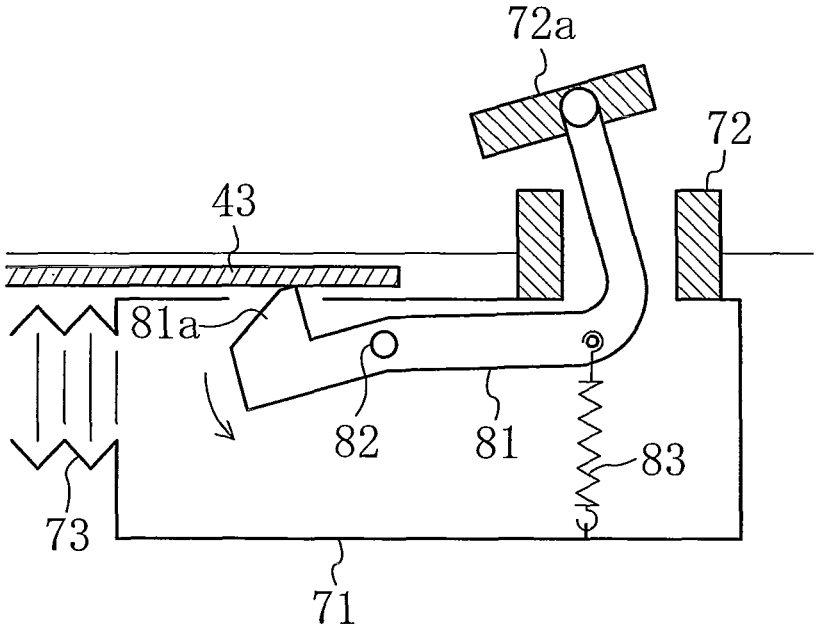

An inlet end of the supply duct (71) is configured to communicate with the space containing the indoor fan (39), and an open/close damper (72) is provided at an opening of the inlet end. Specifically, the inlet end of the supply duct (71) is positioned between the outlet side of the indoor fan (39) and the indoor heat exchanger (37). As shown in FIG. 9, the damper (72) is opened or closed by the movement of the air filter (40). Specifically, an open/close lever (81) attached to an open/close lid (72*a*) of the damper (72) at one end is provided in the supply duct (71). The open/close lever (81) has a rotation axis (82) in the middle thereof, and rotates about the rotation axis (82). The other end of the open/close lever (81) functions as a filter contact portion (81*a*) entering and exiting from an opening formed in an upper surface of the supply duct (71).

Specifically, the inlet end of the supply duct (71) forms an inlet port into which the air blowing from the indoor fan (39) and before passing through the indoor heat exchanger (37) enters. The damper (72) forms an open/close means for opening/closing the inlet port of the dust transfer unit (70).

With the damper (72) configured in this manner, one end (an end close to the damper (72)) of the open/close lever (81) is biased downward by the spring (83) in normal operation, thereby closing the open/close lid (72*a*) (see FIG. 9(*a*). Therefore, the air blowing from the indoor fan (39) does not flow into the supply duct (71). In this state, the filter contact portion (81*a*) of the open/close lever (81) protrudes from the opening in the upper surface of the supply duct (71). In cleaning the filter, the damper tab (43) of the air filter (40) comes into contact with the filter contact portion (81*a*) as the air filter (40) moves, thereby retracting the filter contact portion (81*a*) into the supply duct (71) (see FIG. 9(*b*)). In this state, the one end of the open/close lever (81) rotates upward to open the open/close lid (72*a*) of the damper (72). As a result, the air blowing from the indoor fan (39) flows into the supply duct (71) through the damper (72), and is supplied to the dust container (60).

Although not shown, the discharge duct (74) extends to penetrate a side wall of the casing body (26), with an outlet end thereof reaching the space above the ceiling of the room. Specifically, the discharge duct (74) is configured to transfer (discharge) the dust contained in the dust container (60) to the space above the ceiling of the room together with the air from the supply duct (71). Although not shown, in the present embodiment, the dust guided to the space above the ceiling accumulates there.

[Filter Cleaning Operation]

The air conditioner (10) of the present embodiment is capable of switchably performing normal operation of cooling/heating the room, and filter cleaning operation of cleaning the air filter (40).

First, in the normal operation, the compressor (30), the outdoor fan (12), and the indoor fan (39) are driven. Indoor air is sucked into the indoor unit (13) through the inlet (22), passes through the bell mouth (25), and blows from the indoor fan (39). The air blowing from the indoor fan is cooled or heated as a result of heat exchange with a refrigerant in the indoor heat exchanger (37), and is supplied to the room through the outlets (23).

Figure 10:
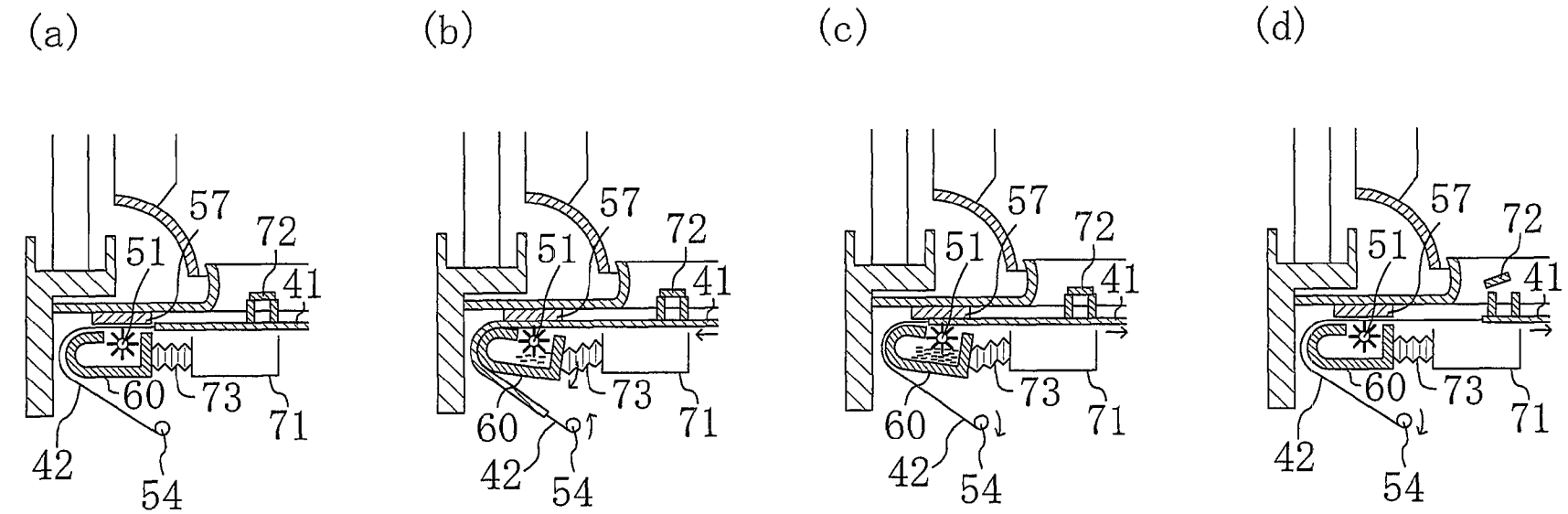
FIGS. 10(*a*) and 10(*b*) are views illustrating filter cleaning operation of the first embodiment of the present invention, in which FIG. 10(*a*) illustrates normal operation, FIG. 10(*b*) illustrates winding of the filter, FIG. 10(*c*) illustrates rewinding of the filter, and FIG. 10(*d*) illustrates dust discharge.

As shown in FIG. 10(*a*), in the normal operation described above, the air filter (40) is arranged at a predetermined position to cover the bell mouth (25). Therefore, the indoor air sucked through the inlet (22) passes through the air filter (40) before entering the bell mouth (25). As the air passes through the air filter, the dust is trapped thereon. Since the damper (72) of the supply duct (71) is closed, the air blowing from the indoor fan (39) does not enter the supply duct (71). Therefore, the air blowing from the indoor fan (39) is all supplied to the indoor heat exchanger (37), thereby preventing decrease in operation efficiency of the fan (39).

The filter cleaning operation will now be described with reference to FIGS. 10(*b*) to 10(*d*). In the filter cleaning operation, dust removal operation of removing the dust trapped on the air filter (40), and dust transfer operation of transferring the removed dust outside the casing (34) are performed.

First, in the filter cleaning operation, the indoor fan (39) is stopped, and two drive motors (56) of the dust removing unit (50) are driven to perform the dust removal operation. In this state, as shown in FIG. 10(*b*), the air filter (40) moves as it is wound about the second winding drum (54). Then, the container tab (44) of the air filter (40) comes into contact with the filter contact portion (64) of the dust container (60), thereby rotating the dust container (60) downward. As a result, a gap is provided between the rear portion of the dust container (60) and the guide member (57), thereby allowing the filter body (41) to travel through the gap between the rotating brush (51) and the guide member (57) without particularly interfering with the dust container (60). This can prevent the dust from being removed as a result of interference of the filter body (41) with the dust container (60), and from falling into the room through the suction grille (29). Since the supply duct (71) and the discharge duct (74) are connected to the dust container (60) through the flexible tubes (73, 75), they are not disconnected by the rotation of the dust container (60).

When the filter body (41) passes through the gap between the dust container (60) and the guide member (57), the dust is removed by the rotating brush (51). The removed dust is contained in the dust container (60). In this state, the damper (72) remains closed. After every part of the filter body (41) passes over the rotating brush (51), the drive motors (56) are automatically driven to rotate in a reverse direction, thereby rewinding the air filter (40) (see FIG. 10(*c*)). That is, the air filter (40) is wound about the first winding drum (53). Since the container tab (44) of the air filter (40) remains in contact with the filter contact portion (64), the dust container (60) remains rotated downward until the direction of rotation of the drive motors (56) changes.

When the air filter (40) is rewound and returns to a predetermined position, the container tab (44) of the air filter (40) separates from the filter contact portion (64), and the dust container (60) rotates upward to return to the original state. That is, the gap between the rear portion of the dust container (60) and the guide member (57) is sealed. When the air filter (40) returns to the predetermined position, the indoor fan (39) is driven again, and the dust transfer operation is performed.

When the indoor fan (39) is driven again, the air filter (40) is further wound about the first winding drum (53). Specifically, in FIG. 10, the air filter (40) moves to the right from the predetermined position. As the air filter (40) moves, the damper tab (43) of the air filter (40) comes into contact with the filter contact portion (81*a*) of the supply duct (71). Then, as shown in FIG. 10(*d*), the open/close lever (81) of the supply duct (71) rotates to open the open/close lid (72*a*) of the damper (72). In this state, the drive motor (56) is stopped.

Once the damper (72) is opened, a portion of the air blowing from the indoor fan (39) enters the supply duct (71), and is supplied to the dust container (60). The air entered the dust container (60) flows into the discharge duct (73) together with the dust, and is discharged to the space above the ceiling. In this way, the dust contained in the dust container (60) is discharged outside the casing (34). In this case, since the gap between the dust container (60) and the guide member (57) is sealed, the air supplied to the dust container (60) will not flow out of the brush receiving opening (62). After the discharge operation performed for a predetermined period of time, the drive motors (56) are driven again, thereby returning the air filter (40) to the predetermined position. This separates the damper tab (43) of the air filter (40) from the filter contact portion (81*a*) of the open/close lever (81), thereby closing the damper (72). Then, the filter cleaning operation is finished.

In the filter cleaning operation, when to rotate the drive motors (56) in the reverse direction, or when to drive or stop them may be determined in response to the number of rotations of the drive motors (56). Further, a limit switch may be arranged at a predetermined position, and the air filter (40) may be provided with a striker corresponding to the limit switch so as to determine when to drive or stop the drive motors (56).

Advantages of First Embodiment

In the present embodiment, the dust removed from the air filter (40) is contained in the dust container (60), and the dust is transferred (discharged) outside the casing (34) using the air blowing from the indoor fan (39). Specifically, in the present embodiment, the dust discharge is achieved using the existing indoor fan (39). This does not require another transfer means, such as a suction fan, etc., thereby saving the user's labor in discharging the dust. This allows for easy discharge of the dust on the air filter (40) outside the unit at low cost without upsizing the unit.

Particularly in the present embodiment, the supply duct (71) and the discharge duct (74) are provided for supplying and discharging the air blowing from the indoor fan (39). This makes it possible to reliably transfer (discharge) the dust in the dust container (60) outside the unit using the air blowing from the indoor fan (39).

In the present embodiment, the open/close damper (72) is provided in the supply duct (71). Therefore, the air blowing from the indoor fan (39) can be used by opening the damper (72) when the filter cleaning is required. This can prevent wasteful supply of the air blowing from the indoor fan (39) to the dust container (60). Further, this can suppress the decrease in operation efficiency of the indoor fan (39), and can reduce energy consumption. In the normal operation, all the air blowing from the indoor fan (39) can reliably be supplied to the room, thereby suppressing decrease in comfortability of a person in the room.

In particular, the damper (72) is automatically opened/closed by making use of the movement of the air filter (40). This allows for additional saving of the user's labor.

Since the dust is transferred from the indoor unit (13) to the space above the ceiling of the room and accumulates there, there is no need for disposal (cleaning) of the dust discharged from the unit. This allows for additional saving of the user's labor. Since the dust accumulates in the space above the ceiling, there is no need for providing a dust container, etc., outside the unit (inside the room), thereby downsizing the apparatus, and retaining indoor environment.

Modified Example of First Embodiment

First Modified Example

Figure 11:
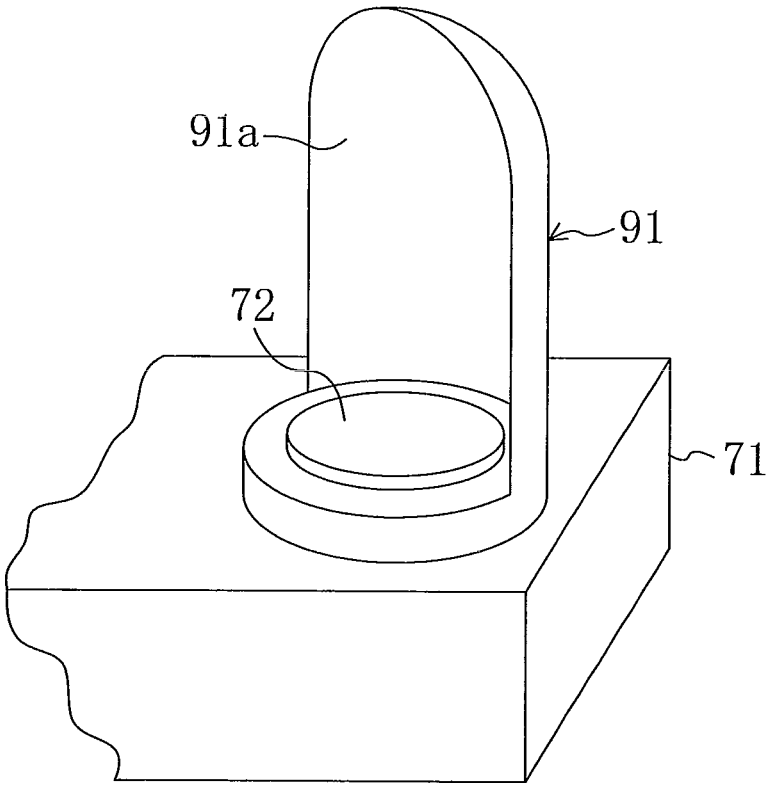
FIG. 11 is a perspective view illustrating an air collecting plate according to a first modified example of the first embodiment.

A first modified example is achieved by adding an air collecting plate (91) to the damper (72) of the supply duct (71) of the first embodiment as shown in FIG. 11. Specifically, the air collecting plate (91) is a vertically oriented concave plate, and is arranged along half the circumference of an inlet of the damper (72). The air collecting plate (91) is arranged with a concave surface (91*a*) opposing to the direction of the air blowing from the indoor fan (39). In this modified example, the air blowing from the indoor fan (39) is reliably captured by the air collecting plate (91). Therefore, the air blowing from the indoor fan (39) easily enters (is easily brought into) the supply duct (71) from the damper (72). This increases the amount of air supplied to (brought into) the dust container (60), thereby allowing for easy discharge of the dust. As a result, the efficiency of the dust discharge (the dust transfer) improves, thereby reducing time required for the filter cleaning operation.

Second Modified Example

Figure 12:
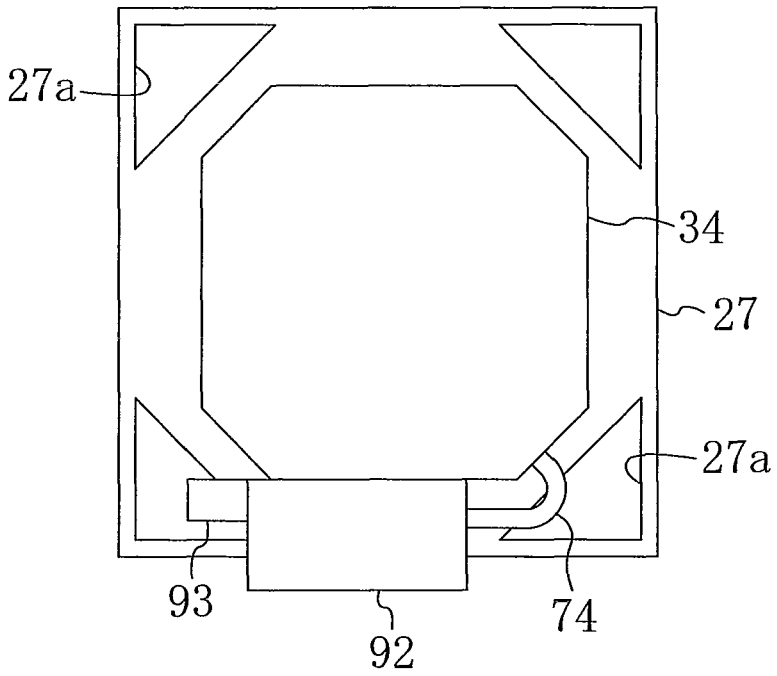
FIGS. 12(*a*) and 12(*b*) are views illustrating an indoor unit according to a second modified example of the first embodiment, in which FIG. 12(*a*) illustrates the indoor unit as viewed from above a ceiling, and FIG. 12(*b*) is a side view of the indoor unit.
Figure 12:
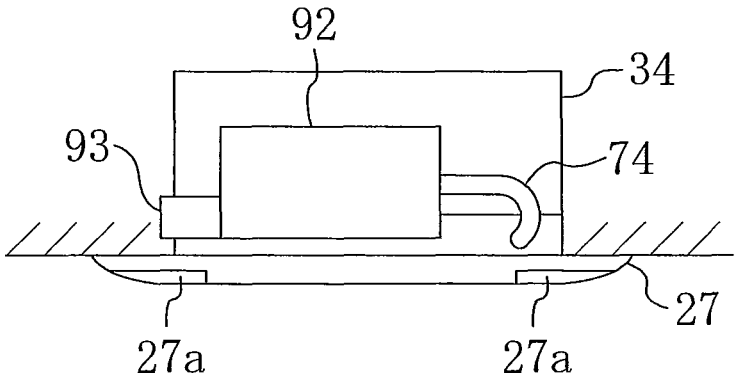

In a second modified example, the dust is transferred and contained in a dust collection box (92) placed outside the casing (34) as shown in FIG. 12. Specifically, the dust collection box (92) is attached to a side surface of the casing (34) in the space above the ceiling. The discharge duct (74) extending from the inside of the casing (34) is connected to the dust collection box (92), and the dust is transferred from the dust container (60), and is contained in the dust collection box (92). The dust collection box (92) is sufficiently larger in volume than the dust container (60). Therefore, the box can contain a larger amount of dust than the dust container (60). Specifically, since the dust container (60) is arranged below the air filter (40), i.e., near the path of the sucked air, it needs to be reduced in volume as much as possible so as not to disturb the air flow. Therefore, the dust container (60) cannot contain a very large amount of dust. In this modified example, however, the dust collection box (92) can contain a large amount of dust, thereby reducing the frequency of the dust disposal. Further, the placement of the dust collection box (92) in the space above the ceiling can give the dust collection box (92) a sufficient volume without affecting the indoor environment.

The dust collection box (92) includes a removal port (93) from which the accumulated dust is removed. The removal port (93) allows for sucking (removing) the dust through an adjuster pocket (27*a*) formed in the decorative panel (27) using a vacuum cleaner, etc. This makes it possible to dispose the dust in the dust collection box (92) at regular time intervals. The adjuster pocket (27*a*) is generally a communicating port provided for communicating the inside of the room and the space above the ceiling for the purpose of inspection and maintenance, and is formed at each of the corners of the decorative panel (27). In the normal operation, the adjuster pockets (27*a*) are closed with a cover. In this modified example, the conventionally provided adjuster pockets (27*a*) are used to remove the dust contained in the dust collection box (92).

In this modified example, the dust collection box (92) may be arranged in the casing (34). In this case, the dust collection box (92) may be placed at a location that allows for removal of the dust using a vacuum cleaner, etc., for example, by opening the suction grille (29).

Third Modified Example

In a third modified example, the adjuster plates (23*a*) are adjusted to maximize flow resistance of the outlets (23) in transferring the dust in the filter cleaning operation of the first embodiment. In this case, the flow resistance of the outlets (23) is maximized (increases) in the filter cleaning operation, thereby drastically reducing the amount of air blowing out of the outlets (23) as compared with the amount in the normal operation. This reduction increases the amount of air blowing into the supply duct (71), thereby increasing the amount of air supplied to the dust container (60). Thus, the efficiency of discharge (transfer) of the dust accumulated in the dust container (60) improves, thereby reducing time required for the filter cleaning operation.

In this modified example, the outlets (23) may be closed by the adjuster plates (23*a*) to reduce the amount of air blowing out of the outlets (23) to zero (approximately zero). In this case, the amount of air blowing into the supply duct (71) further increases, thereby further improving the efficiency of discharge (transfer) of the dust.

Fourth Modified Example

In a fourth modified example, the number of rotations of the indoor fan (39) is maximized in transferring the dust in the filter cleaning operation of the first embodiment. In this case, the amount of air blowing into the supply duct (71) increases in the filter cleaning operation. This improves the efficiency of discharge of the dust in the dust container (60).

In this modified example, the number of rotations of the indoor fan (39) may not be maximized, but may be raised higher than the number of rotations in the normal operation.

Fifth Modified Example

In the fifth modified example, the compressor (30) is stopped in transferring the dust in the filter cleaning operation of the first embodiment. Specifically, in the filter cleaning operation, supply of the refrigerant to the indoor heat exchanger (37) is stopped. As a result, the air is not cooled or heated in the indoor heat exchanger (37). This makes it possible to prevent supply of excessively cooled or heated air, thereby retaining comfortability of a person in the room.

Specifically, in the filter cleaning operation, a portion of the air blowing from the indoor fan (39) bypasses the indoor heat exchanger (37), and is brought into the supply duct (71). Therefore, the amount of air supplied to the indoor heat exchanger (37) decreases as compared with the amount in the normal operation. In this situation, the air is excessively cooled or heated in the indoor heat exchanger (37), thereby affecting the comfortability of the person in the room. However, stopping the compressor (30) can prevent the excessive cooling or heating. Further, stopping the compressor (30) can also prevent condensation on the indoor heat exchanger (37) which may be caused by the excessive cooling of the air in the indoor heat exchanger (37).

Sixth Modified Example

In a sixth modified example, the supply duct (71) is omitted from the first embodiment, and the air blowing from the indoor fan (39) is directly brought into the dust container (60). In this case, the dust container (60) is provided with an inlet port through which the air blowing from the indoor fan (39) enters, and a damper for opening/closing the inlet port is provided. This modified example makes it possible to downsize the indoor unit (13) by the absence of the supply duct (71).

Seventh Modified Example

Figure 13:
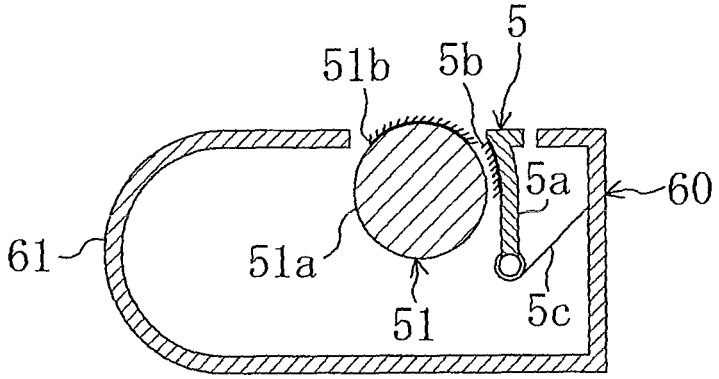
FIG. 13 is a lateral cross-sectional view illustrating the structure of a dust container and a rotating brush according to a seventh modified example of the first embodiment.

In a seventh modified example, the structure of the rotating brush (51) arranged in the dust container (60) is changed, and the removal of the dust is performed in a different manner. As shown in FIG. 13, the dust container (60) of this modified example includes the rotating brush (51) and a non-rotating brush (5) arranged in the brush receiving opening (62).

The rotating brush (51) includes a narrow cylindrical shaft portion (51*a*), and a bristle portion (51*b*) attached to an outer circumferential surface of the shaft portion (51*a*). The bristle portion (51*b*) covers part of the circumference of the shaft portion (51*a*), and extends in the longitudinal direction of the shaft portion (51*a*). The bristle portion (51*b*) is made of so-called pile fabric. The pile fabric is hairy fabric obtained by weaving an extra fiber (pile yarn) into base fabric, and has relatively short bristles projecting from the base fabric. The pile fabric is inclined pile fabric in which the bristles are inclined rearward in FIG. 13. Specifically, the bristles of the bristle portion (51*b*) are inclined in the direction opposite the filter body (41) moving forward. The rotating brush (51) is configured in such a manner that the bristle portion (51*b*) comes into contact with the filter body (41). When the filter body (41) moves in the direction opposite the direction of inclination of the bristles of the bristle portion (51*b*), the dust on the filter body (41) is efficiently removed (trapped). When the filter body (41) moves in the direction of inclination of the bristle portion (51*b*), the dust on the filter body (41) is not removed, but the dust trapped on the bristle portion (51*b*) is removed. The rotating brush (51) is driven to reversibly rotate about an axial center of the shaft portion (51*a*) by an unshown drive means, such as a motor, etc.

The non-rotating brush (5) is arranged rearward of the rotating brush (51). The non-rotating brush (5) includes a body (5*a*), a bristle portion (5*b*), and a spring (5*c*). The body (5*a*) is a plate-like member, and has the same length as the shaft portion (51*a*) of the rotating brush (51). The body (5*a*) is arranged with a surface thereof facing the rotating brush (51). An upper portion of the body (5*a*) is curved to correspond to the circumference of the shaft portion (51*a*) of the rotating brush (51). The bristle portion (5*b*) is provided on the curved portion of the body (5*a*) to extend in the longitudinal direction of the body (5*a*). The bristle portion (5*b*) is made of inclined pile fabric, with the projecting bristles inclined downward in FIG. 13. The bristle portion (5*b*) is configured to come into contact with the bristle portion (51*b*) of the rotating brush (51) as the rotating brush (51) rotates. The spring (5*c*) is attached to a lower end portion of the body (5*a*), and to an inner wall of the dust container (60). That is, the body (5*a*) is supported by the spring (5*c*). The non-rotating brush (5) is provided to remove the dust removed by the rotating brush (51) from the rotating brush (51).

Dust removal operation by the rotating brush (51) will be described with reference to FIG. 14. The dust removal operation is performed in a stage shown in FIG. 10(*b*) in the filter cleaning operation of the first embodiment (i.e., a stage in which the filter body (41) moves forward). The air filter (40) of the first embodiment moves forward in FIG. 10(*b*). However, in this modified example, the air filter (40) moves forward intermittently.

Figure 14:
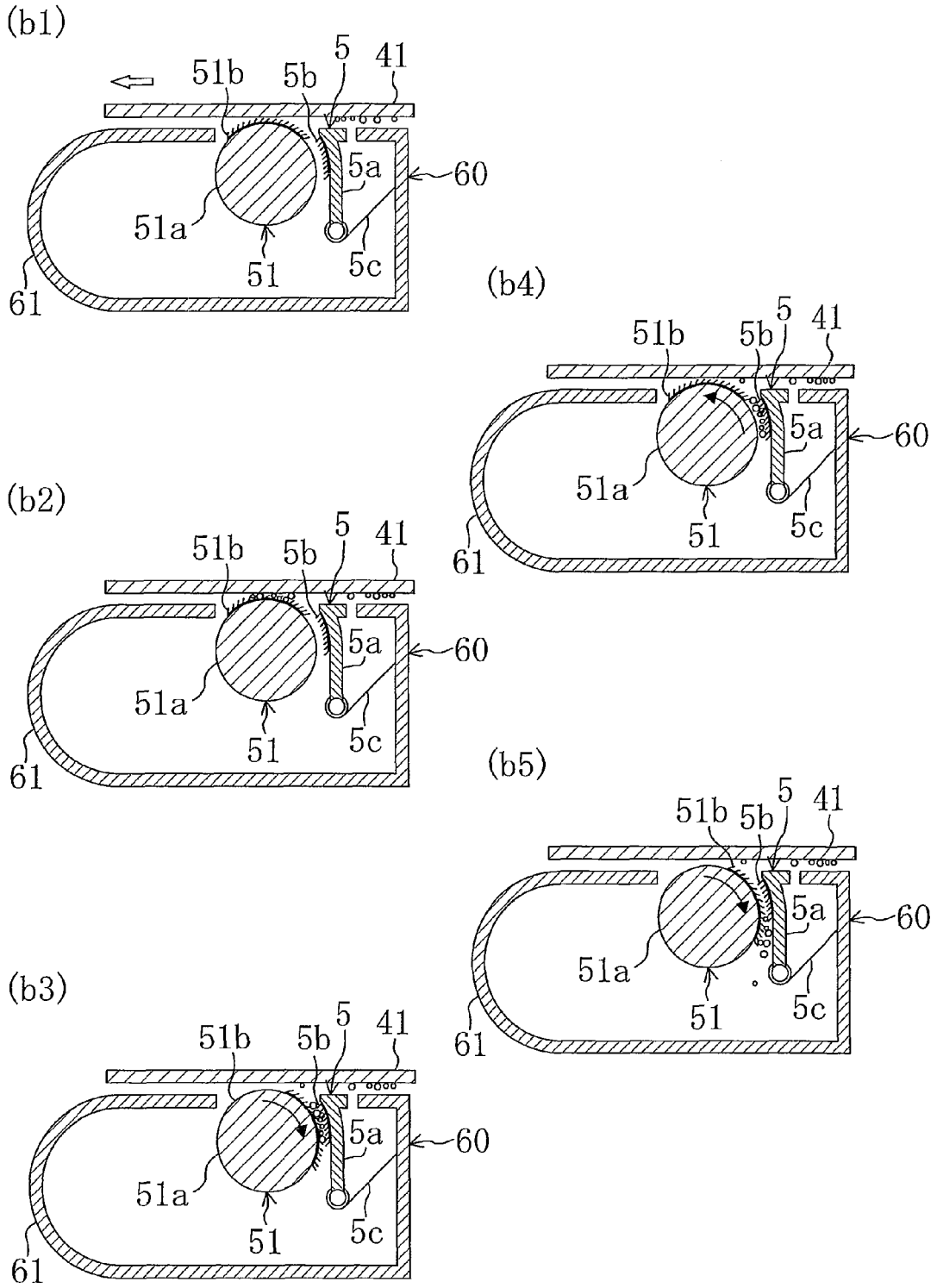
FIG. 14 is a lateral cross-sectional view sequentially illustrating dust removal operation by the rotating brush according to the seventh modified example of the first embodiment in the order of (b1) to (b5).

Specifically, as shown in FIG. 14(*b*1), the drive motor (56) moves the filter body (41) forward. In this case, the rotating brush (51) is stopped with the bristle portion (51*b*) exposed from the brush receiving opening (62). That is, the rotating brush (51) is stopped with the bristle portion (51*b*) of the rotating brush (51) positioned immediately below the filter body (41) and in contact with the filter body (41).

The filter body (41) moves a predetermined distance, and then stops (see FIG. 14(*b*2)). As the filter body (41) moves, the dust on the filter body (41) is trapped on the bristle portion (51*b*) (see FIG. 14(*b*2)). Specifically, the dust on part of the filter body (41) that passed over the bristle portion (51*b*) of the rotating brush (51) is removed. Since the bristles on the bristle portion (51*b*) are inclined in a direction opposite the moving direction of the filter body (41) (i.e., rearward), the bristle portion (51*b*) easily scraps the dust on the filter body (41). This improves the efficiency of dust removal by the rotating brush (51).

When the filter body (41) stops, the rotating brush (51) rotates to the right (clockwise) in FIG. 14 as shown in FIG. 14(*b*3). The rotating brush (51) rotates with the dust kept trapped on the bristle portion (51*b*). The rotating brush (51) rotates with the bristle portions (51*b*, 5*b*) of the rotating brush (51) and the non-rotating brush (5) being in contact with each other. Then, the rotating brush (51) stops after it rotates by a predetermined rotation angle. Specifically, the rotating brush (51) rotates until at least an end portion of the bristle portion (51*b*) on the left in the circumferential direction (a left end portion in FIG. 14(*b*2)) comes into contact with the bristle portion (5*b*) of the non-rotating brush (5).

Then, the rotating brush (51) rotates in the opposite direction (i.e., counterclockwise) as shown in FIG. 14(*b*4). As a result, the dust trapped on the bristle portion (51*b*) of the rotating brush (51) is removed by the bristle portion (5*b*) of the non-rotating brush (5). Since the bristles of the bristle portion (5*b*) of the non-rotating brush (5) are inclined downward, i.e., in a direction opposite the direction of rotation of the rotating brush (51), the dust on the bristle portion (51*b*) of the rotating brush (51) is scraped (removed). The bristle portions (51*b*, 5*b*) in contact with each other pushes the body (5*a*) of the non-rotating brush (5) rearward, but the spring (5*c*) biases the body (5*a*) forward. Therefore, the bristle portions (51*b*, 5*b*) do not separate from each other, thereby pushing the non-rotating brush (5) onto the rotating brush (51) in a suitable manner. This ensures the removal of the dust from the bristle portion (51*b*) of the rotating brush (51). In this way, the dust is trapped on the bristle portion (5*b*) of the non-rotating brush (5). The rotating brush (51) rotates to return to the original state (the state shown in FIG. 14(*b*2)), and then stops.

Then, the rotating brush (51) rotates to the right (clockwise) again by a predetermined rotation angle as shown in FIG. 14(*b*5). As a result, the dust trapped on the bristle portion (5*b*) of the non-rotating brush (5) is scraped by the bristle portion (51*b*) of the rotating brush (51), and falls in the bottom of the dust container (60). Since the bristles of the bristle portion (51*b*) of the rotating brush (51) are inclined in the direction of rotation, the dust on the bristle portion (5*b*) of the non-rotating brush (5) is reliably scraped. In this case, as described above, the spring (5*c*) suitably pushes the non-rotating brush (5) onto the rotating brush (51), thereby reliably removing the dust from the non-rotating brush (5). In this way, the dust on the bristle portion (5*b*) of the non-rotating brush (5) is removed, and is contained in the dust container (60). After rotating by a predetermined rotation angle, the rotating brush (51) rotates to the left (counterclockwise) again, and returns to the original state (the state shown in FIG. 14(*b*1)). Then, the filter body (41) moves a predetermined distance again to repeat the above-described operation.

In this modified example, the bristle portion (51*b*) of the rotating brush (51) is made of the pile fabric. Since the bristles of the bristle portion (51*b*) are short, flow resistance of air (i.e., the air blowing from the indoor fan (39)) decreases in the dust container (60). This makes it possible to improve the efficiency of transfer of the dust contained in the dust container (60).

In this modified example, the bristle portion (51*b*) is provided to cover part of the circumference of the shaft portion (51*a*). As compared with the case where the bristle portion is provided to cover every circumference of the shaft portion (51*a*), the flow resistance of the air further decreases in the dust container (60), thereby improving the efficiency of the dust transfer to a further extent.

In this modified example, the non-rotating brush (5) for removing the dust trapped on the rotating brush (51) is provided. This makes it possible to reliably remove the dust from the rotating brush (51), and to accumulate the dust in the dust container (60).

In this way, the filter body (41) moves intermittently, and the dust trapped on the rotating brush (51) is removed, and is contained in the dust container (60) every time the filter body (41) stops. In removing the dust by continuously moving the filter body (41) as described in the first embodiment, the amount of dust trapped on the rotating brush (51) gradually increases. This gradually decreases the efficiency of dust removal by the rotating brush (51). In this modified example, however, the dust on the filter body (41) is removed in several times, and the dust trapped on the rotating brush (51) is removed every time. This allows for dust removal from the filter body (41) without decreasing the efficiency of dust removal by the rotating brush (51). Thus, the dust on the air filter (40) can reliably be removed and contained in the dust container (60).

Eighth Modified Example

Figure 15:
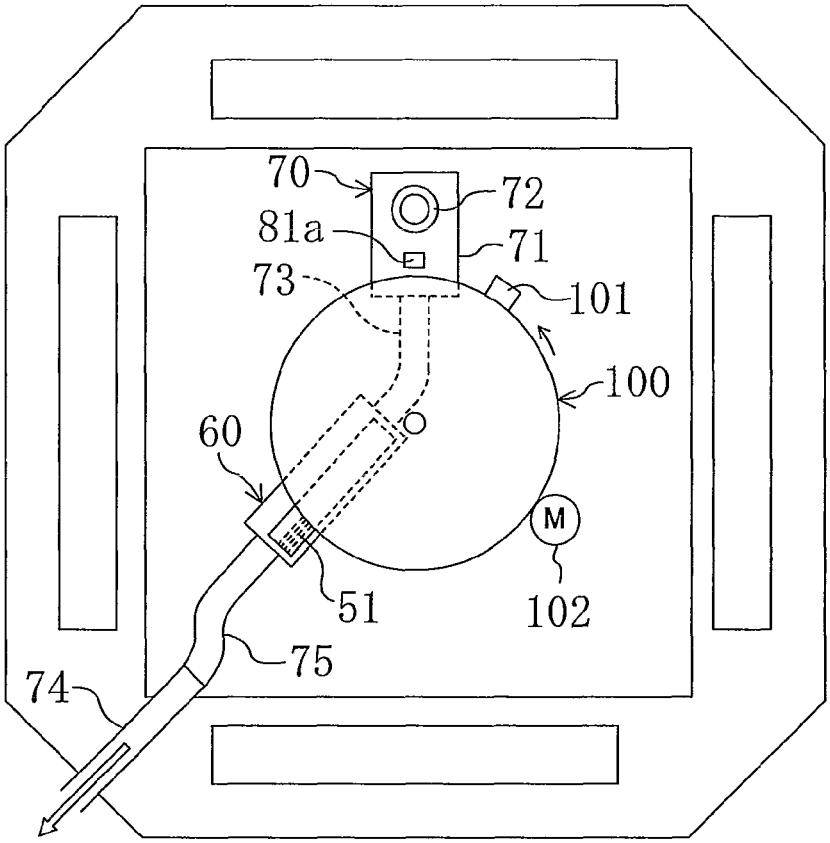
FIG. 15 is a lateral cross-sectional view illustrating an indoor unit according to an eighth modified example of the first embodiment.

In an eighth modified example, the rectangular air filter (40) of the first embodiment is replaced with a circular air filter (100) as shown in FIG. 15.

Specifically, the air filter (100) of this modified example is driven to rotate by a drive motor (102). Although not shown, a gear is formed on an outer circumferential surface of the air filter (100), and is engaged with a gear of the drive motor (102). That is, the drive motor (102) functions as a filter drive means. A damper tab (101) is formed on part of the outer circumferential surface of the air filter (100). The damper tab (101) is a tab protruding radially outward from the air filter (100).

Different from the first embodiment, the dust container (60) of this modified example is arranged below the air filter (100), and extends in the radial direction of the air filter (100). Specifically, the rotating brush (51) extends in the radial direction of the air filter (100), and is in contact with the air filter (100). In this modified example, the dust on the air filter (100) is removed by the rotating brush (51) as the air filter (100) rotates. The removed dust is contained in the dust container (60).

Different from the first embodiment, the supply duct (71) of this modified example extends toward the center of the circular air filter (100). The supply duct (71) is configured in such a manner that the damper (72) opens as the damper tab (101) of the air filter (100) comes into contact with the filter contact portion (81*a*). The dust container (60) is connected to the supply duct (71) and the discharge duct (74) through the flexible tubes (73, 75), respectively, in the same manner as described in the first embodiment. Also in this modified example, the air blowing from the indoor fan (39) is guided to the supply duct (71), thereby discharging the dust in the dust container (60) outside the casing (34).

Ninth Modified Example

In a ninth modified example, the structure of the dust container (60) of the seventh modified example of the first embodiment is modified.

Figure 16:
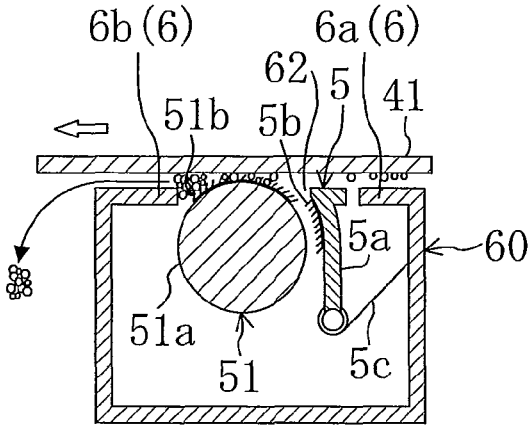
FIG. 16 is a view illustrating dust remaining behind the rotating brush.

In the seventh modified example, the dust adhered to the air filter (40) is scraped by the rotating brush (51) as the air filter (40) passes over the rotating brush (51). However, all the dust is not always scraped completely, and the dust not scraped (the dust that the rotating brush failed to scrape) still adheres to the air filter (40), or remains separated from the air filter (40). As shown in FIG. 16, the dust not scraped moves rearward of the rotating brush (51) (to the left in FIG. 16, i.e., rearward in the direction of movement of the air filter (40)) as the air filter (40) moves. In FIG. 16 (and in FIGS. 17 and 18 described later), character (6) indicates a top plate of the dust container (60), (6*a*) indicates a top plate forward of the rotating brush (51) (hereinafter referred to as a forward top plate), and (6*b*) is a top plate rearward of the rotating brush (51) (hereinafter referred to as a rearward top plate.)

The dust that moved rearward of the rotating brush (51) is disturbed by an edge of the rearward top plate (6*b*), and stays in a gap between the edge and the rotating brush (51). Specifically, the air filter (40) moves, but the dust remains in the gap between the rearward top plate (6*b*) and the rotating brush (51). The remaining dust gradually grows into a cluster of a certain size, and is flipped by the air filter (40) to fall in the room, etc.

Figure 17:
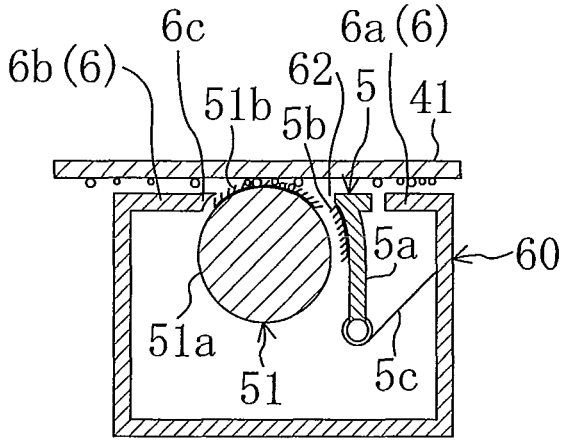
FIG. 17 is a lateral cross-sectional view illustrating the structure of a dust container and a rotating brush according to a ninth modified example of the first embodiment.

As a solution to this problem, in the ninth modified example, the edge (6*c*) of the rearward top plate (6*b*) is configured as a guide for smoothly moving the dust that has not scraped by the rotating brush (51) together with the air filter (40) as shown in FIG. 17. Specifically, the edge (6*c*) of the rearward top plate (6*b*) is tapered toward the rotating brush (51), with an end face thereof being curved to correspond to the bristle portion (51*b*) of the rotating brush (51). This minimizes the gap between the edge (6*c*) and the rotating brush (51) as much as possible. Further, the rearward top plate (6*b*) is formed immediately behind the rotating brush (51). Therefore, the dust that moved rearward of the rotating brush (51) is immediately guided by the rearward top plate (6*b*) to travel in the direction of movement of the air filter (40). The dust that passed over the rotating brush (51) moves while it is kept adhered to the air filter (40), without being disturbed by the rearward top plate (6*b*). This can prevent the dust from remaining behind the rotating brush (51), thereby improving reliability of the function of cleaning the air filter (40).

In this modified example, if the air filter (40) is in the shape of a disc as described in the eighth modified example, the dust that passed over the rotating brush (51) makes a turn together with the air filter (40), and is scraped again by the rotating brush (51). Therefore, the dust on the air filter (40) is all removed, and is contained in the dust container (60).

Since the gap between the edge (6*c*) of the rearward top plate (6*b*) and the rotating brush (51) is reduced, the dust container (60) is more closed (sealed). This can prevent the air blowing in the dust container (60) in the dust transfer operation from leaking through the gap, thereby improving the efficiency of dust transfer.

Figure 18:
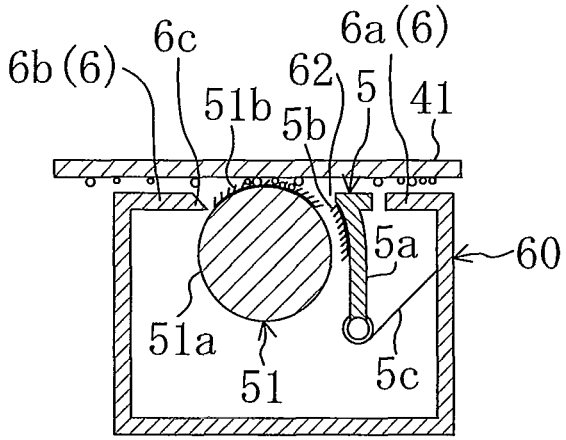
FIG. 18 is a lateral cross-sectional view illustrating the structure of the dust container and the rotating brush according to the ninth modified example of the first embodiment.

In this modified example, the edge (6*c*) of the rearward top plate (6*b*) may be configured as shown in FIG. 18. Specifically, the edge (6*c*) is tapered toward the rotating brush (51), with its thickness gradually decreasing in a direction away from the air filter (40). Specifically, the edge (6*c*) of the rearward top plate (6*b*) approaches the rotating brush (51) as it separates from the air filter (40). In this case, as compared with the tapered shape shown in FIG. 17, the gap between the edge (6*c*) of the rearward top plate (6*b*) and the rotating brush (51) increases. However, the dust that has not scraped but moved rearward of the rotating brush (51) is dragged by the air filter (40) along the tapered face of the edge (6*c*), and is transferred in the direction of movement of the air filter (40). Therefore, also in this case, the dust that passed over the rotating brush (51) is prevented from remaining in the gap, thereby allowing for smooth movement of the dust together with the air filter (40).

The shape of the edge (6*c*) of the rearward top plate (6*b*) is not limited to the examples described above, and may be tapered in a different manner.

Second Embodiment

A second embodiment of the present invention will be described below. The second embodiment is achieved by changing the structures of the air filter (40), the filter drive means, the dust container (60), and the dust transfer unit (70) of the first embodiment.

Figure 19:
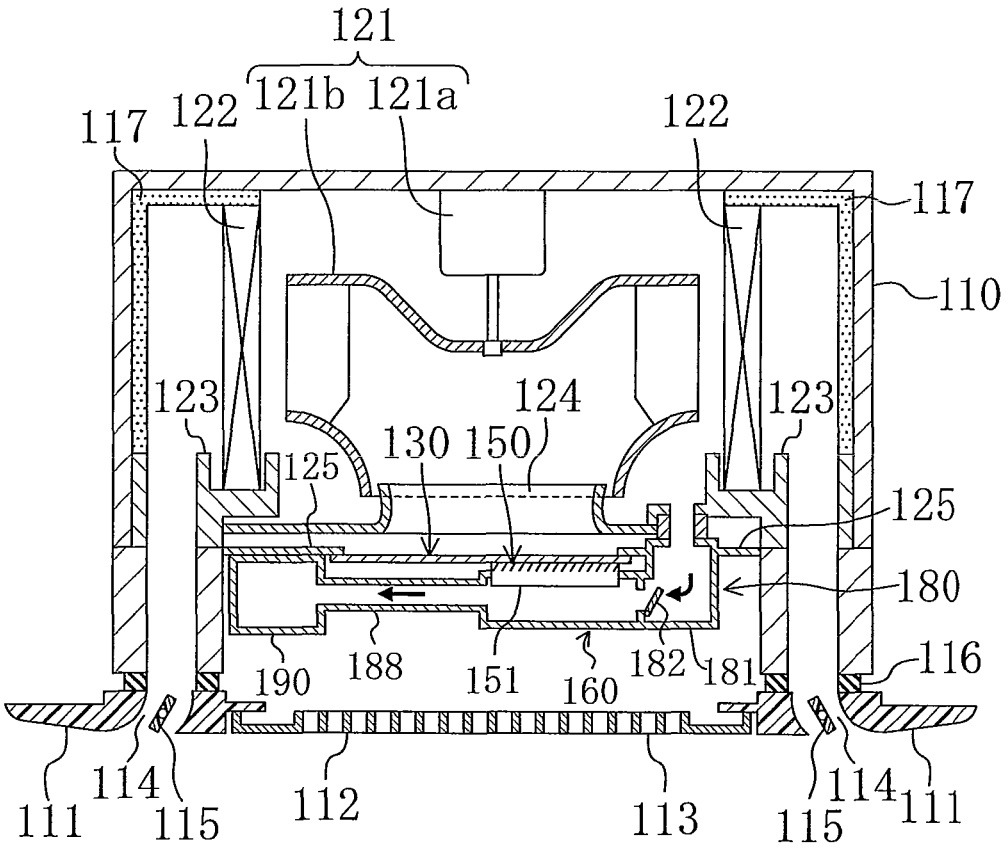
FIG. 19 is a vertical cross-sectional view illustrating the structure of an indoor unit of a second embodiment of the present invention.
Figure 20:
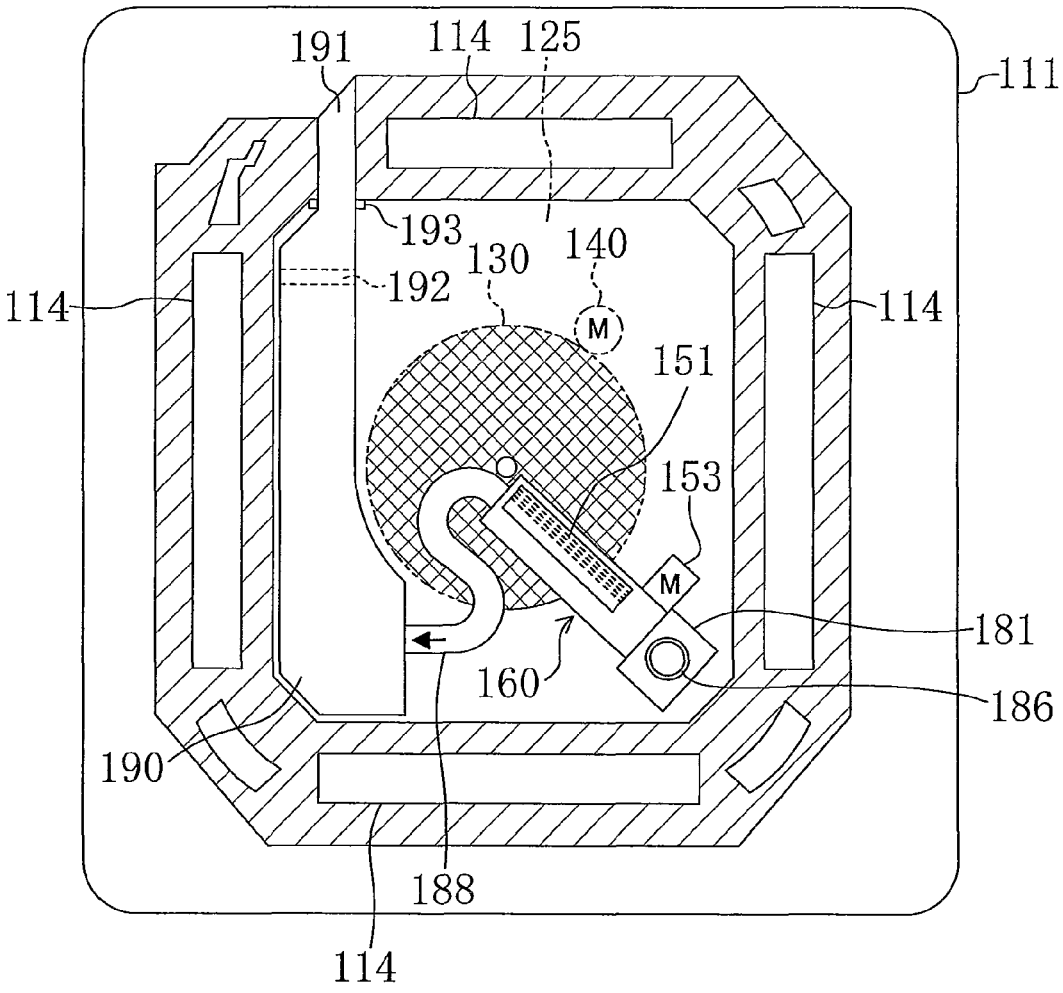
FIG. 20 is a lateral cross-sectional view illustrating the structure of the indoor unit of the second embodiment of the present invention as viewed from above.

As shown in FIGS. 19 and 20, an indoor unit (13) of the present embodiment includes a casing (110) and a decorative panel (111). The casing (110) contains an indoor heat exchanger (122), a drain pan (123), an indoor fan (121), an air filter (130), a filter drive means (140), a dust removing unit (150), a dust container (160), a dust transfer unit (180), and a dust collection box (190).

The casing (110) is in the shape of a substantially rectangular parallelepiped box having an open bottom. A heat insulator (117) is laminated on an inner surface of the casing (110). The casing (110) is arranged with its lower portion inserted in an opening in a ceiling board.

The decorative panel (111) is in the shape of a rectangular plate. When viewed in plan, the decorative panel (111) is slightly larger than the casing (110). The decorative panel (111) is attached to the casing (110) to cover the bottom of the casing (110) with a sealant (116) sandwiched therebetween. The decorative panel (111), when attached to the casing (110), is exposed in the room.

The decorative panel (111) is provided with one inlet (113) and four outlets (114). The inlet (113) is rectangular-shaped, and is formed in the center of the decorative panel (111). A suction grille (112) provided with slits is fitted in the inlet (113). Each of the outlets (114) is in the shape of a narrow rectangle. The outlets (114) are formed along the sides of the decorative panel (111), respectively. An adjuster plate (115) for adjusting the direction of air flow is provided at each of the outlets (114). The adjuster plate (115) rotates to adjust the direction of air flow (the direction of blowing air).

The indoor fan (121) is a so-called turbo fan. The indoor fan (121) is arranged near the center of the casing (110) and above the inlet (113). The indoor fan (121) includes a fan motor (121*a*) and an impeller (121*b*). The fan motor (121*a*) is fixed to a top plate of the casing (110). The impeller (121*b*) is connected to a rotation axis of the fan motor (121*a*). A bell mouth (124) communicating with the inlet (113) is provided below the indoor fan (121). The bell mouth (124) divides space in the casing (110) upstream of the indoor heat exchanger (122) into a room near the indoor fan (121) and a room near the suction grille (112). The indoor fan (121) is configured to blow air sucked from below through the bell mouth (124) in a radial direction.

The indoor heat exchanger (122) is configured as a cross-fin type fin-and-tube heat exchanger. When viewed in plan, the indoor heat exchanger (122) is in the shape of a rectangular frame, and is arranged to surround the indoor fan (121). In the indoor heat exchanger (122), indoor air (blowing air) sent by the indoor fan (121) and a circulating refrigerant exchange heat.

The drain pan (123) is arranged below the indoor heat exchanger (122). The drain pan (123) receives drainage generated as a result of condensation of moisture in the air in the indoor heat exchanger (122). The drain pan (123) is provided with a drain pump (not shown) for discharging the drainage. The drain pan (123) is inclined so that the drainage is collected to part of the drain pan at which the drain pump is provided.

A partition plate (125) is provided below the bell mouth (124). The partition plate (125) vertically divides space between the bell mouth (124) and the suction grille (112). Specifically, the partition plate (125) divides space upstream of the indoor heat exchanger (122) into a room near the indoor heat exchanger (122) including the bell mouth (124), and a room near the suction grille (112).

Figure 21:
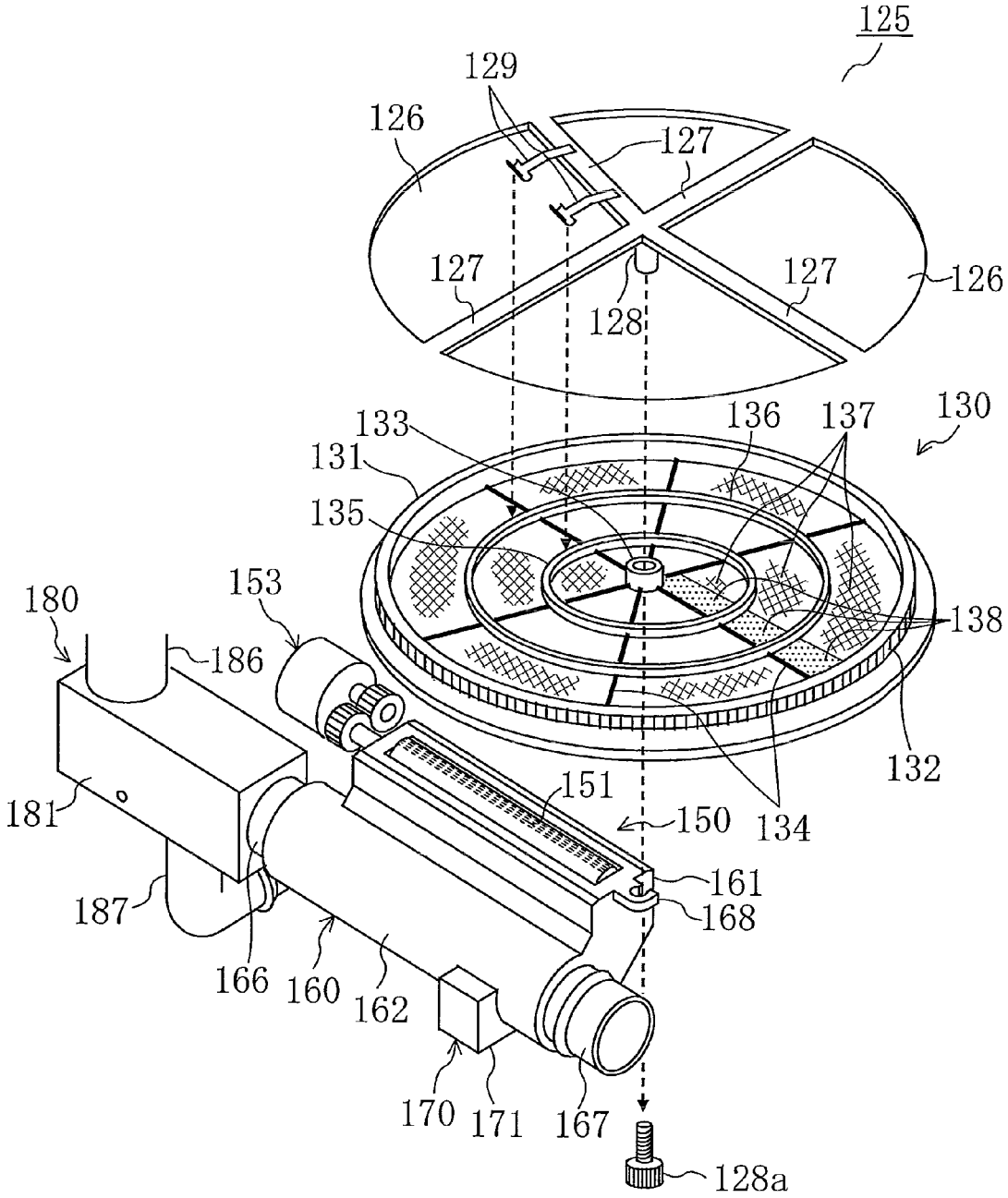
FIG. 21 is a perspective view illustrating the structure of a partition plate, an air filter, and a dust container of the second embodiment of the present invention.

A vent (126) through which the air sucked through the inlet (113) flows into the bell mouth (124) is formed in the center of the partition plate (125). As shown in FIG. 21, the circular vent (126) is divided into four fan-shaped vents by four radially extending radial members (127). The radial members (127) are connected to each other at the center of the circular vent, and a cylindrical filter rotation axis (128) protrudes downward from the center. The filter rotation axis (128) is a rotation axis about which the air filter (130) rotates. Two filter holders (129) are formed on one of the radial members (127).

As shown in FIG. 21, the air filter (130) is arranged below the partition plate (125), and is in the shape of a disc which is as large as it can cover an inlet of the bell mouth (124). Specifically, the air filter (130) includes an annular filter body (131), a mesh member (137), and a closure member (138). A gear (132) is formed on an outer circumferential surface of the filter body (131). A cylindrical axis receiver (133) supported by six radial ribs (134) is formed in the center of the annular filter body (131). Specifically, each of the radial ribs (134) radially extends from the axis receiver (133). An inner annular rib (135) and an outer annular rib (136) coaxial with the filter body (131) are formed radially inside the filter body (131). The outer annular rib (136) has a larger diameter than the inner annular rib (135). The mesh member (137) covers most part of the inside of the filter body (131). The air sucked through the inlet (113) passes through the mesh member (137) of the air filter (130), and flows into the bell mouth (124). The dust contained in the air is trapped on the mesh member (137). The closure member (138) is attached to one of fan-shaped rooms inside the filter body (131) divided by the radial ribs (134). The closure member (138) has a constant width, and extends from the axis receiver (133) to the annular filter body (131) along the radial rib (134). The closure member (138) may be, for example, a resin sheet, and unlike the mesh member (137), it does not allow the air to pass through. The function of the closure member (138) will be described later in detail.

The air filter (130) is biased downward by the filter holders (129) abutting the radial ribs (135, 136). Therefore, the air filter (130) is pressed onto a rotating brush (151) of a dust removing unit (150) described later. This improves the efficiency of dust removal by the dust removing unit (150).

Figure 22:
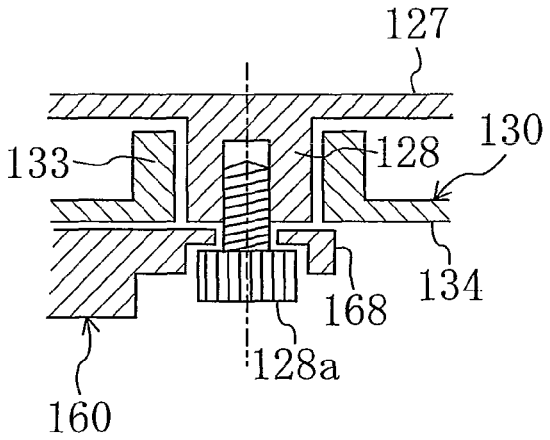
FIG. 22 is a cross-sectional view illustrating how the air filter of the second embodiment of the present invention is attached.

As shown in FIG. 22, the axis receiver (133) of the air filter (130) is fitted on the filter rotation axis (128) of the partition plate (125). The air filter (130) is rotatable about the filter rotation axis (128). The dust container (160) is arranged below the air filter (130). With the axis receiver (133) of the air filter (130) fitted on the filter rotation axis (128), a filter attachment (168) of the dust container (160) is fixed to the filter rotation axis (128) of the partition plate (125) with a fixing screw (128*a*). Thus, the air filter (130) is held between the partition plate (125) and the dust container (160).

A filter drive means (140) for rotating the air filter (130) is provided near the air filter (130) (see FIG. 20). The filter drive means (140) functions as a moving means for relatively moving the air filter (130) and the rotating brush (151).

Figure 23:
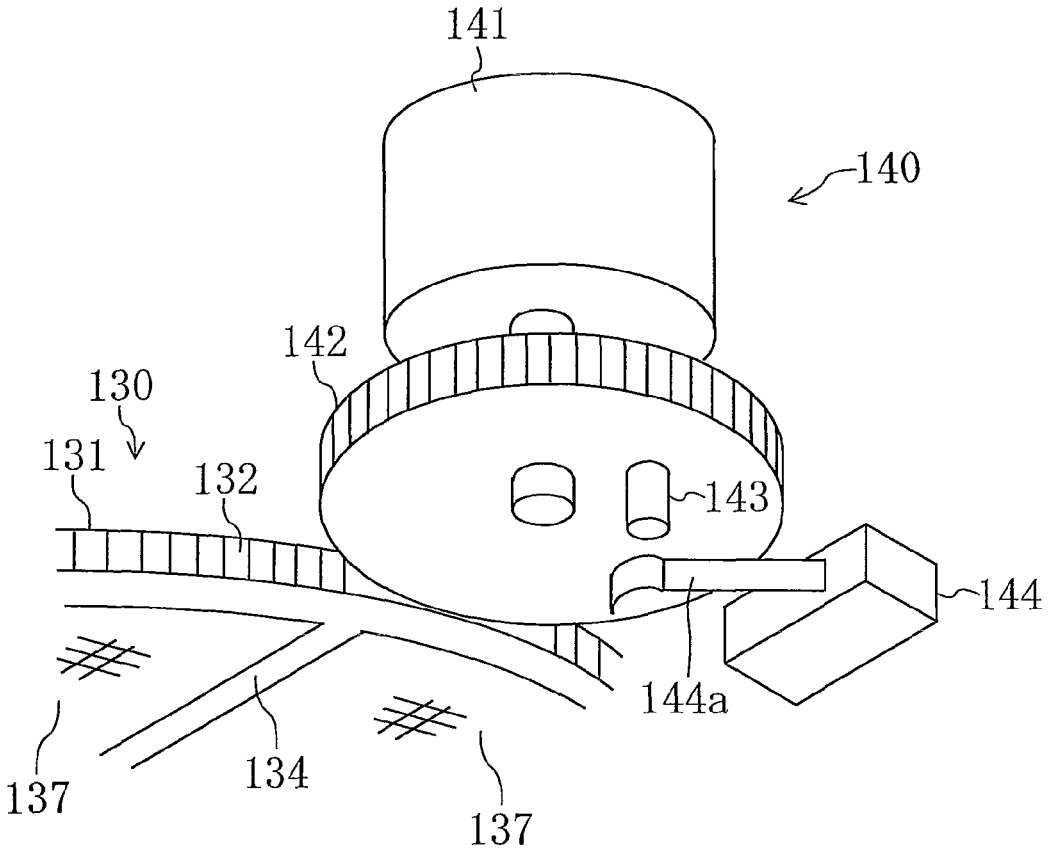
FIG. 23 is a perspective view illustrating the structure of a filter drive means of the second embodiment of the present invention.

Specifically, the filter drive means (140) includes a filter drive motor (141) and a limit switch (144) as shown in FIG. 23. A drive gear (142) is attached to a drive shaft of the filter drive motor (141), and the drive gear (142) engages with the gear (132) of the filter body (131). A switch actuator (143) is formed on one of the surfaces of the drive gear (142). The switch actuator (143) actuates a lever (144*a*) of the limit switch (144) in response to the rotation of the drive gear (142). The limit switch (144) detects the actuation of the lever (144*a*) by the switch actuator (143). That is, the switch actuator (143) and the limit switch (144) detect the rotational position of the drive gear (142).

The dust removing unit (150), the dust container (160), and the dust transfer unit (180) will be described with reference to FIGS. 24 to 29. The dust removing unit (150), etc., are arranged below the partition plate (125) and the air filter (130) (see FIGS. 19 and 20).

The dust removing unit (150) is provided to remove the dust trapped on the air filter (130). The dust removing unit (150) includes a rotating brush (151), a non-rotating brush (152), and a brush drive means (153).

Figure 26:
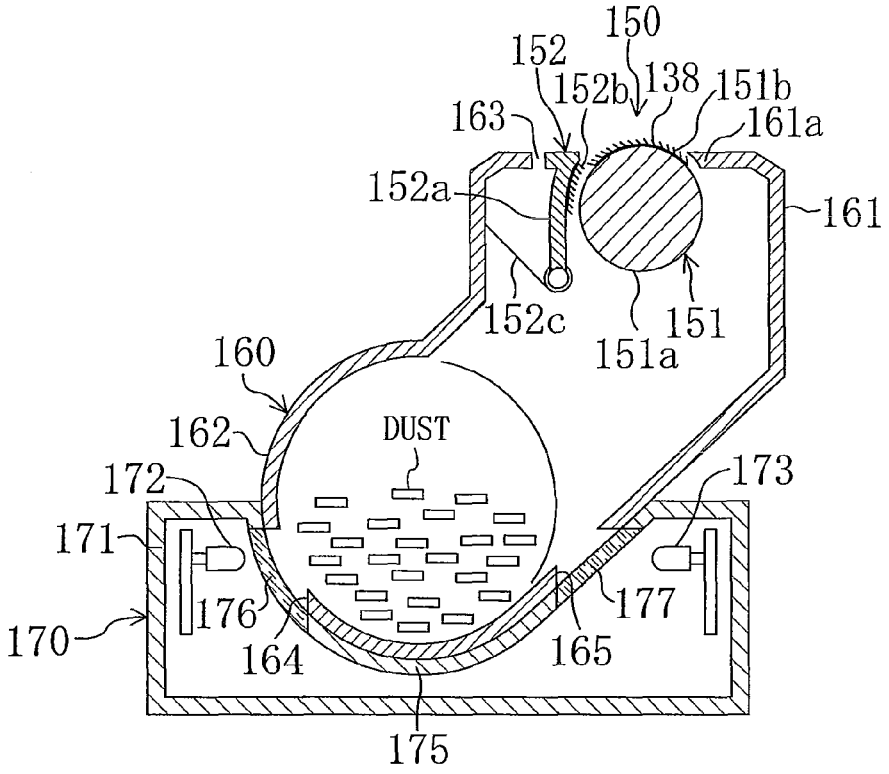
FIG. 26 is a lateral cross-sectional view illustrating the structure of a dust amount detection means of the second embodiment of the present invention relative to the dust container.

As shown in FIG. 26, the rotating brush (151) and the non-rotating brush (152) are arranged in a brush receiving opening (163) of the dust container (160) described later.

The rotating brush (151) includes a narrow cylindrical shaft portion (151*a*) and a bristle portion (151*b*) attached to an outer circumferential surface of the shaft portion (151*a*). The bristle portion (151*b*) is formed of a plurality of bristles. The bristle portion (151*b*) covers part of the circumference of the shaft portion (151*a*), and extends in the longitudinal direction of the shaft portion (151*a*). The non-rotating brush (152) is arranged rearward of the rotating brush (151).

The non-rotating brush (152) includes a body (152*a*), a bristle portion (152*b*), and a spring (152*c*). The body (152*a*) is a plate-like member, and has the same length as the shaft portion (151*a*) of the rotating brush (151). The body (152*a*) is arranged with a surface thereof facing the outer circumferential surface of the rotating brush (151). An upper portion of the body (152*a*) is curved to correspond to the outer circumferential surface of the shaft portion (151*a*) of the rotating brush (151). The bristle portion (152*b*) is provided on the curved portion of the body (152*a*) to extend in the longitudinal direction of the body (152*a*). The spring (152*c*) is attached to a lower end portion of the body (152*a*), and to an inner wall of the dust container (160). That is, the body (152*a*) is supported by the spring (152*c*).

The rotating brush (151) and the non-rotating brush (152) have a length equal to or larger than the radius of the air filter (130). The rotating brush (151) and the non-rotating brush (152) are arranged to extend radially outward from the center of the air filter (130).

Figure 24:
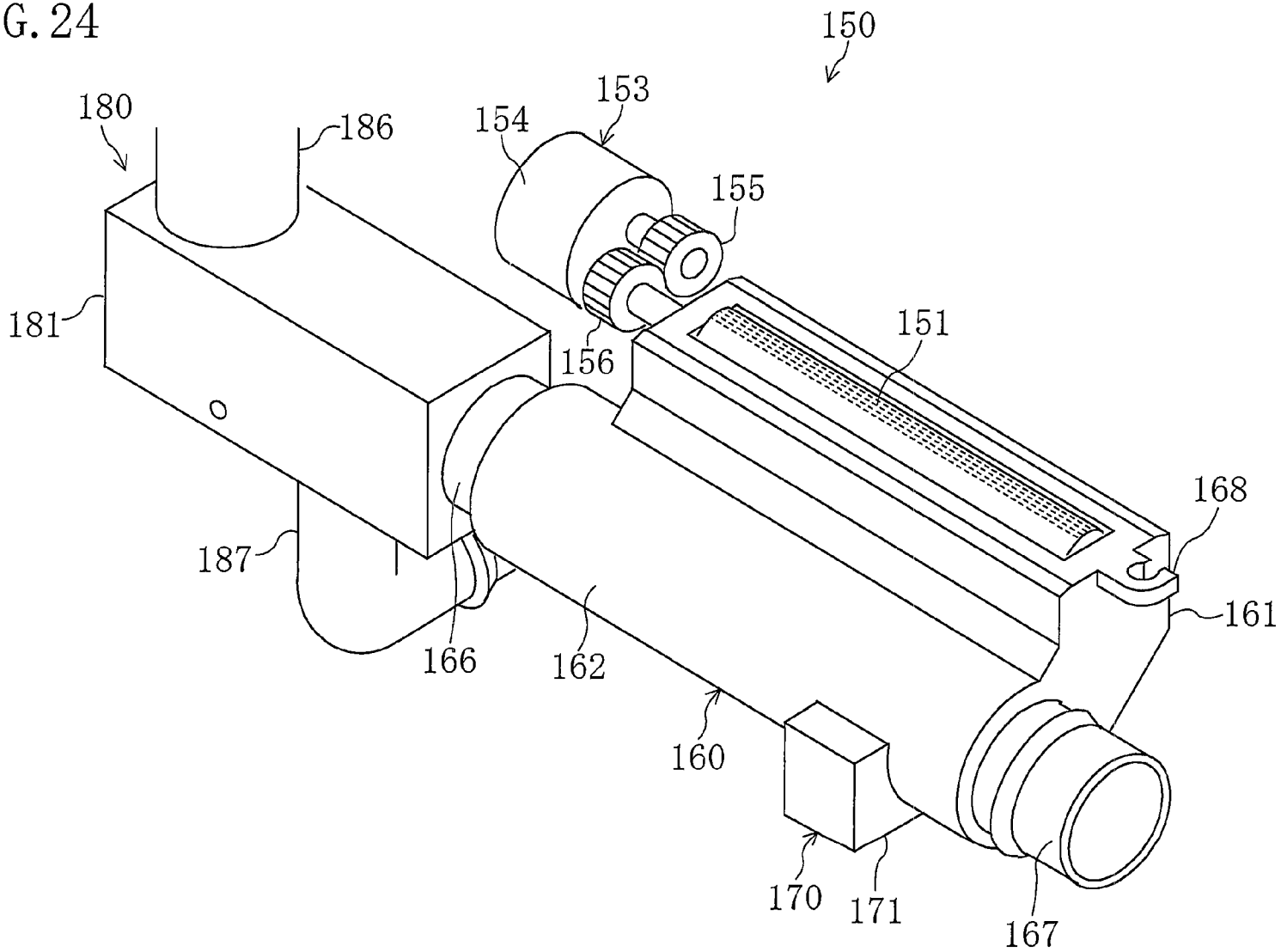
FIG. 24 is a perspective view illustrating the structure of a dust removing unit and a dust container of the second embodiment of the present invention as viewed from above.
Figure 25:
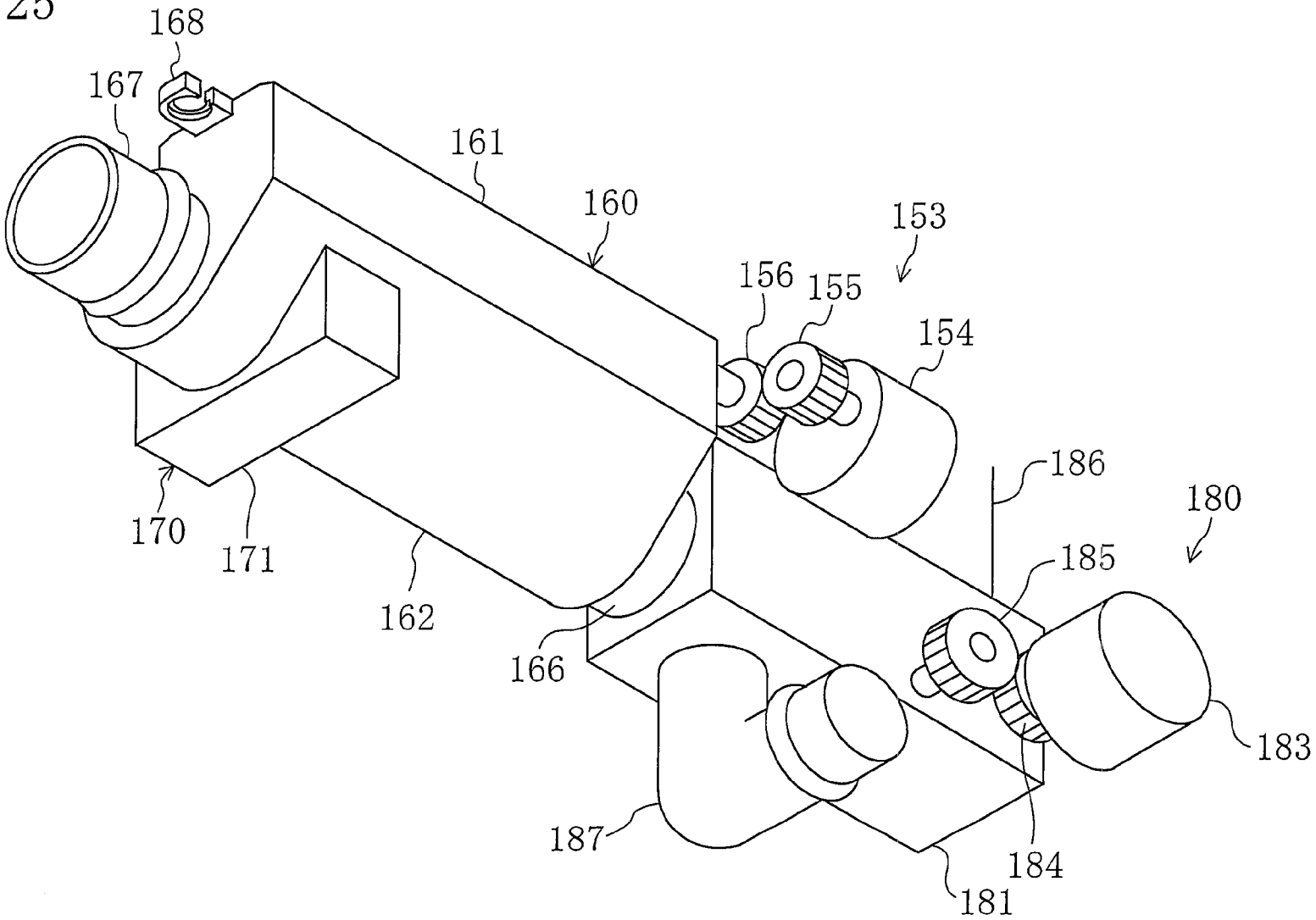
FIG. 25 is a perspective view illustrating the structure of the dust removing unit and the dust container of the second embodiment of the present invention as viewed from below.

The rotating brush (151) is configured in such a manner that the dust is removed from the mesh member (137) as the bristle portion (151*b*) comes into contact with the mesh member (137) of the rotating air filter (130). The rotating brush (151) is driven by the brush drive means (153) to rotate in a reversible manner. As shown in FIGS. 24 and 25, the brush drive means (153) includes a brush drive motor (154), and a drive gear (155) and a driven gear (156) engaging with each other. The drive gear (155) is attached to a drive shaft of the brush drive motor (154), and the driven gear (156) is attached to an end of the shaft portion (151*a*) of the rotating brush (151). This structure drives the rotating brush (151) to rotate.

The bristle portion (152*b*) of the non-rotating brush (152) is configured to come into contact with the bristle portion (151*b*) of the rotating brush (151) as the rotating brush (151) is rotated by the brush drive means (153). The contact allows for removal of the dust from the bristle portion (151*b*) of the rotating brush (151). Specifically, the non-rotating brush (152) removes the dust from the rotating brush (151) to clean the rotating brush (151). The dust removal action of the rotating brush (151) and the non-rotating brush (152) will be described later.

The bristle portions (151*b*, 152*b*) of the rotating brush (151) and the non-rotating brush (152) are made of so-called pile fabric. The pile fabric is hairy fabric obtained by weaving an extra fiber (pile yarn) into base fabric, and has relatively short bristles projecting from the base fabric. The pile fabric is inclined pile fabric in which the bristles are inclined in a certain direction.

Specifically, the bristles of the bristle portion (151*b*) of the rotating brush (151) are inclined to the left from the shaft portion (151*a*) in FIG. 26. In other words, the bristles of the bristle portion (151*b*) are inclined in a direction opposite the direction of rotation of the air filter (130). When the air filter (130) rotates in the direction opposite the direction of inclination of the bristles of the bristle portion (151*b*), the dust on the mesh member (137) is efficiently scraped. On the other hand, when the air filter (130) rotates in the same direction as the direction of inclination of the bristles of the bristle portion (151*b*), the dust on the mesh member (137) is not scraped, but the dust trapped on the bristle portion (151*b*) is removed. The bristles of the bristle portion (152*b*) of the non-rotating brush (152) are inclined downward from the body (152*a*) in FIG. 26. Specifically, the bristles of the bristle portion (152*b*) are inclined in the direction opposite the direction of counterclockwise rotation of the rotating brush (151) in FIG. 26.

The dust container (160) contains the dust removed from the rotating brush (151) by the non-rotating brush (152), i.e., it contains the dust removed by the dust removing unit (150). The dust container (160) is a columnar container bent substantially in the shape of rotated V when viewed from the side (from the right in FIG. 24). An upper portion of the dust container (160) is a removal portion (161) for removing the dust on the air filter (130), and a lower portion is a container portion (162) for containing the dust removed from the air filter (130).

A brush receiving opening (163) is formed in a top plate of the removal portion (161) to extend in the longitudinal direction of the top plate, and the rotating brush (151) and the non-rotating brush (152) are arranged in the brush receiving opening (163) as described above. The above-described filter attachment (168) is formed at a side surface of the removal portion (161). An edge (161*a*) of the top plate rearward of the brush receiving opening (163) (i.e., an edge opposite the non-rotating brush (152)) is tapered toward the rotating brush (151), with an end face thereof being curved to correspond to the bristle portion (151*b*) of the rotating brush (151). This minimizes a gap between the edge (161*a*) and the rotating brush (151) as much as possible. Therefore, even if the dust on the air filter (130) is not removed by the rotating brush (151), and passes over the rotating brush (151), the dust is immediately guided in the direction of movement of the air filter (130) along the edge (161*a*). Specifically, the dust that passed over the rotation brush (151) is not disturbed by the top plate of the removal portion (161), but moves smoothly while it is kept adhered to the air filter (130). This modification to the edge (161*a*) can prevent the dust from remaining in the gap between the rotating brush (151) and the top plate of the removal portion (161). If the dust remains in the gap, it gradually grows into a cluster of a certain size, and is finally flipped out of the gap to fall in the room, etc. However, this can be prevented by the present embodiment. Further, since the gap between the edge (161*a*) and the rotating brush (151) is reduced, the dust container (160) is more closed (sealed).

A lower (bottom) part of the container portion (162) is convex curved. The dust removed from the rotating brush (151) by the non-rotating brush (152) falls and accumulates in the curved part of the container portion (162). Longitudinal ends (166, 167) of the container portion (162) are both opened. A first end (166) of the container portion (162) is connected to a damper box (181) of a dust transfer unit (180) described later, and a second end (167) is connected to a transfer duct (188) of the dust transfer unit (180) described later.

As shown in FIG. 26, the dust container (160) includes a dust amount detection means (170) for detecting the amount of dust (the amount of the contained dust) in the container portion (162). The dust amount detection means (170) includes a sensor box (171). The sensor box (171) is arranged close to the second end (167) of the container portion (162) of the dust container (160), and extends laterally across the container portion (162) to cover the bottom of the container portion (162).

Two openings (164, 165) are formed in a wall of the container portion (162) (a container wall) covered with the sensor box (171). A first opening (164) and a second opening (165) oppose to each other. The sensor box (171) includes two transparent windows (176, 177) formed in a curved portion (175) covering the container wall of the container portion (162). A first transparent window (176) and a second transparent window (177) are provided to close the first opening (164) and the second opening (165) of the container portion (162), respectively.

The sensor box (171) contains an LED (172) as a light emitter, and a phototransistor (173) as a light receptor. The LED (172) is arranged to face the first transparent window (176) and the first opening (164), and the phototransistor (173) is arranged to face the second transparent window (177) and the second opening (165). That is, the LED (172) and the phototransistor (173) are arranged to face each other so as to laterally sandwich the container portion (162).

In the dust amount detection means (170), light emitted from the LED (172) sequentially passes through the first transparent window (176) and the first opening (164), and the second opening (165) and the second transparent window (177), and is received by the phototransistor (173). The phototransistor (173) detects the intensity of the received light. Depending on the detected light intensity, the amount of dust contained in the container portion (162) (i.e., the amount of filling dust) is determined. Specifically, when the amount of the contained dust is small, transmittance of light (the amount of transmitted light) from the first transparent window (176) to the second transparent window (177) in the container portion (162) is high, thereby increasing the detected light intensity. On the other hand, if the amount of the contained dust is large, the transmittance of light (the amount of transmitted light) from the first transparent window (176) to the second transparent window (177) in the container portion (162) is low, thereby decreasing the detected light intensity. Thus, for example, when the light intensity is a predetermined value or lower, the dust amount detection means (170) can determine that the amount of dust contained in the container portion (162) is full.

In the present embodiment, the phototransistor (173) may be replaced with a photodiode.

Figure 27:
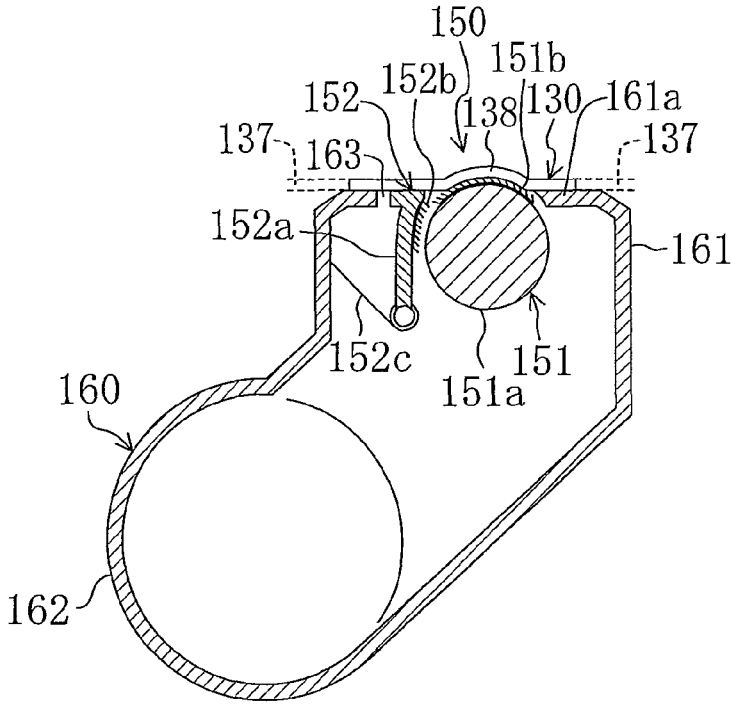
FIG. 27 is a lateral cross-sectional view illustrating the relationship between a dust container and a closure member of an air filter of the second embodiment of the present invention.

As shown in FIG. 27, in the dust container (160), the closure member (138) of the air filter (130) can cover the rotating brush (151) and the non-rotating brush (152), and can close the brush receiving opening (163). This can prevent the dust in the dust container (160) from flowing outside through the brush receiving opening (163).

The dust transfer unit (180) includes the damper box (181), a transfer duct (188), an entrance duct (186), and a suction duct (187) as shown in FIGS. 20, 24, and 25.

Figure 28:
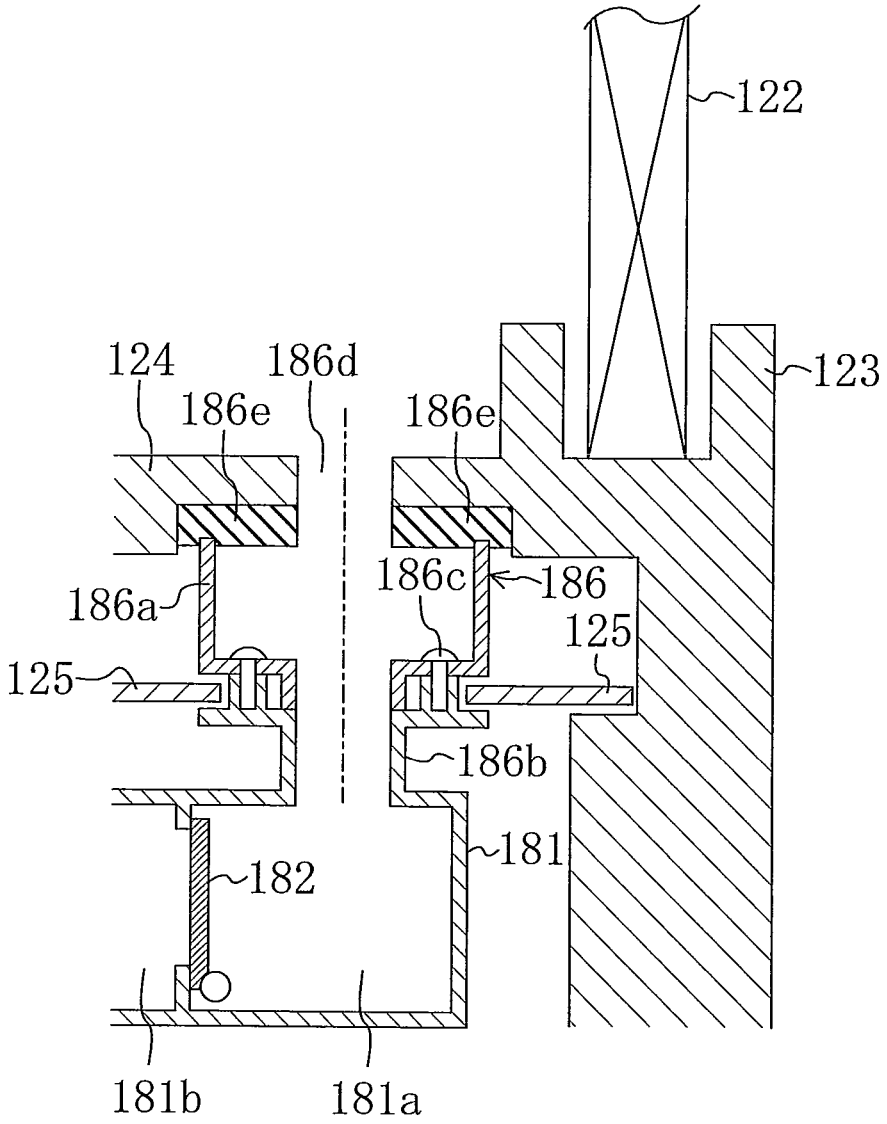
FIG. 28 is a cross-sectional view illustrating the structure of a major part of a dust transfer unit of the second embodiment of the present invention.
Figure 29:
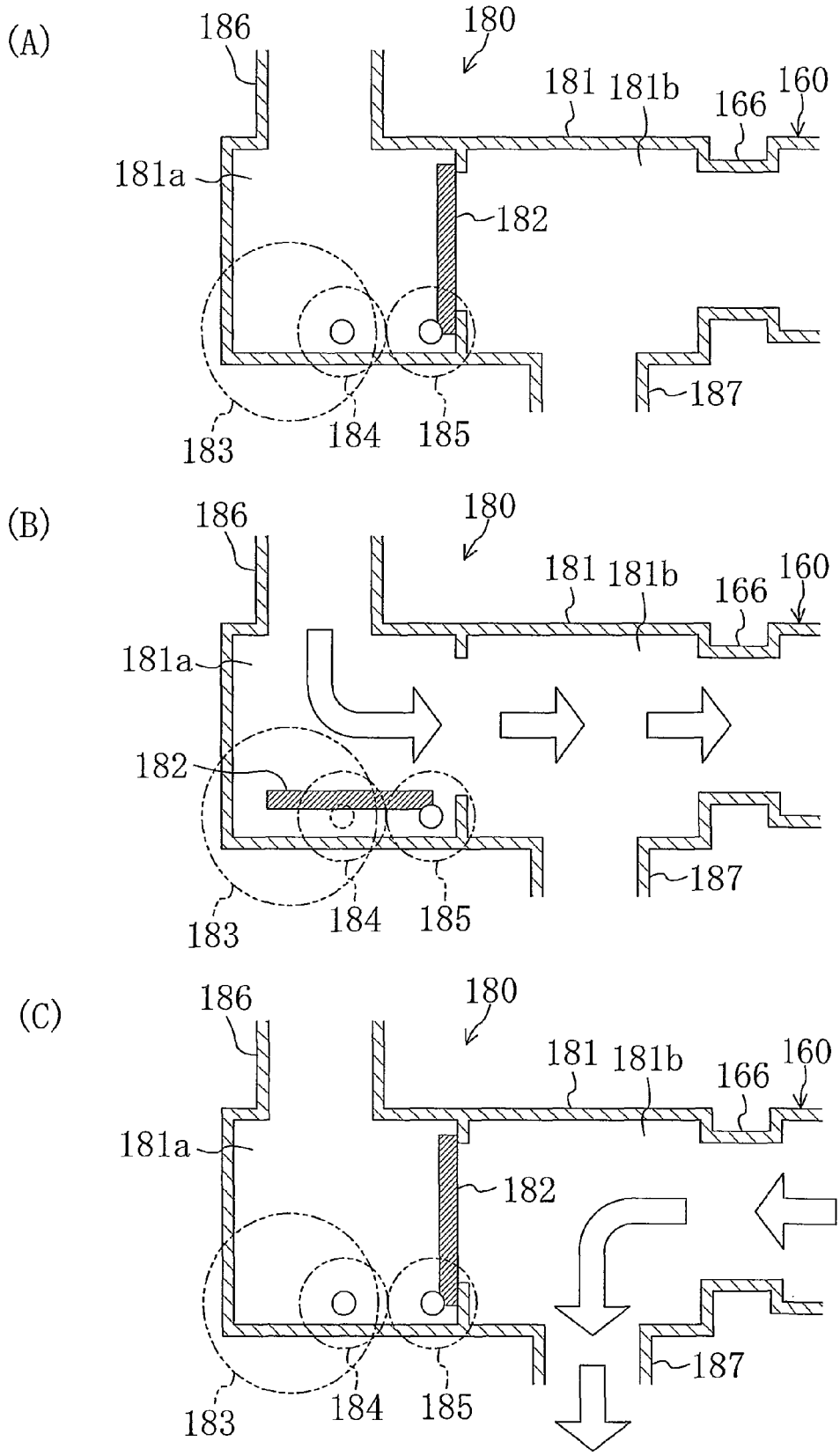
FIG. 29 is a cross-sectional view illustrating the structure of a major part of the dust transfer unit of the second embodiment of the present invention.

The damper box (181) is in the shape of a rectangular parallelepiped extending in the longitudinal direction of the container portion (162) of the dust container (160). The first end (166) of the container portion (162) is connected to a longitudinal end of the damper box (181). As shown in FIGS. 28 and 29, the damper box (181) contains a damper (182) as a path opening/closing means of the present invention. Closing the damper (182) divides space inside the damper box (181) in the longitudinal direction. Specifically, the space inside the damper box (181) is divided into a first room (181*a*) and a second room (181*b*). As described above, the first end (166) of the container portion (162) is connected to the second room (181*b*).

As shown in FIGS. 25 and 29, the dust transfer unit (180) includes a damper drive motor (183) for driving the damper (182) to open/close, a drive gear (184), and a driven gear (185). The drive gear (184) is attached to a drive shaft of the damper drive motor (183), and the driven gear (185) is attached to a rotation axis of the damper (182). The drive gear (184) and the driven gear (185) engage with each other. In this structure, the rotation of the damper drive motor (183) is transferred to the rotation axis of the damper (182) through the gears (184, 185). This allows the damper (182) to rotate about the rotation axis, thereby opening/closing the damper (182).

The entrance duct (186) is connected to an upper surface of the damper box (181), and communicates with the first room (181*a*). As shown in FIG. 28, the entrance duct (186) extends vertically upward from the damper box (181), and penetrates the partition plate (125). The entrance duct (186) includes an upstream duct (186*a*) and a downstream duct (186*b*), both of which are circular when viewed in a lateral cross-sectional view. The two ducts (186*a*, 186*b*) are vertically connected to each other with fixing screws (186*c*). A lateral cross-sectional area (a flow path area) of the upstream duct (186*a*) is larger than a lateral cross-sectional area (a flow path area) of the downstream duct (186*b*). A lower end portion of the downstream duct (186*b*) (a lower end portion in FIG. 28) is connected to the damper box (181). An upper end portion of the upstream duct (186*a*) (an upper end portion in FIG. 28) is in contact with a horizontally extending member of the bell mouth (124) with a sealing member (186*e*) interposed therebetween. An inlet (186*d*) as a through hole is formed in the horizontally extending member of the bell mouth (124). The upstream duct (186*a*) communicates with space including the indoor fan (121) through the inlet (186*d*). Specifically, the entrance duct (186) brings the air blowing from the indoor fan (121) into the damper box (181).

A junction between the upstream duct (186*a*) and the downstream duct (186*b*) of the entrance duct (186) is located in a through hole formed in the partition plate (125). Specifically, the ducts (186*a*, 186*b*) are connected in such a manner that a bottom plate of the upstream duct (186*a*) and an upper flange of the downstream duct (186*b*) sandwich the rim of the through hole in the partition plate (125). The junction and the sealing member (186*e*) are configured in such a manner that the entrance duct (186), the damper box (181), and the dust container (160) rotate together about the axial center of the entrance duct (186).

An inlet end of the suction duct (187) is connected to the lower surface of the damper box (181), and communicates with the second room (181*b*). The other outlet end of the suction duct (187) is connected to a nozzle receiver (210) formed on the decorative panel (111) as described later. The nozzle receiver (210) is provided to receive a hose of a cleaner, etc., inserted therein.

As shown in FIGS. 19 and 20, one end of the transfer duct (188) is connected to the second end (167) of the container portion (162) of the dust container (160), and the other end is connected to a dust collection box (190) described later. The transfer duct (188) is made of a flexible tube.

The entrance duct (186) and the transfer duct (188) provide a path of the air of the present invention.

In the dust transfer unit (180), the damper (182) in the damper box (181) is closed in normal operation of performing cooling and heating (see FIG. 29(A)). Therefore, the air blowing from the indoor fan (121) does not enter the damper box (181). In the dust transfer unit (180), the damper (182) in the damper box (181) is opened in transferring the dust in the dust container (160) to the dust collection box (190) (see FIG. 29(B)). This allows the air blowing from the indoor fan (121) to enter the dust container (160) through the entrance duct (186) and the damper box (181). As a result, the dust in the dust container (160) is transferred to the dust collection box (190) together with the air through the transfer duct (188). That is, the dust in the dust container (160) is discharged. Further, in the dust transfer unit (180), the damper (182) in the damper box (181) is closed when the dust in the dust collection box (190) is discharged outside the casing (110) (see FIG. 29(C)). In this case, the dust in the dust collection box (190) is sucked by a cleaner attached to the nozzle receiver (210) through the transfer duct (188), the damper box (181), and the suction duct (187). That is, the dust transfer unit (180) is configured to transfer the dust in the dust container (160) to a predetermined location using the air blowing from the indoor fan (121).

As described above, the dust collection box (190) contains the dust transferred from the dust container (160) as shown in FIGS. 19 and 20. The dust collection box (190) is in the shape of a rather narrow, rectangular parallelepiped, and is arranged below the partition plate (125) like the dust container (160). The dust collection box (190) is arranged along one of the sides of the partition plate (125) so as not to overlap with the air filter (130) when viewed in plan. An end of the dust collection box (190) opposite the end connected to the transfer duct (188) serves as an exhaust port (191). A portion of the dust collection box including the exhaust port (191) penetrates the casing (110) and communicates with the inside of the room. A sealing member (193) is provided at the penetrating portion of the exhaust port (191).

The portion including the exhaust port (191) of the dust collection box (190) is smaller in area than the other portion when viewed in plan. A side plate of the dust collection box (190) close to the air filter (130) is curved to correspond to the outer circumference of the air filter (130). A filter (192) is arranged in the dust collection box (190) close to the exhaust port (191). In transferring the dust from the dust container (160) to the dust collection box (190), the air inside the box is discharged from the exhaust port (191). In this case, the filter (192) prevents the transferred dust from flowing out of the exhaust port (191). When the dust is discharged from the dust collection box (190) by suction of a cleaner, the indoor air enters the dust collection box (190) through the exhaust port (191). Dust contained in the entered air is trapped on the filter (192). In this way, air supply/exhaust through the exhaust port (191) keeps good pressure balance in the dust collection box (190), thereby allowing for transfer and discharge of the dust to and from the dust collection box (190) in a suitable manner.

Figure 30:
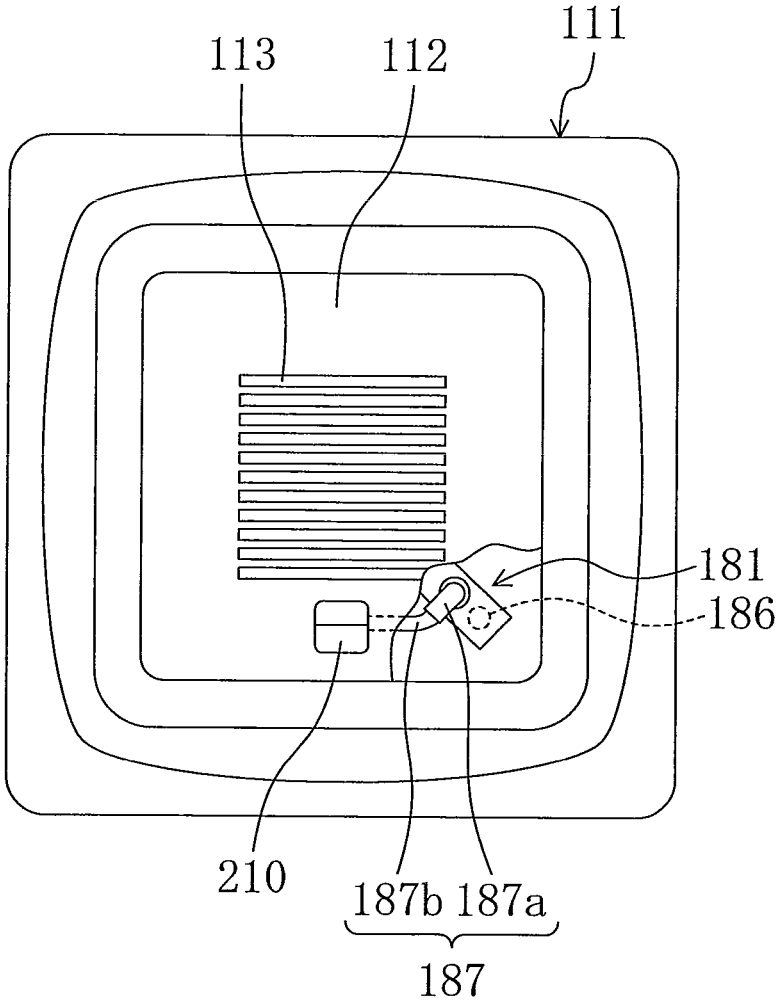
FIG. 30 is a view, partially cut away, illustrating a decorative panel of the second embodiment of the present invention as viewed from inside the room.
Figure 31:
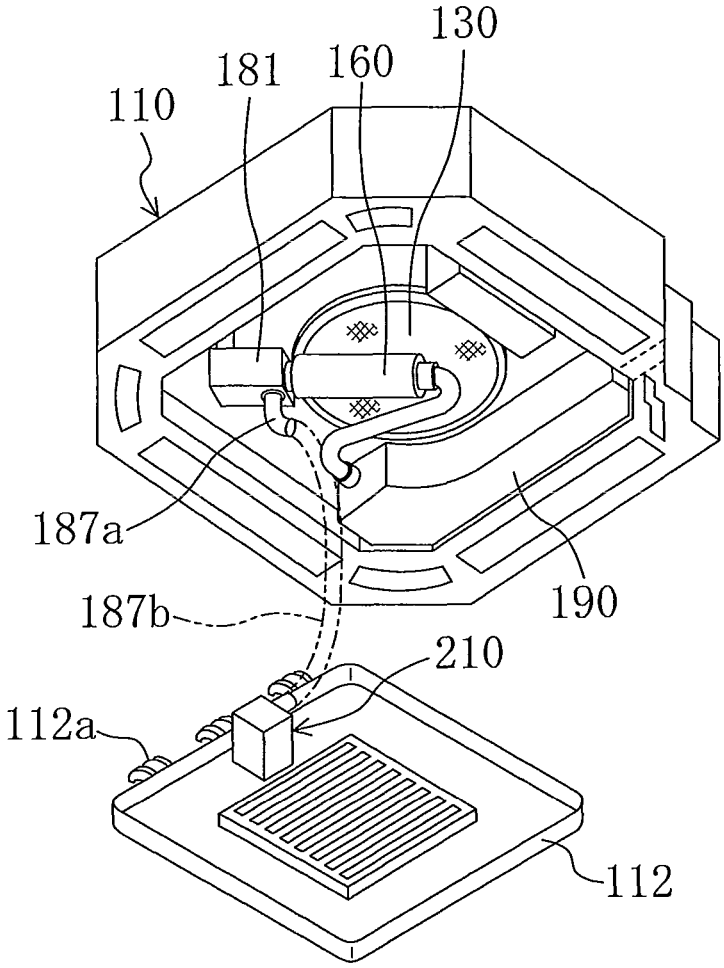
FIG. 31 is a perspective view schematically illustrating connection between a damper box and a nozzle receiver of the second embodiment of the present invention.

As shown in FIGS. 30 and 31, the suction duct (187) includes a rotatable connection tube (187*a*) attached to the lower surface of the damper box (181), and a flexible duct (187*b*) connecting the connection tube (187*a*) and the nozzle receiver (210) of the decorative panel (111). The nozzle receiver (210) is attached to the suction grille (112) outside the suction port (113). As shown in FIG. 31, hinges (112*a*) for connection with the decorative panel (111) are formed on one of the sides of the suction grille (112), and the nozzle receiver (210) is arranged near the hinges (112*a*).

Figure 32:
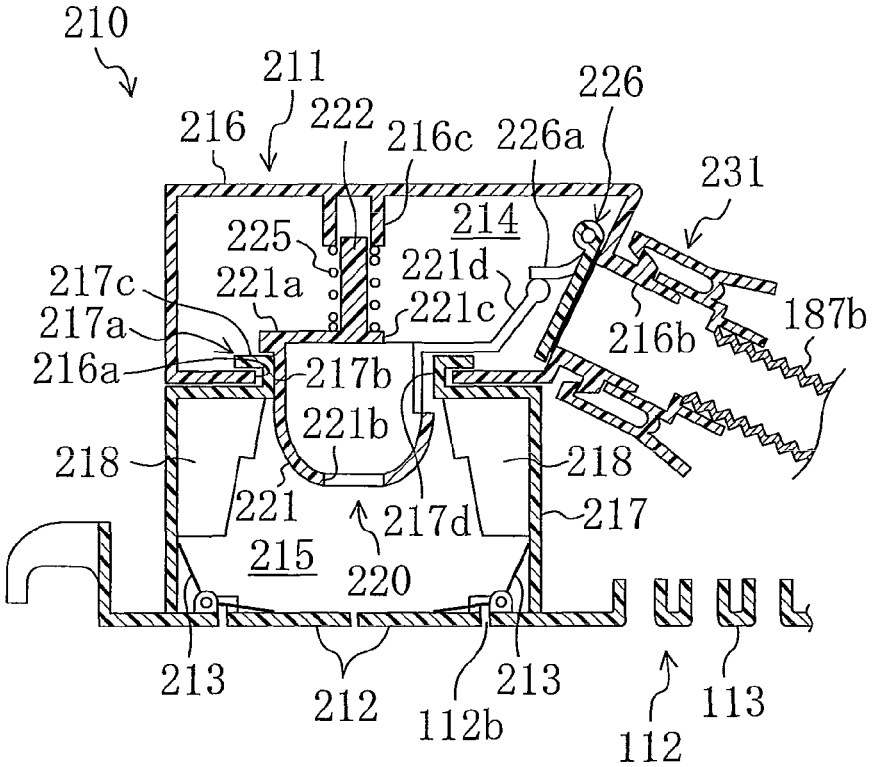
FIG. 32 is a vertical cross-sectional view illustrating the structure of the nozzle receiver of the second embodiment of the present invention.
Figure 32:
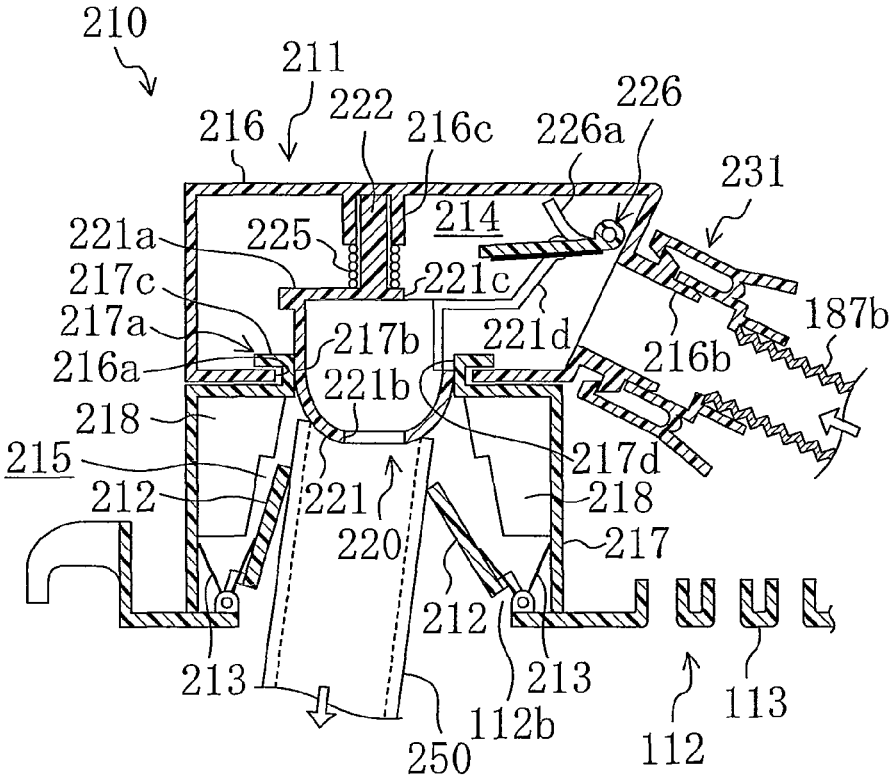

The nozzle receiver (210) includes a box-shaped cover member (211) arranged on the surface of the suction grille (112) opposite the ceiling board as shown in FIG. 32. The cover member (211) includes an upper cover (216) and a lower cover (217) vertically connected to each other. A first room (214) is formed in the upper cover (216), and a second room (215) is formed in the lower cover (217). The upper cover (216) is rotatably connected to the lower cover (217). Specifically, a circular opening (216*a*) is formed in a lower surface of the upper cover (216), and an engagement (217*a*) engaging with the rim of the opening (216*a*) is formed on an upper surface of the lower cover (217). The engagement (217*a*) of the lower cover (217) includes a cylindrical body (217*b*) protruding to correspond to the opening (216*a*) of the upper cover (216), and a flange portion (217*c*) extending radially outward from the distal end of the cylindrical body. With the rim of the opening (216*a*) of the upper cover (216) inserted between the flange portion (217*c*) and the upper surface of the lower cover (217), the upper cover (216) rotatably engages with the lower cover (217).

A duct connecting opening (216*b*) opened obliquely downward is formed in one of the side surfaces of the upper cover (216), and the flexible duct (187*b*) of the suction duct (187) is detachably connected to the duct connecting opening (216*b*) through a one-touch joint (231). The duct connecting opening (216*b*) is covered with a valve element (226) arranged inside the upper cover (216). An upper end portion of the valve element (226) is rotatably supported by the upper cover (216), and the valve element (226) includes a projection (226*a*) projecting from the upper end portion toward the inside of the upper cover (216). As described later in detail, the projection (226*a*) is in contact with part of a piston member (220), thereby opening/closing the valve element (226) in response to the vertical motion of the piston member (220).

An opening (112*b*) corresponding to the lower cover (217) is formed in the suction grille (112). Two plate-shaped lid members (212, 212) are arranged in the opening (112*b*). The lid members (212, 212) are rotatably attached to an inner side of the rim of the opening (112*b*), and are configured as double doors opening upward. A spring (213) for biasing the lid members (212) to the closed position is provided at a rotation center of each of the lid members (212). Therefore, the lid members are set in the state shown in FIG. 32(A). This can hide the inside of the nozzle receiver (210) from the room, and can prevent the dust from flowing inside the room.

An insertion hole (217*d*) in which a nozzle connector (221) described later slides is formed inside the body (217*b*) of the engagement (217*a*) of the lower cover (217). The piston member (220) includes a nozzle connector (221) to which a nozzle (250) of a cleaner abuts, and an axis (222) formed on an upper portion of the nozzle connector (221). The nozzle connector (221) is in the shape of a hemisphere projecting toward the inside of the room, and an upper portion thereof is covered with a flat portion (221*a*). A projecting end of the nozzle connector (221) is provided with a hole (221*b*). This makes it possible to reliably abut the nozzle (250) of any types of cleaners onto the nozzle connector (221), irrespective of the cross sectional shape and size of the cleaners, thereby allowing for sucking and collecting the dust through the hole (221*b*).

An opening (221*c*) is formed in part of the nozzle connector (221). The opening (221*c*) is opened obliquely upward from a dismal end of the hemispherical portion of the nozzle connector (221). An abutment (221*d*) extending obliquely upward from the flat portion (221*a*) to abut the projection (226*a*) of the valve element (226) is arranged in the opening (221*c*). Specifically, the projection (226*a*) of the valve element (226) is bent upward, and is pushed upward by the abutment (221*d*) as the nozzle connector (221) moves upward (the state shown in FIG. 32(B)). As a result, the valve element (226) opens. The axis (222) extends upward from the flat portion (221*a*) of the nozzle connector (221). An upper end of the axis (222) is inserted in a cylindrical guide portion (216*c*) formed on the upper surface of the upper cover (216). A spring (225) is arranged about the circumference of the axis (222) between the guide portion (216*c*) and the flat portion (221*a*) to bias the nozzle connector (221) downward.

In the above-described structure, when the nozzle (250) of the cleaner is pressed onto the nozzle connector (221) from below, the nozzle connector (221) moves upward against the bias force of the spring (225), and the opening (221*c*) of the nozzle connector (221) entirely communicates with the first room (214) in the upper cover (216). As the nozzle connector (221) moves upward, the abutment (221*d*) of the nozzle connector (221) pushes the projection (226*a*) of the valve element (226) upward. This opens the valve element (226), thereby communicating the suction duct (187) and space inside the nozzle connector (221) through the duct connecting opening (216*b*).

—Working Mechanism—

Figure 33:
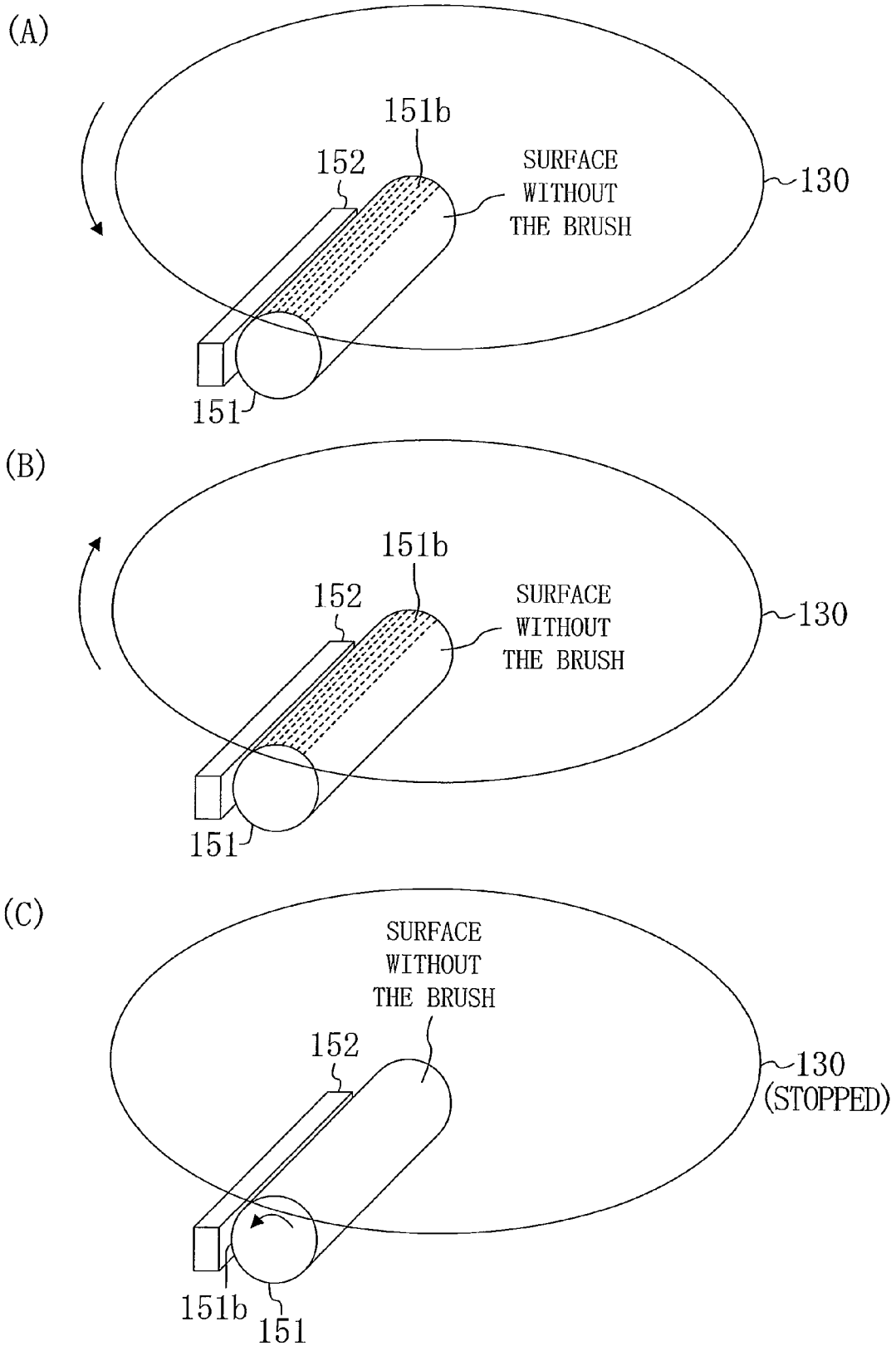

A working mechanism of the indoor unit (13) of the second embodiment will be described with reference to FIGS. 33 and 34. The indoor unit (13) is capable of switchably performing normal operation of cooling/heating the room, and filter cleaning operation of cleaning the air filter (130).

<Normal Operation>

As described above, in the normal operation, the air filter (130) is stopped in the state shown in FIG. 27. Specifically, the brush receiving opening (163) of the dust container (160) is closed by the closure member (138) of the air filter (130) in the normal operation. Further, the damper (182) in the damper box (181) is closed (the state shown in FIG. 29(A)).

In this state, the indoor fan (121) is driven. Then, indoor air sucked into the indoor unit (13) through the inlet (113) passes through the air filter (130), and enters the bell mouth (124). When the air passes through the air filter (130), dust contained in the air is trapped on the mesh member (137) of the air filter (130). The air entered the bell mouth (124) blows from the indoor fan (121). The blowing air is cooled or heated as a result of heat exchange with a refrigerant in the indoor heat exchanger (122), and is supplied to the inside of the room through the outlets (114). Thus, the room is cooled or heated.

In this way, since the damper (182) in the damper box (181) is closed in the normal operation, the air blowing from the indoor fan (121) does not enter the dust container (160) through the damper box (181). Further, since the brush receiving opening (163) of the dust container (160) is closed by the closure member (138), the dust in the dust container (160) does not flow out of the brush receiving opening (163). This can prevent the dust from falling in the room.

In the normal operation of the present embodiment, as shown in FIG. 33(C), the bristle portion (151*b*) of the rotating brush (151) may be arranged near the non-rotating brush (152). Specifically, the rotating brush (151) is rotated until the bristle portion (151*b*) of the rotating brush (151) moves to a position at which it does not contact the air filter (130), thereby facing a surface of the rotating brush (151) without the brush (i.e., a circumferential surface of the shaft (151*a*) on which the bristle portion (151*b*) is not formed) to the closure member (138) of the air filter (130). More specifically, in the normal operation, the bristle portion (151*b*) of the rotating brush (151) and the air filter (130) do not contact each other. This can prevent degradation of the bristle portion (151*b*) due to constant contact with the air filter (130), thereby improving durability of the rotating brush (151). Also in this case, the brush receiving opening (163) of the dust container (160) is closed by the closure member (138) of the air filter (130).

<Filter Cleaning Operation>

In the filter cleaning operation, the compressor is stopped, and the refrigerant does not circulate in the refrigerant circuit. In this filter cleaning operation, "dust removal operation," "brush cleaning operation," "dust transfer operation," and "dust discharge operation" are switchably performed.

The "dust removal operation" is performed to remove the dust trapped on the air filter (130). The "brush cleaning operation" is performed to remove the dust trapped on the rotating brush (151). The "dust transfer operation" is performed to transfer the dust from the dust container (160) to the dust collection box (190). The "dust discharge operation" is performed to discharge the dust in the dust collection box (190) outside the casing (110).

In the present embodiment, the "dust removal operation" and the "brush cleaning operation" are alternately performed. First, in the "dust removal operation," the indoor fan (121) is stopped. Then, as shown in FIG. 33(A), the rotating brush (151) is rotated to bring the bristle portion (151*b*) into contact with the air filter (130). In this state, the air filter (130) rotates in the direction of an arrow indicated in FIG. 33(A) (counterclockwise direction). Specifically, the air filter (130) moves in a direction opposite the inclination of the bristles of the bristle portion (151*b*) of the rotating brush (151). The rotating brush (151) is kept stopped.

As a result, the dust on the air filter (130) is trapped on the bristle portion (151*b*) of the rotating brush (151) (see FIG. 34(A)). Then, when the lever (144*a*) of the limit switch (144) of the filter drive means (140) is actuated, the filter drive motor (141) stops, thereby stopping the air filter (130). In this way, the dust remaining on part of the air filter (130) that has passed over the bristle portion (151*b*) of the rotating brush (151) is removed. Since the bristles of the bristle portion (151*b*) are inclined in the direction opposite the direction of rotation (movement) of the air filter (130), the dust on the air filter (130) is easily scraped by the bristle portion (151*b*). When the air filter (130) stops, the "dust removal operation" is switched to the "brush cleaning operation."

In the "brush cleaning operation," the indoor fan (121) and the rotating brush (151) remains stopped, and the air filter (130) rotates in the direction of an arrow indicated in FIG. 33(B) (clockwise direction). Specifically, the air filter (130) rotates in the reverse direction of the direction of rotation in the "dust removal operation," i.e., in the same direction as the inclination of the bristles of the bristle portion (151*b*) of the rotating brush (151). As a result, the dust remaining between the air filter (130) and the bristle portion (151*b*), i.e., the dust almost separated from the air filter (130), uniformly adheres to the bristle portion (151*b*). Thus, the dust on the air filter (130) is reliably trapped on the bristle portion (151*b*). This can improve the efficiency of dust removal by the rotating brush (151).

Figure 34:
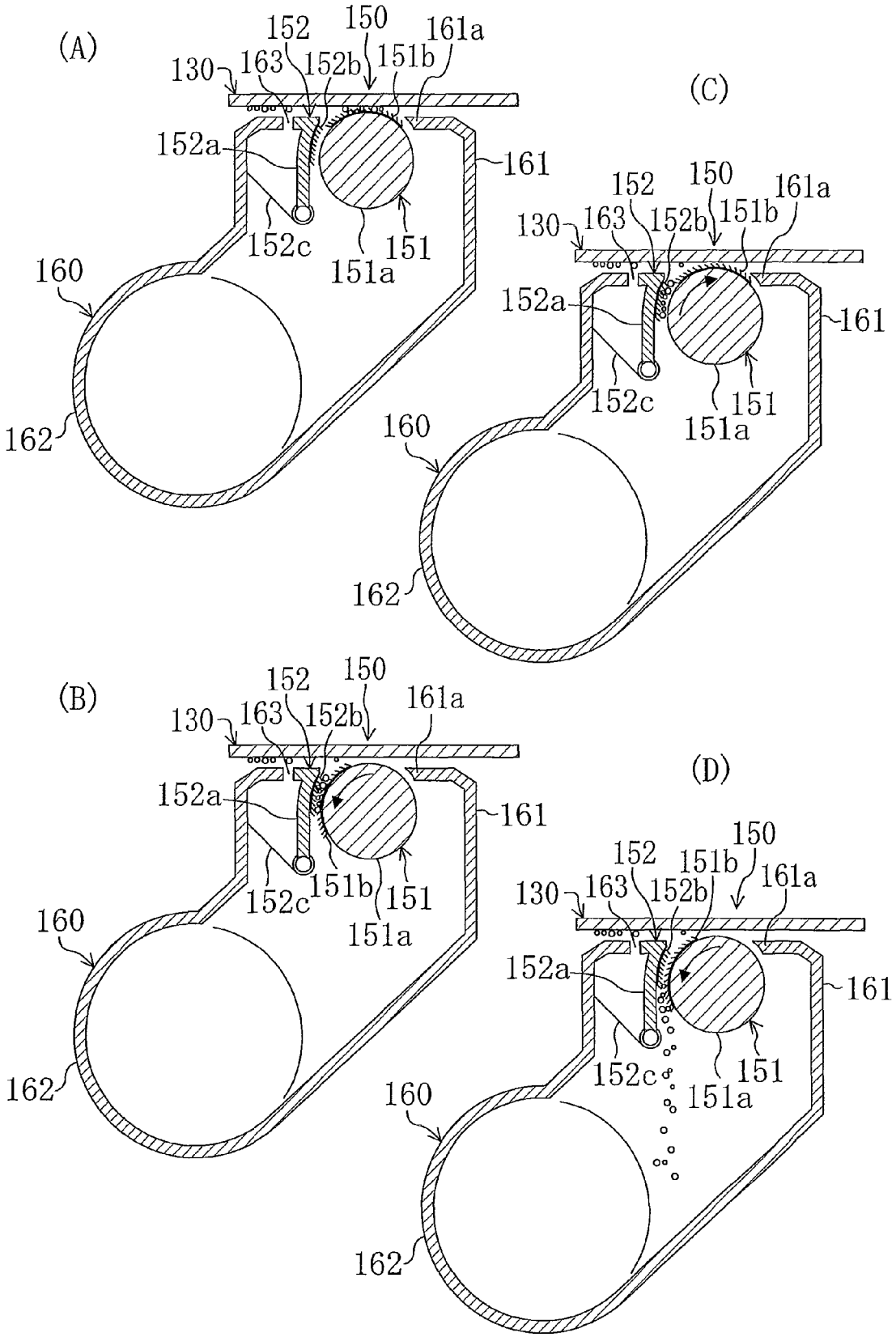
FIG. 34 is a lateral cross-sectional view illustrating how a dust removing unit of the second embodiment of the present invention works in brush cleaning operation.

Then, in the "brush cleaning operation," the rotating brush (151) rotates to the left in FIG. 34 (in the counterclockwise direction), with the indoor fan (121) kept stopped. In this case, the rotating brush (151) rotates with the bristle portions (51*b*, 52*b*) of the rotating brush (151) and the non-rotating brush (152) kept in contact with each other (see FIG. 34(B)). The rotating brush (151) stops after it rotates by a predetermined rotation angle.

Then, the rotating brush (151) rotates in the reverse direction (i.e., to the right in FIG. 34 (clockwise direction)). As a result, the dust trapped on the bristle portion (151*b*) of the rotating brush (151) is removed by the bristle portion (152*b*) of the non-rotating brush (152) (see FIG. 34(C)). Since the bristles of the bristle portion (152*b*) of the non-rotating brush (152) are inclined downward, i.e., in a direction opposite the direction of rotation of the rotating brush (151), the dust is scraped from the bristle portion (151*b*) of the rotating brush (151). The bristle portions (51*b*, 52*b*) in contact with each other push the body (152*a*) of the non-rotating brush (152) rearward, but the spring (152*c*) biases the body (152*a*) toward the rotating brush (151). Therefore, the bristle portions (51*b*, 52*b*) do not separate from each other, thereby pressing the non-rotating brush (152) to the rotating brush (151) in a suitable manner. This ensures the removal of the dust from the bristle portion (151*b*) of the rotating brush (151). In this way, the dust is trapped on the bristle portion (152*b*) of the non-rotating brush (152). The rotating brush (151) rotates to return to the original state (the state of FIG. 34(A)), and then stops.

Then, the rotating brush (151) rotates to the left (counterclockwise) again by a predetermined rotation angle. As a result, the dust trapped on the bristle portion (152*b*) of the non-rotating brush (152) is scraped by the bristle portion (151*b*) of the rotating brush (151), and falls in the container portion (162) of the dust container (160) (see FIG. 34(D). Since the bristles of the bristle portion (151*b*) of the rotating brush (151) are inclined toward the rotation direction, the dust is reliably scraped from the bristle portion (152*b*) of the non-rotating brush (152). In this case, as described above, the spring (152*c*) suitably presses the non-rotating brush (152) onto the rotating brush (151), thereby removing the dust from the non-rotating brush (152) in a more reliable manner. In this way, the dust trapped on the rotating brush (151) is removed, and is contained in the container portion (162) of the dust container (160). Then, the rotating brush (151) rotates to the right (clockwise) again to return to the original state (the state of FIG. 34(A)), and the "brush cleaning operation" is finished.

Once the "brush cleaning operation" is finished, the "dust removal operation" is performed again. Specifically, the air filter (130) is rotated again, and is stopped when the lever (144*a*) of the limit switch (144) is actuated again. As a result, the dust on part of the air filter (130) that has passed over the bristle portion (151*b*) of the rotating brush (151) is trapped on the bristle portion (151*b*) of the rotating brush (151) (the state shown in FIG. 34(A)). In this way, the "dust removal operation" and the "brush cleaning operation" are alternately performed. As a result, the dust is removed sequentially from predetermined parts of the air filter (130). When the dust is removed from every part of the air filter (130), the "dust removal operation" and the "brush cleaning operation" are completely finished. For example, when the lever (144*a*) of the limit switch (144) is actuated a predetermined number of times, the system determines that the air filter (130) has made a single turn. Then, the operations are finished.

In the "dust removal operation" and the "brush cleaning operation" described above, the dust amount in the dust container (160) is detected by the dust amount detection means (170). When the light intensity detected by the phototransistor (173) decreases to a set value (a lower limit value) or lower, the system determines that a predetermined amount of the dust has accumulated in the dust container (160), and the process is switched to the "dust transfer operation."

In the "dust transfer operation," the air filter (30) is stopped in the state shown in FIG. 27. The damper (182) in the damper box (181) is opened (the state shown in FIG. 29(B)). The indoor fan (121) is driven in this state. The air blowing from the indoor fan (121) sequentially passes through the entrance duct (186) and the damper box (181), and enters the dust container (160). This transfers the dust in the dust container (160) to the dust collection box (190) together with the air through the transfer duct (188). Then, the dust amount in the dust container (160) decreases, and the light intensity detected by the phototransistor (173) increases. When the detected light intensity increases to a set value (an upper limit value) or higher, the system determines that the dust in the dust container (160) is almost transferred (discharged), and the "dust transfer operation" is finished. Thereafter, the dust removal operation" or the "brush cleaning operation" is restarted.

In the "dust transfer operation," the brush receiving opening (163) of the dust container (160) is closed by the closure member (138) of the air filter (130). Therefore, when the air blowing from the indoor fan (121) enters the dust container (160), the dust in the dust container (160) does not flow out of the brush receiving opening (163). This can prevent the dust from falling in the room.

In the "dust transfer operation" described above, when the light intensity detected by the phototransistor (173) does not smoothly increase (e.g., when the detected light intensity does not vary for a certain period of time), the system determines that the air does not flow appropriately through the entrance duct (186) and the transfer duct (188). The flow of the air is inhibited, for example, by the dust filling the dust collection box (190) and the transfer duct (188), by clogging of the entrance duct (186), etc, or by the damper (72) which is broken and does not open. In this case, the indoor fan (121) is stopped to halt the "dust transfer operation." Then, the dust discharge operation described later or inspection is performed to resolve the trouble, and then the "dust transfer operation" is restarted.

In the filter cleaning operation of the present embodiment, the "dust discharge operation" is performed under the predetermined conditions. For example, as described above, when the light intensity detected by the phototransistor (173) does not increase in the "dust transfer operation," the system determines that the dust filled the dust collection box (190) and the transfer duct (188), thereby performing the "dust discharge operation." The "dust discharge operation" may automatically be performed after the "dust transfer operation" is performed predetermined times (for a predetermined time), or may optionally be performed by a command sent by a user through a remote controller.

In the "dust discharge operation," like in the "dust transfer operation," the air filter (30) is stopped in the state shown in FIG. 27. The damper (182) in the damper box (181) is closed (the state shown in FIG. 29(C)). In this state, the user inserts a hose of a cleaner into the nozzle receiver (210) of the decorative panel (111). Then, the nozzle receiver (210) enters the state shown in FIG. 32(B), and the air is sucked in the direction of an arrow. The suction allows for sucking of the dust in the dust collection box (190) into the cleaner through the transfer duct (188), the dust container (160), and the suction duct (187). In this case, the dust in the dust container (160) is also sucked into the cleaner through the suction duct (187). This discharges the dust in the dust collection box (190) and the dust container (160) outside the casing (110). In the "dust discharge operation," since the brush receiving opening (163) of the dust container (160) is closed by the closure member (138) of the air filter (130), the dust passing through or being contained in the dust container (160) does not flow out through the brush receiving opening (163). This can prevent the dust from falling in the room.

Advantages of Second Embodiment

Also in the present embodiment, like the first embodiment, the dust is discharged from the dust container (160) using the existing indoor fan (139). This can save the user's labor in discharging the dust without need for another transfer means, such as a suction fan, etc.

Also in the present embodiment, the air blowing from the indoor fan (121) and before flowing into the indoor heat exchanger (122) is brought into the dust container (160). Therefore, in the cooling operation, for example, the air before cooled in the indoor heat exchanger (122) is brought into the dust container (160), thereby preventing condensation formed by the cooled air in the dust container (160). This can protect the electronic components, such as the LED (172) and the phototransistor (173), from the condensation. This makes it possible to improve the reliability, and to reduce the cost and size due to the unnecessity of another means for preventing the condensation.

In the present embodiment, the closure member (138) is arranged in part of the air filter (130) so as to close the brush receiving opening (163) of the dust container (160) by the closure member (138) in the "dust transfer operation" and the "dust discharge operation." This can prevent the dust contained in the dust container (160) from flowing out of the brush receiving opening (163). Specifically, when the mesh member (137) of the air filter (130) is located above the brush receiving opening (163), the dust in the dust container (160) can pass through the mesh member (137) together with the air. However, this can be prevented by the present embodiment. Thus, falling of the dust into the room from the indoor unit (13) is prevented, thereby improving the reliability.

Third Embodiment

A Third embodiment of the present embodiment will be described below. The first and second embodiments described above are directed to the so-called in-ceiling indoor unit (13). However, the third embodiment is directed to a so-called ceiling-suspended indoor unit (13).

Figure 35:
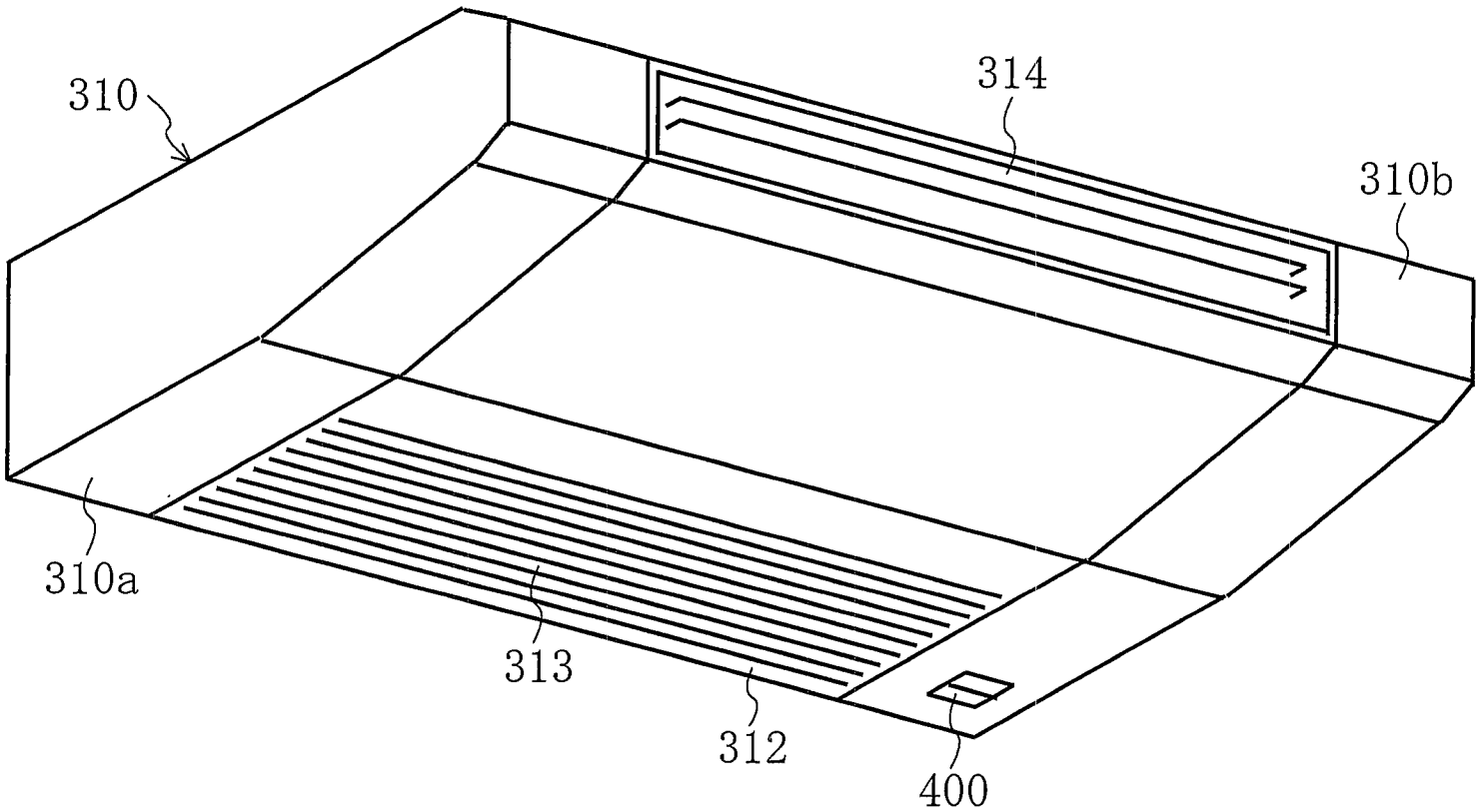
FIG. 35 is a perspective view illustrating an indoor unit of a third embodiment of the present invention as viewed from below.

As shown in FIG. 35, the indoor unit (13) of the present embodiment includes a flat, substantially-rectangular casing (310). The casing (310) is suspended from a ceiling of a room. A suction grille (312) is provided in a center of a lower surface (310*a*) of the casing (310), and the suction grille (312) has an inlet (313). An outlet (314) is formed in a center of a front surface (310*b*) of the casing (310). When viewed from the front surface (310*b*), a nozzle receiver (400) is arranged at a left end portion of the lower surface (310*a*) of the casing (310).

Figure 36:
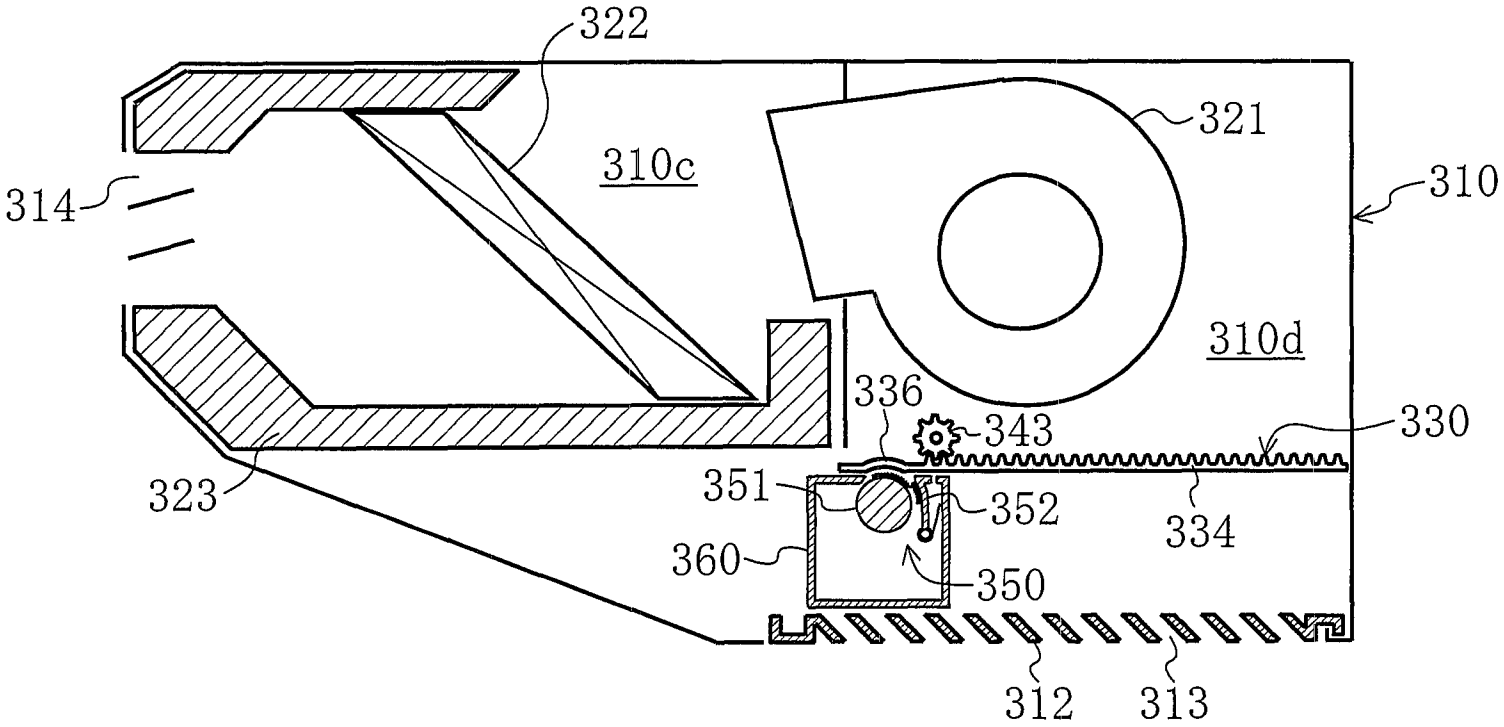
FIG. 36 is a vertical cross-sectional view illustrating the indoor unit of the third embodiment of the present invention cut at the center thereof.
Figure 37:
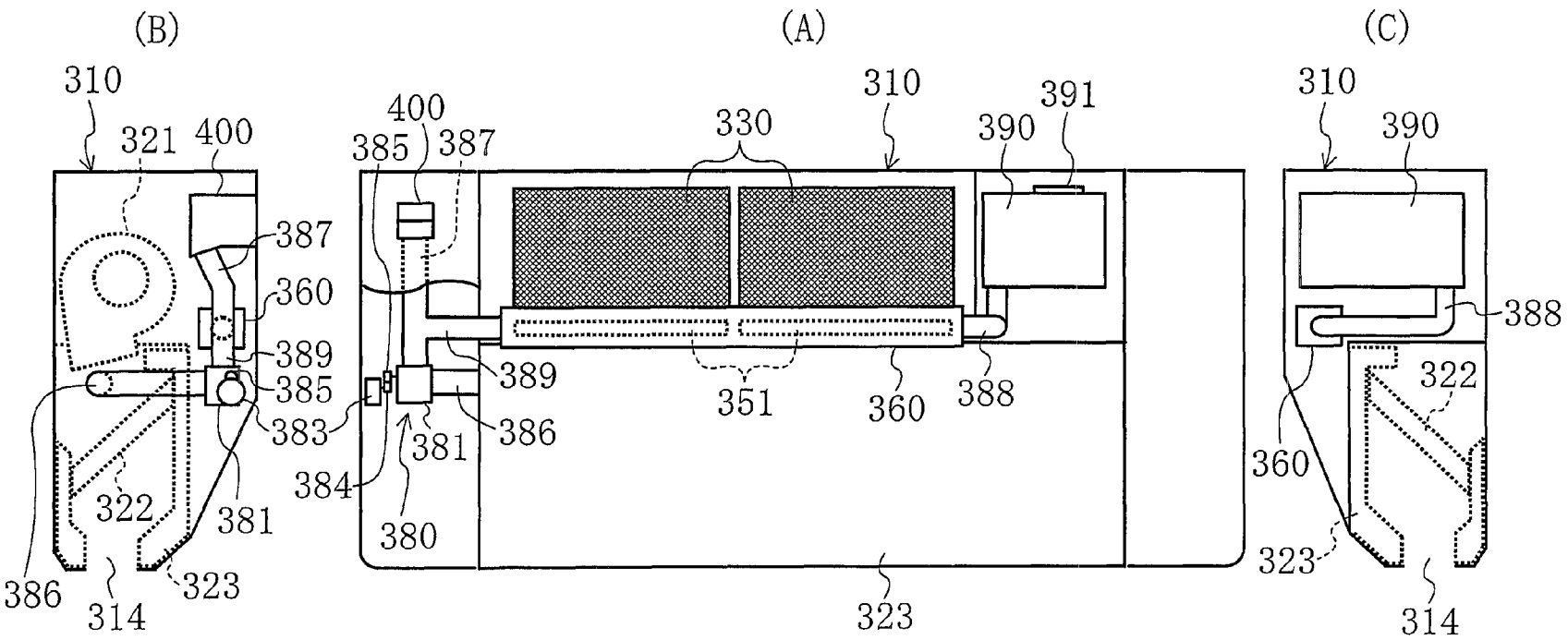

As shown in FIGS. 36 and 37, the casing (310) contains an indoor fan (321), an indoor heat exchanger (322), a drain pan (323), an air filter (330), a filter drive means (340), a dust removing unit (350), a dust container (360), a dust transfer unit (380), and a dust collection box (390). Space inside the casing (310) is divided into an air sucking room (310*d*) communicating with the inlet (313), and an air blowing room (310*c*) communicating with the outlet (314).

The indoor fan (321) is a so-called turbo fan, and is arranged above the inlet (313). An inlet side of the indoor fan (321) communicates with the air sucking room (310*d*), and an outlet side communicates with the air blowing room (310*c*). Although not shown, the indoor fan (321) includes a fan motor and an impeller.

The indoor heat exchanger (322) is configured as a cross-fin type fin-and-tube heat exchanger, and is placed in the air blowing room (310*c*). The indoor heat exchanger (322) is inclined toward the outlet side of the indoor fan (321). Heat exchange is performed between the indoor air (blowing air) sent from the indoor fan (321) and a refrigerant circulating in the indoor heat exchanger.

The drain pan (323) is arranged below the indoor heat exchanger (322) in the air blowing room (310*c*). The drain pan (323) receives drainage generated as a result of condensation of moisture in the air in the indoor heat exchanger (322).

Figure 38:
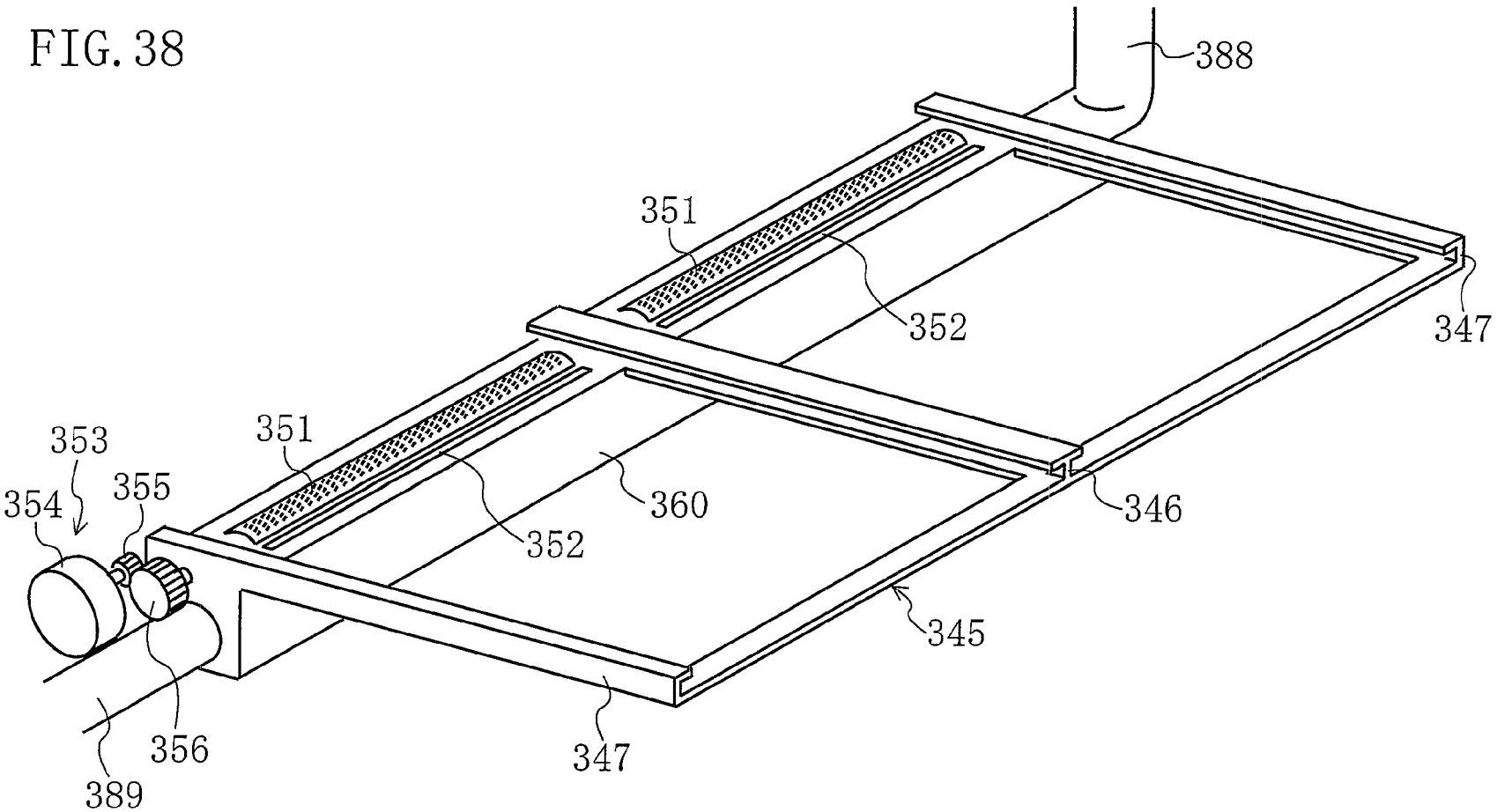
FIG. 38 is a perspective view illustrating a brush drive means and a filter guide of the third embodiment of the present invention as viewed from behind.
Figure 40:
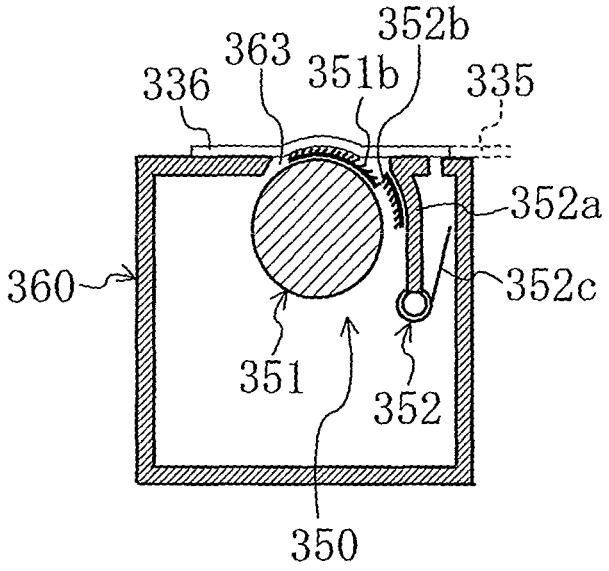
FIG. 40 is a lateral cross-sectional view illustrating the relationship between a dust container and a closure member of an air filter of the third embodiment of the present invention.

As shown in FIGS. 38 and 40, the dust container (360) is arranged in the air sucking room (310*d*) immediately above the inlet (313). The dust container (360) is in the shape of a narrow rectangular parallelepiped, and is arranged to extend in the lateral direction of the casing (310) (left-right direction in FIG. 37(A)). Two brush receiving openings (363) are formed in an upper surface of the dust container (360). Each of the brush receiving openings (363) is in the shape of a narrow rectangle extending in the longitudinal direction of the dust container (360). The two brush receiving openings (363) are aligned in the longitudinal direction of the dust container (360).

The dust removing unit (350) is provided to remove the dust trapped on the air filter (330). The dust removing unit (350) includes two pairs of a rotating brush (351) and a non-rotating brush (352), and a brush drive means (353).

As shown in FIG. 40, the pairs of the rotating brush (351) and the non-rotating brush (352) are arranged in the brush receiving openings (363) of the dust container (360), respectively. The rotating brush (351) and the non-rotating brush (352) are configured in the same manner as those of the second embodiment. Specifically, the rotating brush (351) includes a shaft portion (351*a*), and a bristle portion (351*b*) attached to part of a circumferential surface of the shaft portion (351*a*). The non-rotating brush (352) includes a body (352*a*), a bristle portion (352*b*), and a spring (352*c*).

The rotating brush (351) is driven by the brush drive means (353) to rotate in a reversible manner. As shown in FIG. 38, the brush drive means (353) includes a brush drive motor (354), and a drive gear (355) and a driven gear (356) engaging with each other. The drive gear (355) is attached to a drive shaft of the brush drive motor (354), and the driven gear (356) is connected to the shaft portion (351*a*) of the rotating brush (351). The brush drive means (353) rotates the rotating brush (351) to bring the bristle portions (351*b*, 352*b*) of the rotating brush (351) and the non-rotating brush (352) into contact with each other in the same manner as in the second embodiment, thereby removing the dust from the bristle portion (351*b*) of the rotating brush (351). The removed dust is contained in the dust container (360).

Figure 39:
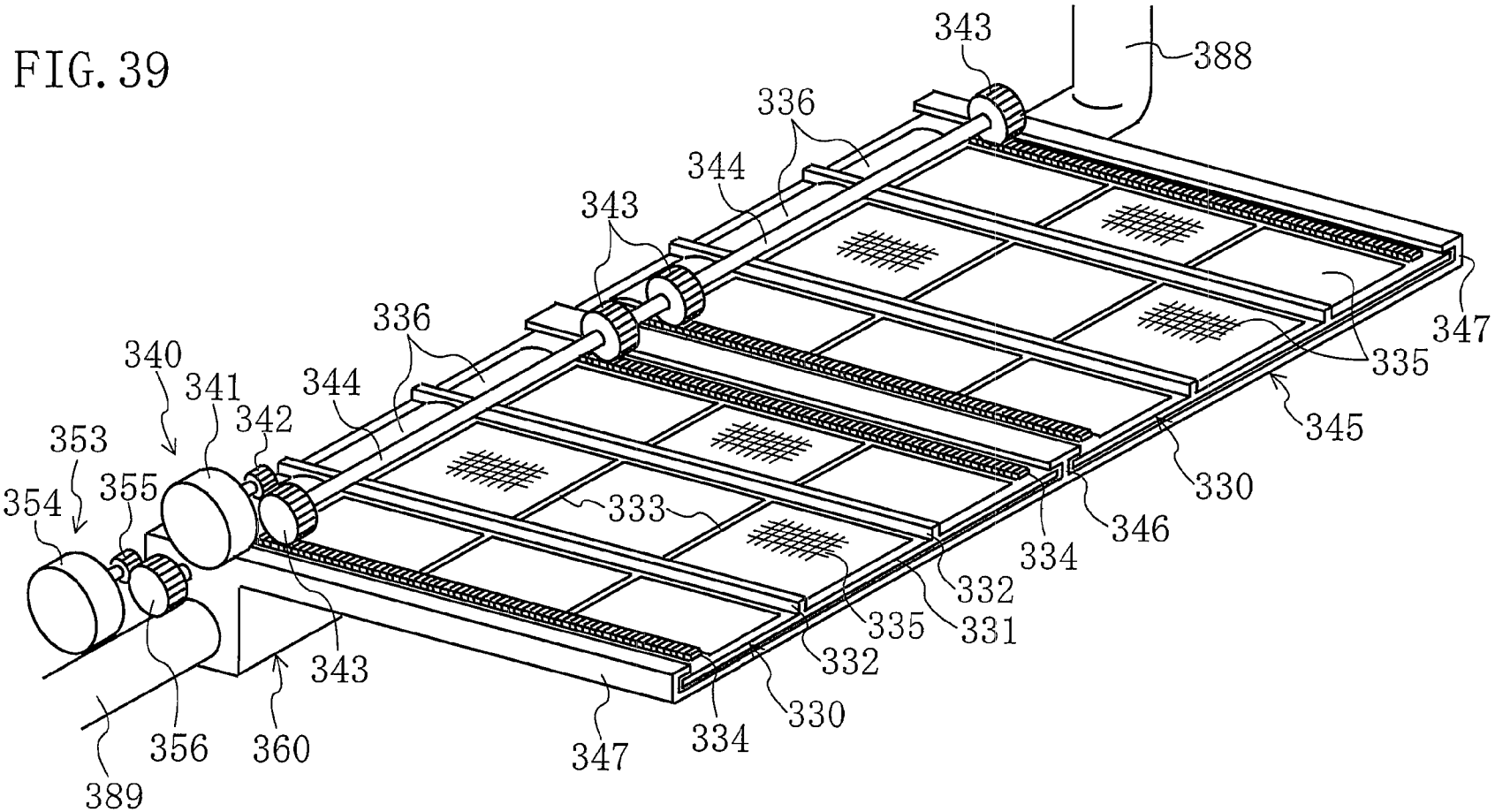
FIG. 39 is a perspective view illustrating the relationship between a filter drive means and an air filter of the third embodiment of the present invention as viewed from behind.

As shown in FIGS. 38 and 39, two air filters (330) are provided in the present embodiment. Each of the air filters (330) includes a filter body (331) in the shape of a rectangular frame. Longitudinal ribs (332) and lateral ribs (333) are arranged inside the frame-shaped filter body (331) in the shape of a grid, thereby dividing the space inside the frame into rectangular rooms, and a sheet-shaped mesh member (335) is attached to each of the rooms. The filter body (331) includes racks (334) attached to lateral ends thereof (the ends in the extending direction of the lateral ribs (333)). Each of the racks (334) extends substantially in the longitudinal direction of the filter body (331) (the extending direction of the longitudinal ribs (332)). The rack (334) engages with a driven gear (343) of a brush drive means (353) described later. The filter body (331) further includes a closure member (336) arranged at one of the longitudinal ends thereof. The closure member (336) extends substantially in the lateral direction of the filter body (331). The closure member (336) is made of, for example, a resin sheet, and unlike the mesh member (335), it does not allow the air to pass through. As described later in detail, the closure member (336) is provided to close the brush receiving opening (363) of the dust container (360).

The filter drive means (340) is provided to slide the air filter (330), and is placed in the air sucking room (310*d*). The filter drive means (340) includes a filter drive motor (341), a drive gear (342), four driven gears (343), and a filter mount (345). The drive gear (342) is connected to a drive shaft of the filter drive motor (341), and engages with one of the driven gears (343). The four driven gears (343) correspond to the racks (334) of the air filters (330), respectively. The four driven gears (343) are coupled to each other through a single driven axis (344). The filter mount (345) is a rectangular frame provided with two laterally aligned openings, and is integral with the dust container (360) as it is cantilevered from an upper end portion of the side surface of the dust container (360). The positions of the openings in the filter mount (345) correspond to the pairs of the rotating brush (351) and the non-rotating brush (352). A single center guide rail (346) and two peripheral guide rails (347) are formed on an upper surface of the filter mount (345). With the edges of the air filters (330) inserted in the guide rails (346, 347) as shown in FIG. 39, the guide rails (346, 347) function as a guide for slide movement of the air filters (330).

Figure 41:
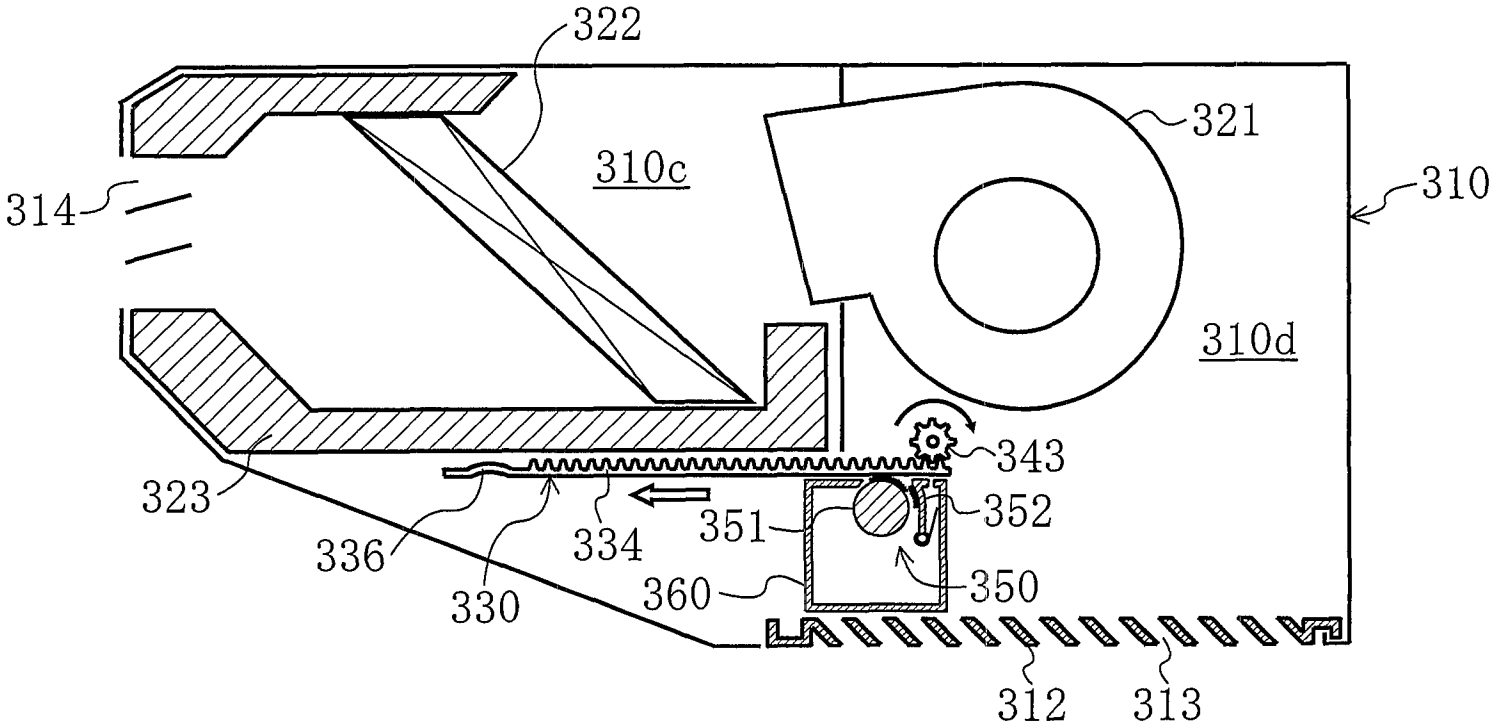
FIG. 41 is a vertical cross-sectional view illustrating the indoor unit of the third embodiment of the present invention cut at the center thereof.

As shown in FIG. 40, in the dust container (360), like the second embodiment described above, the closure member (336) of the air filter (330) can cover the rotating brush (351) and the non-rotating brush (352), and can close the brush receiving opening (363). Further, as shown in FIG. 41, when the filter drive means (340) drives the air filter (330) to slide, the mesh member (335) of the air filter (330) comes into contact with the bristle portion (351*b*) of the rotating brush (351), thereby removing the dust on the mesh member (335).

Figure 42:
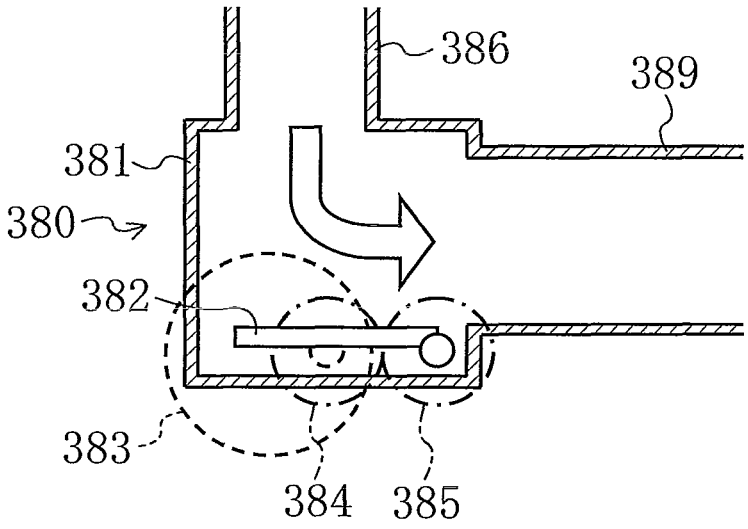
FIG. 42 is a cross-sectional view illustrating the structure of a major part of a dust transfer unit of the third embodiment of the present invention.
Figure 42:
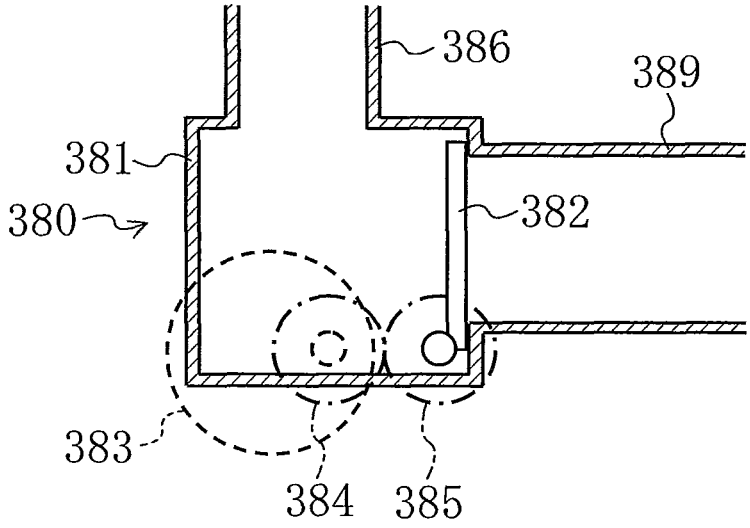

As shown in FIGS. 37, 38 and 42, the dust transfer unit (380) includes a damper box (381), an entrance duct (386), a suction duct (387), a transfer duct (388), and a connection duct (389).

The entrance duct (386) communicates with the air blowing room (310*c*) at one end, and communicates with the damper box (381) at the other end. The connection duct (389) is connected to the damper box (381) at one end, and is connected to an end of the dust container (360) at the other end. One end of the transfer duct (388) is connected to the other end of the dust container (360), and the other end of the transfer duct (388) is connected to the dust collection box (390). The dust collection box (390) has a larger volume than the dust container (360), and includes an exhaust port (391). Although not shown, the exhaust port (391) includes a filter. The suction duct (387) is connected to the middle of the connection duct (389) at one end, and is connected to the nozzle receiver (400) at the other end. The structure of the nozzle receiver (400) is the same as that described in the second embodiment. The damper box (381) contains a damper (382) for opening/closing the junction between the damper box (381) and the connection duct (389).

The dust transfer unit (380) includes a damper drive motor (383) for driving the damper (382) to open/close, and a drive gear (384) and a driven gear (385) engaging with each other. The drive gear (384) is attached to a drive shaft of the damper drive motor (383), and the driven gear (385) is attached to a rotation axis of the damper (382). In this configuration, the rotation of the damper drive motor (383) is transferred to the rotation axis of the damper (382), thereby switching the damper (382) between the opened state (see FIG. 42(A)) and the closed state (see FIG. 42(B)).

The indoor unit (13) of the present embodiment is also capable of switchably performing the normal operation of cooling/heating the room, and the filter cleaning operation of cleaning the air filter (330).

First, in the normal operation, the air filter (330) is stopped in the state shown in FIG. 40. Then, the brush receiving openings (363) of the dust container (360) are closed by the closure members (336) of the air filters (330), and the damper (382) in the damper box (381) is closed. Therefore, as described in the second embodiment, the air blowing from the indoor fan (321) does not enter the dust container (360) through the damper box (381). The dust in the dust container (360) does not flow out of the brush receiving openings (363).

In the filter cleaning operation, "dust removal operation," "brush cleaning operation," "dust transfer operation," and "dust discharge operation" are switchably performed in the same manner as described in the second embodiment.

First, in the "dust removal operation," the air filters (330) are allowed to slide with the indoor fan (321) stopped. This brings the mesh member (335) of each of the air filters (330) into contact with the bristle portion (351*b*) of the rotating brush (351), thereby removing the dust on the mesh member (335). The "brush cleaning operation" is performed in the same manner as described in the second embodiment. The "brush cleaning operation" allows the dust trapped on the bristle portion (351*b*) of the rotating brush (351) to accumulate in the dust container (360).

Figure 43:
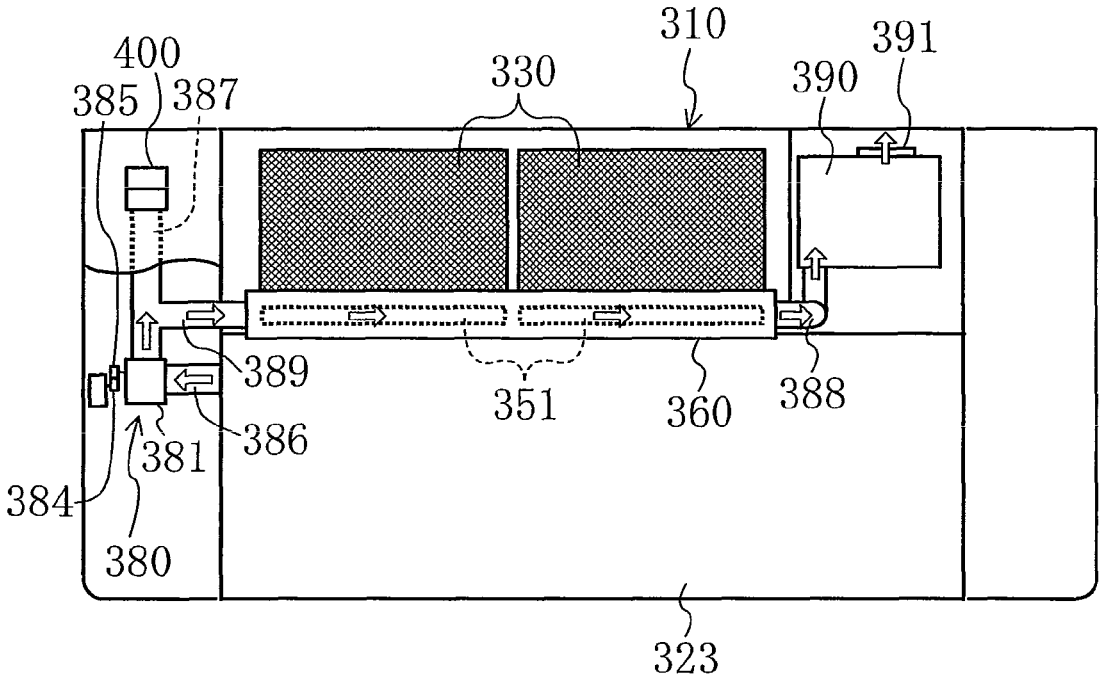
FIG. 43 is a lateral cross-sectional view illustrating air flow in the indoor unit in the filter cleaning operation according to the third embodiment of the present invention as viewed from below.

In the "dust transfer operation," the air filters (330) are stopped in the state shown in FIG. 40. The damper (382) in the damper box (381) is opened. The indoor fan (321) is driven in this state. Then, as indicated by an arrow in FIG. 43, the air blowing from the indoor fan (321) is brought into the damper box (381) from the air blowing room (310*c*) through the entrance duct (386), and enters the dust container (360) through the connection duct (389). As a result, the dust in the dust container (360) is transferred to the dust collection box (390) together with the air through the transfer duct (388). This allows the dust in the dust container (360) to accumulate in the dust collection box (390). The air entered the dust collection box (390) is discharged from the exhaust port (391). Also in the "dust transfer operation," the brush receiving openings (363) of the dust container (360) are closed by the closure members (336) of the air filters (330). Therefore, the dust in the dust container (360) does not flow out of the brush receiving openings (363).

Figure 44:
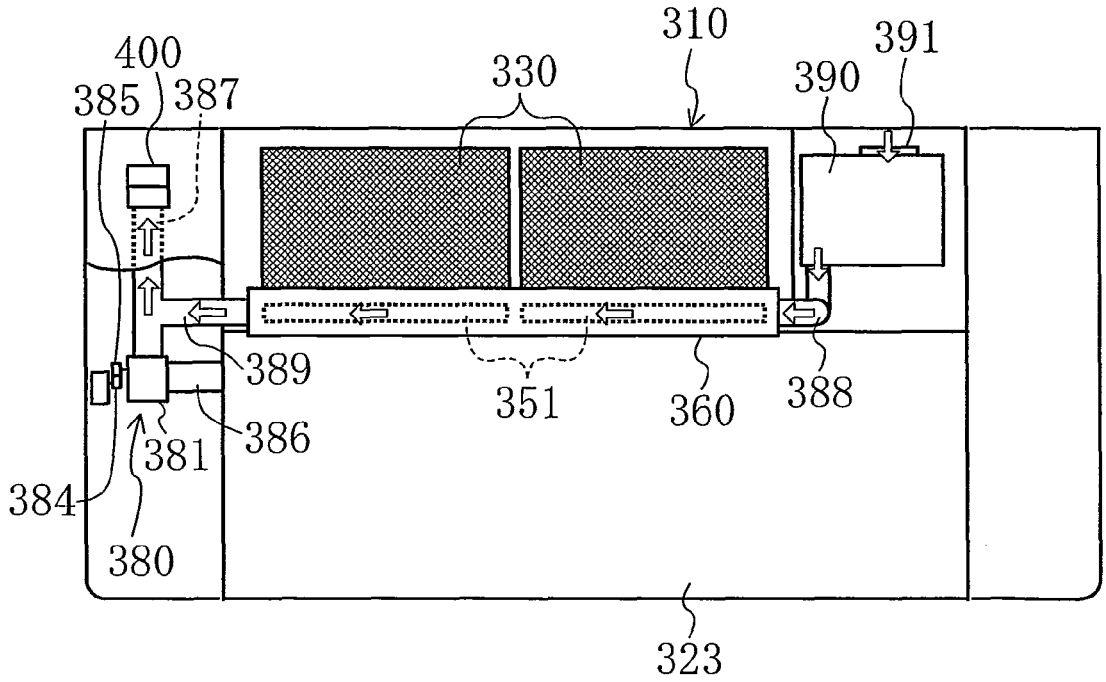
FIG. 44 is a lateral cross-sectional view illustrating air flow in the indoor unit in the filter cleaning operation according to the third embodiment of the present invention as viewed from below.

In the "dust discharge operation," the air filters (330) are stopped in the state shown in FIG. 40 in the same manner in the "dust transfer operation." The damper (382) in the damper box (381) is closed. In this state, the user inserts a hose of a cleaner into the nozzle receiver (400). Then, as indicated by an arrow in FIG. 44, the dust in the dust collection box (390) is sucked into the cleaner sequentially through the transfer duct (388), the dust container (360), and the suction duct (387) in this order. In this case, the dust in the dust container (360) is also sucked into the cleaner. Also in the "dust discharge operation," the dust passing through or being contained in the dust container (360) does not flow out of the brush receiving openings (363).

Figure 45:
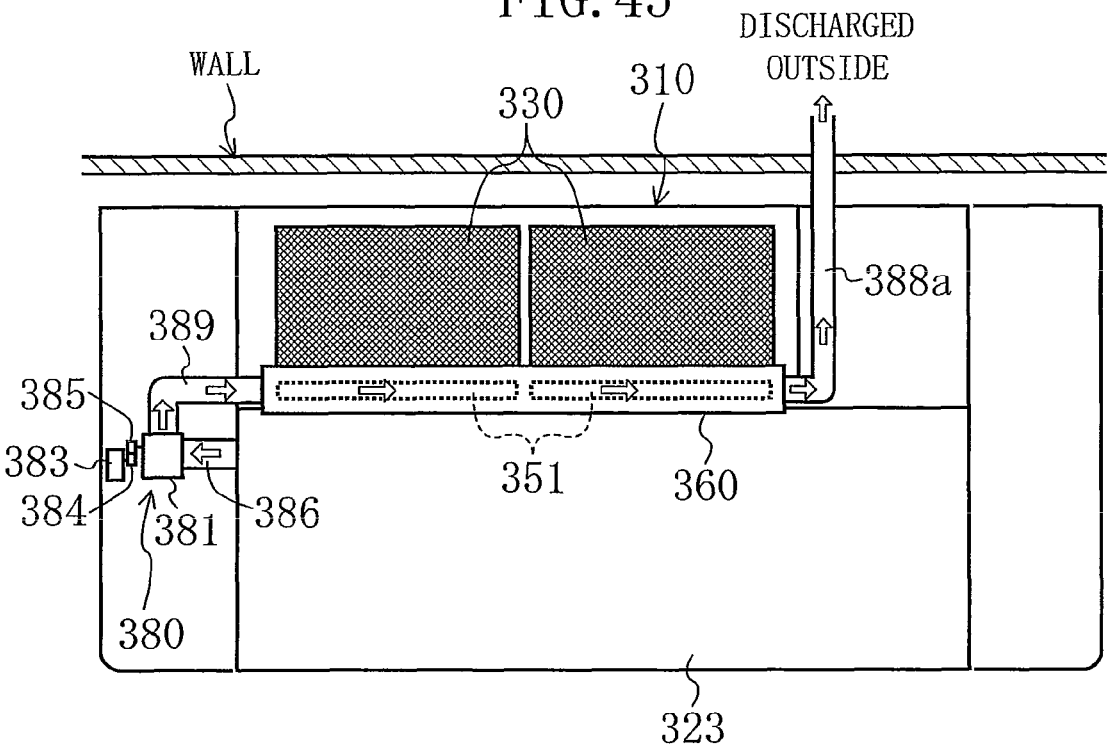
FIG. 45 is a lateral cross-sectional view illustrating the indoor unit of the third embodiment of the present invention as viewed from below.

FIG. 45 shows a possible modified example of the third embodiment. Specifically, the dust collection box (390) is omitted from the third embodiment, and the transfer duct (388*a*) is configured to communicate with the outside. In this case, the dust in the dust container (360) is directly transferred and discharged to the outside together with the air in the "dust transfer operation." This can save the user's labor in discharging the dust. As a matter of course, the nozzle receiver is no longer necessary in this modified example.

Other Embodiments

The above-described embodiments may be modified in the following manner.

For example, the embodiments are directed to the indoor unit (13) installed on the ceiling. However, the present invention is not limited thereto, and may be applied to a so-called wall-suspended indoor unit attached to a wall in the room.

The embodiments are directed to the indoor unit (13) including the indoor heat exchanger (37, 122, 322) arranged near the outlet side of the indoor fan (39, 121, 321). However, the present invention can be applied to an indoor unit in which the indoor heat exchanger is arranged near the inlet side of the indoor fan and downstream of the air filter (30).

In the first embodiment, the damper (72) in the supply duct (71) is opened/closed by using the moving air filter (40). However, the present invention is not limited thereto, and the damper (72) may be opened/closed using the drive motor (56) for moving the air filter (40).

In the first embodiment, the damper (72) in the supply duct (71) may be omitted, and an open/close means for opening/closing the path may be arranged downstream of the dust container (60) (e.g., in the middle of the discharge duct (74)). In this case, the air blowing from the indoor fan (39) is always brought into the dust container (60) through the supply duct (71), irrespective of whether the normal operation or the filter cleaning operation is performed. However, when the open/close means provided downstream of the dust container (60) is configured to close in the normal operation, and to open in the filter cleaning operation, the dust in the dust container (60) can be transferred (discharged) outside the casing (34) only in the cleaning operation.

In the filter cleaning operation in the first embodiment, there is no need for performing the dust transfer operation every time. For example, in the first embodiment, the same dust amount detection means as that of the second embodiment may be arranged in the dust container (60) so as to perform the dust transfer operation in response to the detected dust amount.

In the embodiments described above, the air blowing from the indoor fan (39, 121, 321) and before passing through the indoor heat exchanger (37, 122, 322) is brought into the supply duct (71) or the entrance duct (186, 386). However, according to the present invention, the same dust transfer operation can be performed by supplying the air that passed through the indoor heat exchanger (37, 122, 322) into the supply duct (71) or the entrance duct (186, 386). In this case, when the room is being cooled, for example, the air cooled in the indoor heat exchanger (37, 122, 322) flows through the supply duct (71), etc., thereby causing condensation on the supply duct (71), etc. For preventing the condensation, the supply duct (71) and the dust container (60, 160, 360) may be covered with a heat insulator.

In the embodiments described above, the dust removed by the rotating brush (51, 151, 351) is temporarily contained in the dust container (60, 160, 360), and then it is transferred. However, according to the present invention, the dust container (60, 160, 360), the supply duct (71), the entrance duct (186, 386) may be omitted, and the dust removed by the rotating brush (51, 151, 351) may directly be transferred by the air blowing from the indoor fan (39, 121, 321).

The above-described embodiments are provided as preferred examples in nature, and are not intended to limit the scope, applications, and use of the invention.

INDUSTRIAL APPLICABILITY

As described above, the present invention is useful for an indoor unit of an air conditioner having the function of removing dust on a filter.

The invention claimed is:

1. An indoor unit of an air conditioner comprising:

a casing containing an indoor heat exchanger, an indoor fan for sucking air from inside of a room, and an air filter arranged on an inlet side of the indoor fan;

a dust removing unit for removing dust trapped on the air filter; and a dust transfer unit for transferring the dust removed by the dust removing unit to a predetermined location using air blowing from the indoor fan, the dust transfer unit including a supply duct having an inlet port arranged upstream of the indoor heat exchanger and downstream of the indoor fan such that air blowing from the indoor fan flows into the dust container through the supply duct.

2. The indoor unit of the air conditioner of claim 1, wherein the indoor fan is arranged to blow the air sucked from the inside of the room to the indoor heat exchanger, and the dust transfer unit is configured to transfer the dust removed by the dust removing unit to the predetermined location using the air blowing from the indoor fan and before passing through the indoor heat exchanger.

3. The indoor unit of the air conditioner of claim 1, further comprising:

a columnar dust container for containing the dust removed by the dust removing unit, wherein the dust transfer unit is configured to bring the air blowing from the indoor fan into one end side of the dust container without allowing the air to pass through the air filter so as to transfer the dust contained in the dust container from the other end side of the dust container to the predetermined location together with the air.

4. The indoor unit of the air conditioner of claim 2 or 3, wherein the number of rotations of the indoor fan is maximized when the dust transfer unit is transferring the dust.

5. The indoor unit of the air conditioner of claim 3, wherein the indoor fan is arranged to blow the air sucked from the inside of the room to the indoor heat exchanger, and the dust transfer unit is configured to bring the air blowing from the indoor fan and before passing through the indoor heat exchanger to the dust container.

6. The indoor unit of the air conditioner of claim 5, wherein the dust transfer unit includes a discharge duct through which the dust contained in the dust container is transferred to the predetermined location together with the air.

7. The indoor unit of the air conditioner of claim 2 or 5, wherein an adjuster plate for adjusting a flow direction of the air is provided at an outlet through which the air blowing from the indoor fan is supplied to the inside of the room, and the adjuster plate is adjusted to maximize flow resistance of the outlet when the dust transfer unit is transferring the dust.

8. The indoor unit of the air conditioner of claim 2 or 5, wherein supply of a heating medium to the indoor heat exchanger is stopped when the dust transfer unit is transferring the dust.

9. The indoor unit of the air conditioner of claim 3, wherein the dust transfer unit includes an open/close unit for opening/closing the inlet port into which the air blowing from the indoor fan enters.

10. The indoor unit of the air conditioner of claim 3, wherein the dust transfer unit includes an air collecting plate arranged at the inlet port into which the air blowing from the indoor fan enters.

11. The indoor unit of the air conditioner of claim 3, wherein the dust transfer unit is configured to transfer the dust contained in the dust container outside the casing.

12. The indoor unit of the air conditioner of claim 3, further comprising:

a dust collection box larger in volume than the dust container; wherein the dust transfer unit is configured to transfer the dust contained in the dust container to the dust collection box.

13. The indoor unit of the air conditioner of claim 3, wherein the dust removing unit includes a brush member provided in the dust container and is in contact with the air filter, and a filter moving unit for moving the air filter relative to the brush member.

14. The indoor unit of the air conditioner of claim 13, wherein an open/close unit for opening/closing the inlet port by moving the air filter is arranged at the inlet port of the dust transfer unit into which the air blowing from the indoor fan enters.

15. The indoor unit of the air conditioner of claim 13, wherein the brush member of the dust removing unit includes a bristle portion made of pile fabric and is in contact with the air filter.

16. The indoor unit of the air conditioner of claim 13, wherein the brush member is arranged in an opening formed in an upper surface of the dust container, and an edge of the opening positioned rearward of the brush member in the direction of movement of the air filter functions as a guide for allowing the dust on the air filter that passed over the brush member to move together with the air filter.

17. The indoor unit of the air conditioner of claim 16, wherein the edge of the opening is gradually tapered toward the brush member.

18. The indoor unit of the air conditioner of claim 17, wherein the brush member includes a cylindrical shaft portion, and a bristle portion arranged on an outer circumferential surface of the shaft portion, and an end face of the edge of the opening is curved to correspond to the bristle portion.

19. The indoor unit of the air conditioner of claim 13, wherein the brush member is arranged in an opening formed in an upper surface of the dust container, and a closure member for closing the opening is formed in part of the air filter.

* * * * *